US012545391B2

(12) United States Patent
Holda et al.

(10) Patent No.: US 12,545,391 B2
(45) Date of Patent: Feb. 10, 2026

(54) STERN DRIVES AND NOISE-VIBRATION-HARSHNESS DAMPENING ASSEMBLIES FOR A STERN DRIVES

(71) Applicant: Brunswick Corporation, Mettawa, IL (US)

(72) Inventors: Joseph A. Holda, West Bend, WI (US); Jeremiah L. Prochnow, Appleton, WI (US)

(73) Assignee: Brunswick Corporation, Mettawa, IL (US)

( * ) Notice: Subject to any disclaimer, the term of this patent is extended or adjusted under 35 U.S.C. 154(b) by 444 days.

(21) Appl. No.: 18/123,829

(22) Filed: Mar. 20, 2023

(65) Prior Publication Data

US 2023/0312075 A1 Oct. 5, 2023

Related U.S. Application Data

(60) Provisional application No. 63/324,251, filed on Mar. 28, 2022.

(51) Int. Cl.
*B63H 21/30* (2006.01)
*B63H 20/02* (2006.01)

(52) U.S. Cl.
CPC ..... *B63H 21/305* (2013.01); *B63H 20/02* (2013.01); *B63H 2020/025* (2013.01)

(58) Field of Classification Search
CPC . B63H 21/305; B63H 20/02; B63H 2020/025
See application file for complete search history.

(56) References Cited

U.S. PATENT DOCUMENTS

| | | | |
|---|---|---|---|
| 1,161,935 | A | 11/1915 | Heck |
| 1,774,956 | A | 9/1930 | Wilson |
| 2,372,247 | A | 3/1945 | Pemberton |
| 2,384,436 | A | 9/1945 | Bossen |
| 2,536,894 | A | 1/1951 | Wanzer |
| 2,549,481 | A | 4/1951 | Kiekhaefer |
| 2,688,299 | A | 9/1954 | Gload et al. |

(Continued)

FOREIGN PATENT DOCUMENTS

| | | |
|---|---|---|
| CA | 1317165 | 5/1993 |
| CN | 101475050 | 7/2009 |

(Continued)

OTHER PUBLICATIONS

NTN Overview & CVJ Technology, Prepared for Mercury Marine on Aug. 7, 2018. www.ntnamericas.com.

(Continued)

*Primary Examiner* — Stephen P Avila
(74) *Attorney, Agent, or Firm* — Andrus Intellectual Property Law, LLP

(57) ABSTRACT

A noise-vibration-harshness (NVH) dampening cover for a stern drive is configured to propel a marine vessel in water. The NVH dampening cover comprises a plurality of panels which together enclose a powerhead suspended from a transom of the marine vessel. The plurality of panels is configured to be suspended from an inner portion of a mounting assembly, the mounting assembly having an outer portion for mounting the stern drive to the transom.

14 Claims, 35 Drawing Sheets

(56) References Cited

U.S. PATENT DOCUMENTS

| | | | | |
|---|---|---|---|---|
| 2,732,819 | A | 1/1956 | Irgens | |
| 2,804,838 | A | 9/1957 | Moser | |
| 2,877,733 | A | 3/1959 | Harris | |
| 2,902,967 | A | 9/1959 | Wanzer | |
| 3,021,725 | A | 2/1962 | Schneider | |
| 3,084,657 | A | 4/1963 | Kiekhaefer | |
| 3,094,967 | A | 6/1963 | Willis | |
| 3,164,122 | A | 1/1965 | Morris | |
| 3,171,382 | A | 3/1965 | Bergstedt | |
| 3,285,221 | A | 11/1966 | North | |
| 3,310,021 | A | 3/1967 | Shimanckas | |
| 3,376,842 | A | 4/1968 | Wynne | |
| 3,404,586 | A | 10/1968 | Fanstone | |
| 3,483,843 | A | 12/1969 | Hawthorne | |
| 3,486,478 | A | 12/1969 | Halliday | |
| 3,548,775 | A | 12/1970 | Hammond et al. | |
| 3,707,939 | A | 1/1973 | Berg | |
| 3,738,306 | A | 6/1973 | Pinkerton | |
| 3,756,188 | A | 9/1973 | Smith | |
| 3,795,219 | A | 3/1974 | Peterson | |
| 3,841,257 | A | 10/1974 | Strang | |
| 3,881,443 | A | 5/1975 | Hamp | |
| 3,896,757 | A | 7/1975 | Kucher | |
| 3,930,436 | A | 1/1976 | Hedenberg | |
| 3,946,698 | A | 3/1976 | LaFollette et al. | |
| 3,952,687 | A | 4/1976 | Brownlie | |
| 3,982,496 | A | 9/1976 | Blanchard | |
| 4,276,034 | A | 6/1981 | Kashmerick | |
| 4,297,097 | A | 10/1981 | Kiekhaefer | |
| 4,323,354 | A | 4/1982 | Blanchard | |
| 4,343,612 | A | 8/1982 | Blanchard | |
| 4,371,348 | A | 2/1983 | Blanchard | |
| 4,418,633 | A | 12/1983 | Krautkremer et al. | |
| 4,432,737 | A | 2/1984 | Johansson | |
| 4,619,548 | A | 10/1986 | Kazaoka et al. | |
| 4,668,195 | A | 5/1987 | Smith | |
| 4,747,795 | A | 5/1988 | Kawamura et al. | |
| 4,887,982 | A | 12/1989 | Newman et al. | |
| 4,907,994 | A | 3/1990 | Jones | |
| 4,911,666 | A | 3/1990 | Gage et al. | |
| 4,932,907 | A | 6/1990 | Newman et al. | |
| 5,024,639 | A | 6/1991 | Crispo | |
| 5,108,325 | A | 4/1992 | Livingston et al. | |
| 5,112,256 | A | 5/1992 | Clement | |
| 5,224,888 | A | 7/1993 | Fujimoto et al. | |
| 5,280,708 | A | 1/1994 | Sougawa et al. | |
| 5,463,990 | A | 11/1995 | Rush, II et al. | |
| 5,465,633 | A | 11/1995 | Bernloehr | |
| 5,480,330 | A | 1/1996 | Brown | |
| 5,487,687 | A | 1/1996 | Idzikowski et al. | |
| 5,522,744 | A | 6/1996 | Schlogel | |
| 5,540,606 | A | 7/1996 | Strayhorn | |
| 5,660,571 | A | 8/1997 | Nakayasu et al. | |
| 5,674,099 | A | 10/1997 | Muramatsu et al. | |
| 5,711,742 | A | 1/1998 | Leinonen et al. | |
| 5,743,774 | A | 4/1998 | Adachi et al. | |
| 6,146,220 | A | 11/2000 | Alby et al. | |
| 6,183,321 | B1 | 2/2001 | Alby et al. | |
| 6,273,771 | B1 | 8/2001 | Buckley et al. | |
| 6,276,977 | B1 | 8/2001 | Treinen et al. | |
| 6,286,845 | B1 | 9/2001 | Lin | |
| 6,287,159 | B1 | 9/2001 | Polakowski et al. | |
| 6,350,167 | B1 * | 2/2002 | Neisen | B63H 23/32 440/111 |
| 6,402,577 | B1 | 6/2002 | Treinen et al. | |
| 6,431,928 | B1 | 8/2002 | Aarnivuo | |
| 6,544,085 | B1 | 4/2003 | Menard et al. | |
| 6,554,083 | B1 | 4/2003 | Kerstetter | |
| 6,609,939 | B1 | 8/2003 | Towner et al. | |
| 7,163,427 | B1 | 1/2007 | Lee | |
| 7,244,152 | B1 | 7/2007 | Uppgard | |
| 7,267,587 | B2 | 9/2007 | Oguma et al. | |
| 7,290,638 | B2 | 11/2007 | Shiino et al. | |
| 7,347,753 | B1 | 3/2008 | Caldwell et al. | |
| 7,387,556 | B1 | 6/2008 | Davis | |
| 7,517,262 | B2 | 4/2009 | Mizutani | |
| 7,527,537 | B2 | 5/2009 | Mizutani | |
| 7,588,473 | B2 | 9/2009 | Beachy Head | |
| 7,641,527 | B1 | 1/2010 | Balaji et al. | |
| 7,662,005 | B2 | 2/2010 | Provost | |
| 7,699,674 | B1 | 4/2010 | Wald et al. | |
| 7,794,295 | B2 | 9/2010 | Beachy Head | |
| 7,871,302 | B2 | 1/2011 | Provost | |
| 7,886,678 | B2 | 2/2011 | Mizutani | |
| 7,896,304 | B1 | 3/2011 | Eichinger et al. | |
| 8,118,630 | B2 | 2/2012 | Okabe et al. | |
| 8,118,701 | B2 | 2/2012 | Okabe et al. | |
| 8,142,247 | B2 | 3/2012 | Konakawa et al. | |
| 8,157,694 | B2 | 4/2012 | Nakamura et al. | |
| 8,246,398 | B2 | 8/2012 | Inaba | |
| 8,246,399 | B2 | 8/2012 | Inaba | |
| 8,327,789 | B2 | 12/2012 | Emch | |
| 8,425,373 | B2 | 4/2013 | Okabe et al. | |
| 8,485,854 | B2 | 7/2013 | Gallato et al. | |
| 8,651,904 | B2 | 2/2014 | Pellegrinetti et al. | |
| 8,690,616 | B2 | 4/2014 | Grassi et al. | |
| 8,715,021 | B2 | 5/2014 | Horkko et al. | |
| 8,795,011 | B2 | 8/2014 | Takase et al. | |
| 8,808,045 | B2 | 8/2014 | Lundqvist et al. | |
| 8,821,140 | B2 | 9/2014 | Paval | |
| 9,205,906 | B1 | 12/2015 | Eichinger | |
| 9,233,743 | B2 | 1/2016 | Daikoku et al. | |
| 9,296,458 | B2 | 3/2016 | Saruwatari et al. | |
| 9,334,034 | B1 | 5/2016 | Waldvogel et al. | |
| 9,446,828 | B1 | 9/2016 | Groeschel et al. | |
| 9,475,560 | B1 | 10/2016 | Jaszewski et al. | |
| 9,776,700 | B2 | 10/2017 | Beachy Head | |
| 9,809,289 | B2 | 11/2017 | Nutt et al. | |
| 9,849,957 | B1 | 12/2017 | Grahl et al. | |
| 9,896,175 | B2 | 2/2018 | Galletta, Jr. | |
| 10,215,278 | B1 | 2/2019 | Techscherer et al. | |
| 10,315,747 | B1 | 6/2019 | Jaszewski et al. | |
| 10,392,091 | B2 | 8/2019 | Galletta, Jr. | |
| 10,518,858 | B1 | 12/2019 | Klawitter et al. | |
| 10,752,328 | B1 | 8/2020 | Bielefeld et al. | |
| 10,800,502 | B1 | 10/2020 | Alby et al. | |
| 11,068,297 | B2 | 7/2021 | Galletta, Jr. | |
| 11,130,554 | B1 | 9/2021 | Alby et al. | |
| 11,292,568 | B2 | 4/2022 | Galletta, Jr. | |
| 2003/0047379 | A1 * | 3/2003 | Lecours | B63H 21/30 181/204 |
| 2007/0004294 | A1 | 1/2007 | Mansfield et al. | |
| 2008/0188147 | A1 * | 8/2008 | Mansfield | B63H 20/02 440/75 |
| 2013/0045648 | A1 | 2/2013 | Kinpara et al. | |
| 2021/0339839 | A1 | 11/2021 | Galletta, Jr. | |

FOREIGN PATENT DOCUMENTS

| | | |
|---|---|---|
| GB | 364207 | 1/1932 |
| JP | 6004958 | 10/2016 |
| WO | WO 2007020906 | 2/2007 |
| WO | WO 2017223240 | 12/2017 |

OTHER PUBLICATIONS

Extended European Search Report for EP 23164747.0 dated Aug. 30, 2023.

Extended European Search Report for European Patent Application No. 23 164754.6, dated Sep. 19, 2023.

Intent to Grant issued in Corresponding EP Application No. 23164747.0, dated May 28, 2025.

NTN, Tri-Ball Joint, Constant Velocity Joints (Small and Medium size). Cat. No. 5602-V/E. Available online from URL: https://www.ntnglobal.com/en/products/catalog/en/5602/index.html. NTN Corporation, 2013.

NTN, Constant Velocity Joints for Industrial Machines: Application Examples. Cat.No. 5604/E. Available online from URL: https://www.ntnglobal.com/en/products/catalog/en/5604/index.html. NTN Corporation 2019.

NTN, Constant Velocity Joints for industrial machines. Cat. No.

(56) References Cited

OTHER PUBLICATIONS

5603-V/E. Available online from URL: https://https://www.ntnglobal.com/en/products/catalog/en/5603/index.html. NTN Corporation. 2005.

* cited by examiner

STERN DRIVES AND NOISE-VIBRATION-HARSHNESS DAMPENING ASSEMBLIES FOR A STERN DRIVES

CROSS REFERENCE TO RELATED APPLICATION

This application claims priority to U.S. Provisional Application No. 63/324,251, filed Mar. 28, 2022, which is incorporated herein by reference in its entirety.

FIELD

The present disclosure relates to marine drives, and in particular to stern drives having a powerhead for propulsion, for example an electric motor.

BACKGROUND

The following U.S. Patents are incorporated herein by reference in entirety.

U.S. Pat. No. 6,287,159 discloses a support apparatus for a marine propulsion system in a marine vessel wherein a compliant member is attachable to the transom of a marine vessel. In certain applications, the compliant member is directly attached to an intermediate plate and to an external frame member that is, in turn, attached directly to the transom of the marine vessel. The intermediate plate is attached directly to components of the marine propulsion system to provide support for the marine propulsion system relative to the transom, but while maintaining non-contact association between the marine propulsion system and the transom.

U.S. Pat. No. 9,446,828 discloses an apparatus for mounting a marine drive to a hull of a marine vessel. An outer clamping plate faces an outside surface of the hull and an inner clamping plate faces an opposing inside surface of the hull. A marine drive housing extends through the hull. The marine drive housing is held in place with respect to the hull by at least one vibration dampening sealing member which is disposed between the inner and outer clamping plates. A first connector clamps the outer clamping plate to the outside surface of the hull and a second connector clamps the inner clamping plate to the outer clamping plate. The inner and outer clamping plates are held at a fixed distance from each other so that a consistent compression force is applied to the vibration dampening sealing member.

SUMMARY

This Summary is provided to introduce a selection of concepts which are further described herein below in the Detailed Description. This Summary is not intended to identify key or essential features of the claimed subject matter, nor is it intended to be used as an aid in limiting the scope of the claimed subject matter.

In non-limiting examples, a stern drive comprises a powerhead, a drive assembly comprising a propulsor for propelling a marine vessel in water, a mounting assembly configured to suspend the powerhead inside of a transom of the marine vessel and configured to suspend the drive assembly outside of the transom of the marine vessel, and a noise-vibration-harshness (NVH) dampening cover extending over the powerhead inside the marine vessel.

Optionally, the NVH dampening cover is coupled to the mounting assembly. Optionally, the mounting assembly comprises an inner portion facing inside the marine vessel and an outer portion facing outside the marine vessel, and wherein the NVH dampening cover is suspended from the inner portion. Optionally, the NVH cover comprises a plurality of panels which together at least partially surround the powerhead. Optionally, the plurality of panels is configured to fit through a hole in the transom for mounting the stern drive, and wherein the plurality of panels is fastened to the inner portion of the mounting assembly from outside the marine vessel. Optionally, the stern drive comprises a seal configured to prevent ingress of fluid to the NVH dampening cover. Optionally, the seal is located between the NVH dampening cover and the inner portion of the mounting assembly. Optionally, the seal is located between two panels in the plurality of panels.

Optionally, the plurality of panels comprises a top panel and opposing side panels each of which are fastened to the inner portion of the mounting assembly. Optionally, the stern drive comprises a seal configured to prevent ingress of fluid to the NVH dampening cover, wherein the seal is located between the top panel an at least one of the side panels. Optionally, at least one of the plurality of panels comprises slots which are engageable with fasteners on the mounting assembly which facilitates hanging of the plurality of panels on the mounting assembly during assembly, and which thereby facilitates further installation by fastening to the mounting assembly. Optionally, the NVH dampening cover comprises at least one through-port for connecting rigging members to the powerhead.

In non-limiting examples, a method is for installing a stern drive via a hole in a transom of a marine vessel. The method may comprise providing a noise-vibration-harshness (NVH) dampening cover comprised of a plurality of panels that are sized to fit through the hole in the transom; coupling an inner portion of a mounting assembly to the transom, the mounting assembly having an outer portion being configured to suspend a powerhead inside the marine vessel and to suspend a drive assembly comprising a propulsor outside of the marine vessel; before or after coupling the inner portion of the mounting assembly to the transom, inserting each of the plurality of panels into the marine vessel via the hole; and manually accessing the plurality of panels via the hole and fastening the plurality of panels to the inner portion of the mounting assembly.

Optionally, at least one panel in the plurality of panels is fastened to the inner portion of the mounting assembly by first hanging the respective panel on a fastener extending from the inner portion of the mounting assembly and then tightening the fastener. Optionally, the method comprises, from outside the marine vessel, inserting the powerhead into the marine vessel via the hole. Optionally, the method comprises fastening at least two of the plurality of panels together. Optionally, the method comprises positioning a seal between at least two of the plurality of panels. Optionally, the method comprises comprising positioning a seal between the plurality of panels and the inner portion of the mounting assembly.

In non-limiting examples, a noise-vibration-harshness (NVH) dampening cover is for a stern drive configured to propel a marine vessel in water. The NVH dampening cover may comprise a plurality of panels which together enclose a powerhead suspended from a transom of the marine vessel, and wherein the plurality of panels is configured to be suspended from an inner portion of a mounting assembly, the mounting assembly having an outer portion for mounting the stern drive to the transom.

Optionally, the plurality of panels is configured to mate with each other when suspended from the inner portion of the mounting assembly, thereby enclosing the powerhead. Optionally, the plurality of panels comprises opposing side panels and a top panel which is seated on top of the opposing side panels. Optionally, the opposing side panels are fastened to each other. Optionally, the NVH dampening cover comprises at least one rigging port in the plurality of panels, the at least one rigging port facilitating connection of rigging connectors to the powerhead.

These and combinations other than those summarized above are possible within the scope of the present disclosure, as would be apparent to one having ordinary skill in the art.

BRIEF DESCRIPTION OF THE DRAWINGS

The present disclosure includes the following figures.

DETAILED DESCRIPTION

Figure 1:
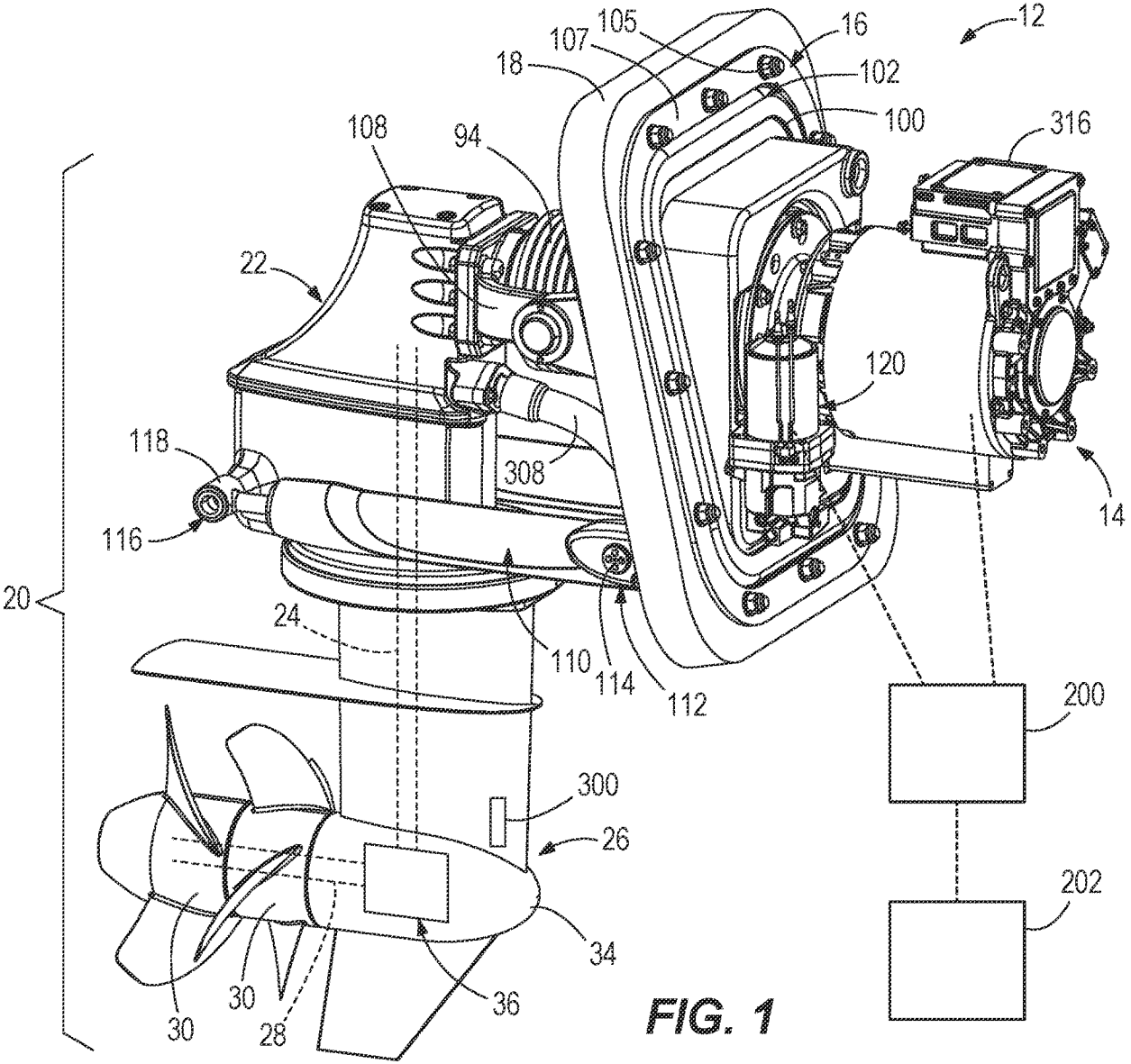
FIG. 1 is a starboard side perspective view of a stern drive according to the present disclosure.
Figure 2:
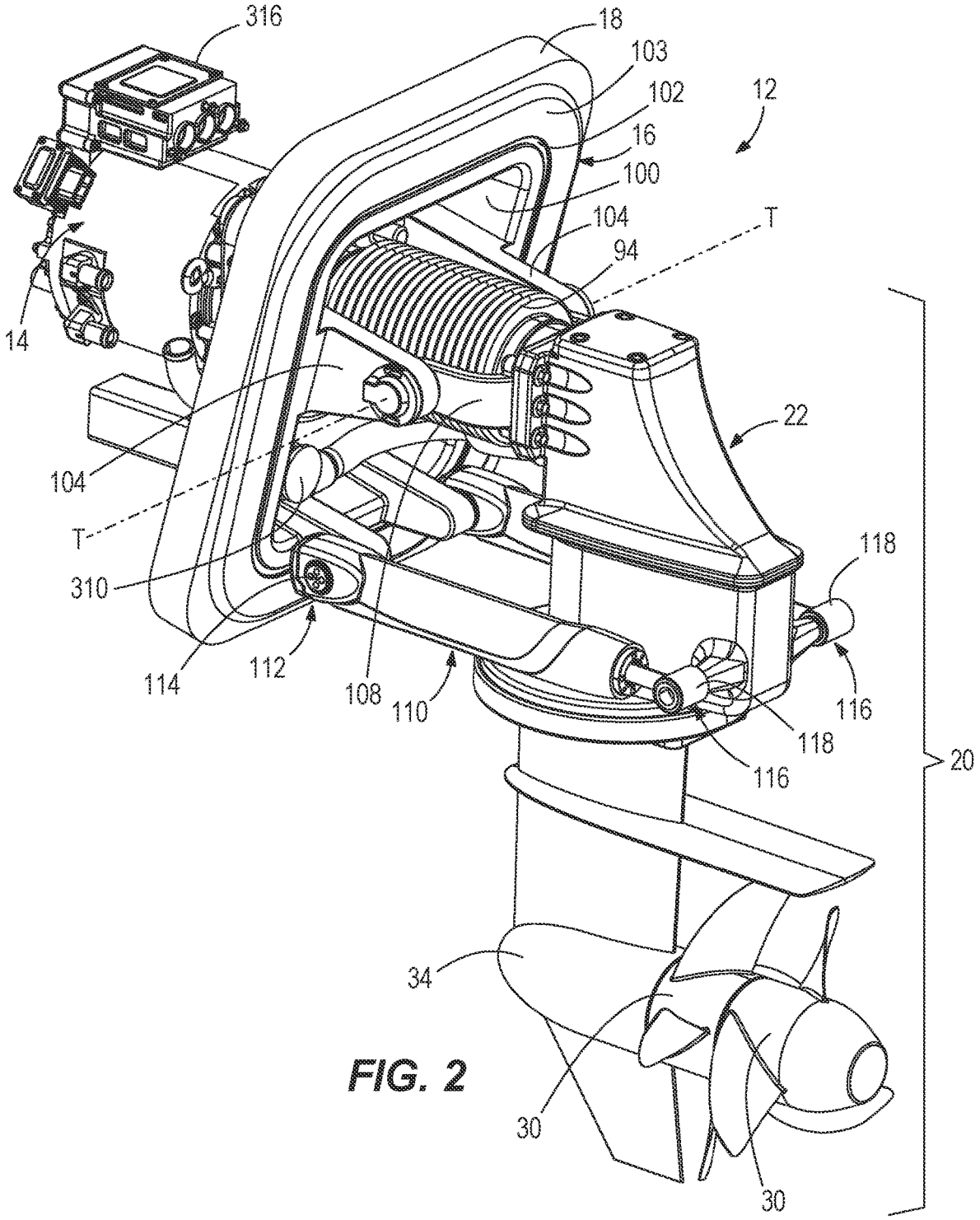
FIG. 2 is a port side perspective view of the stern drive.
Figure 3:
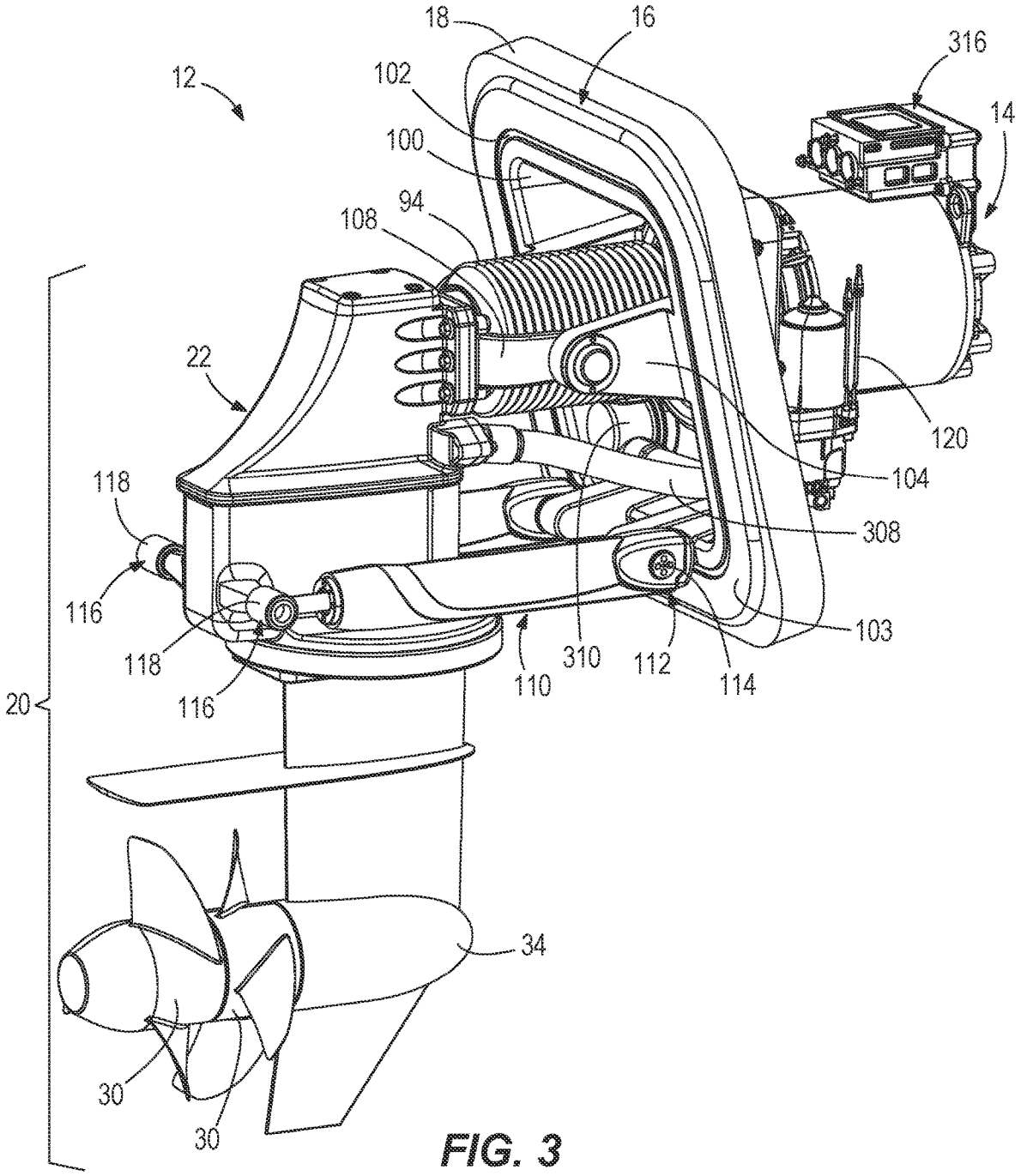
FIG. 3 is a starboard side perspective view of the stern drive.

FIGS. 1-8 illustrate a stern drive 12 for propelling a marine vessel in a body of water. Referring to FIG. 1, the stern drive 12 has a powerhead, which in the illustrated example is an electric motor 14, a mounting assembly 16 which affixes the electric motor 14 to and suspends the electric motor 14 from the transom 18 of the marine vessel, and a drive assembly 20 coupled to the mounting assembly 16. The illustrated powerhead is not limiting and in other examples the powerhead may include an engine and/or a combination of an engine and an electric motor, and/or any other suitable means for powering a marine drive. The mounting assembly 16 is configured so that the powerhead which in the illustrated example is an electric motor 14 is suspended (i.e., cantilevered) from the interior of the transom 18, above the bottom of the hull of the marine vessel. As will be further explained below, the drive assembly 20 is trimmable up and down relative to the mounting assembly 16, including in non-limiting examples wherein a majority or an entirety of the drive assembly 20 is raised completely out of the water. The drive assembly 20 has a driveshaft housing 22 containing a driveshaft 24 and a gearcase housing 26 containing one or more output shaft(s) 28, e.g., one or more propulsor shaft(s). The output shaft(s) 28 extends from the rear of the gearcase housing 26 and support one or more propulsors(s) 30 configured to generate thrust in the water for propelling the marine vessel. The output shaft(s) 28 extend generally transversely to the driveshaft 24. In the illustrated example, propulsor(s) 30 include two counter-rotating propellers. However this is not limiting, and the present disclosure is applicable to other arrangements, including arrangements wherein one or more output shaft(s) 28 are not counter-rotating and/or wherein the one or more output shaft(s) 28 extend from the front of the gearcase housing 26, and/or wherein the propulsor(s) 30 include one or more impellers and/or any other mechanism for generating a propulsive force in the water.

Figure 7:
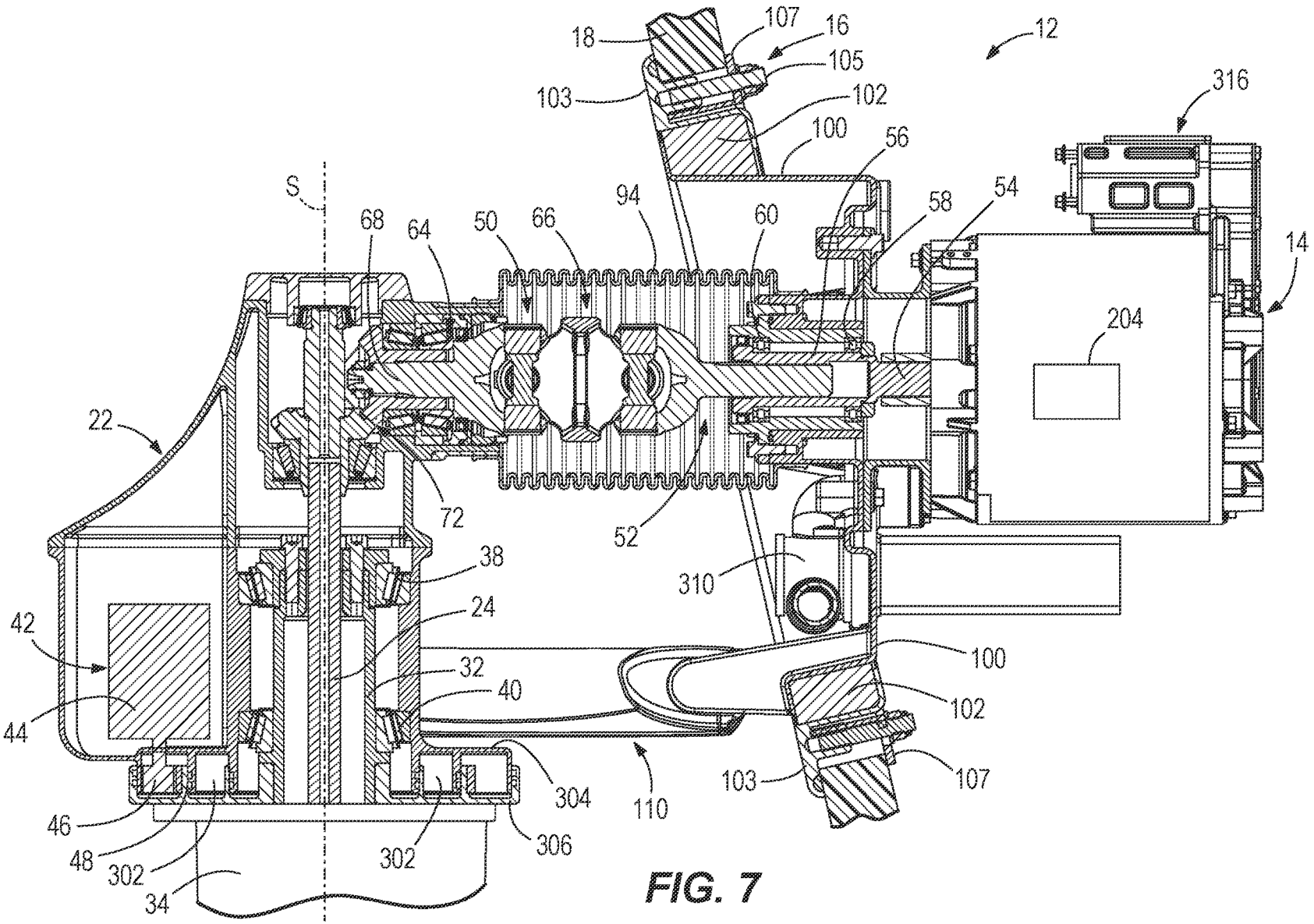
FIG. 7 is a starboard side sectional view of the stern drive.

Referring to FIGS. 1 and 7, the gearcase housing 26 is steerable about a steering axis S (see FIG. 7) relative to the driveshaft housing 22. The gearcase housing 26 (see FIG. 1) has a steering housing 32 (see FIG. 7) which extends upwardly into the driveshaft housing 22, as well as a torpedo housing 34 which depends from the steering housing 32. An angle gearset 36 (see FIG. 1) in the torpedo housing 34 operably couples the lower end of the driveshaft 24 to the output shaft(s) 28 so that rotation of the driveshaft 24 causes rotation of the output shaft(s) 28, which in turn causes rotation of the propulsor(s) 30.

Referring to FIG. 7, upper and lower bearings 38, 40 are disposed radially between the steering housing 32 and the driveshaft housing 22. The upper and lower bearings 38, 40 rotatably support the steering housing 32 relative to the driveshaft housing 22. A steering actuator 42 is configured to cause rotation of the gearcase housing 26 relative to the driveshaft housing 22. In the illustrated example, the steering actuator 42 is an electric motor 44 located in the driveshaft housing 22. The electric motor 44 has an output gear 46 which is meshed with a ring gear 48 on the steering housing 32 so that rotation of the output gear 46 causes rotation of the gearcase housing 26 about the steering axis S. As further explained below, operation of the electric motor 44 can be controlled via a conventional user input device located at the helm of the marine vessel or elsewhere, which facilitates control of the steering angle of the gearcase housing 26 and associated propulsors(s) 30. This facilitates steering control of the marine vessel. The type and configuration of the steering actuator 42 can vary from what is shown and in other examples could include one or more hydraulic actuators, electro-hydraulic actuators, and/or any other suitable actuator for causing rotation of the gearcase housing 26. Other suitable examples are disclosed in the above-incorporated U.S. Pat. No. 10,800,502.

Figure 5:
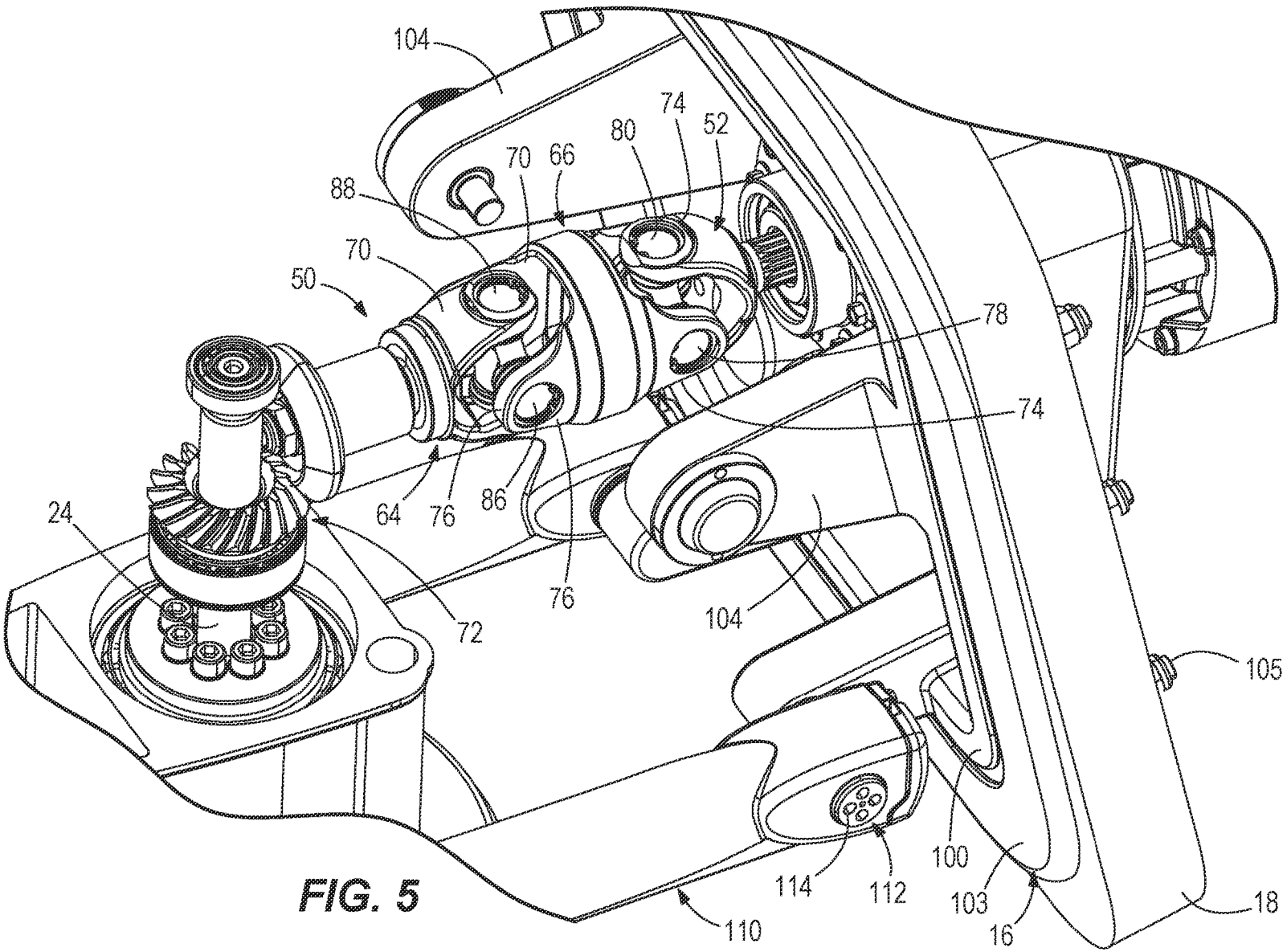
FIG. 5 is a perspective view looking down at a universal joint of the stern drive which couples a powerhead, which in the illustrated example includes an electric motor, to a driveshaft of the stern drive.
Figure 6:
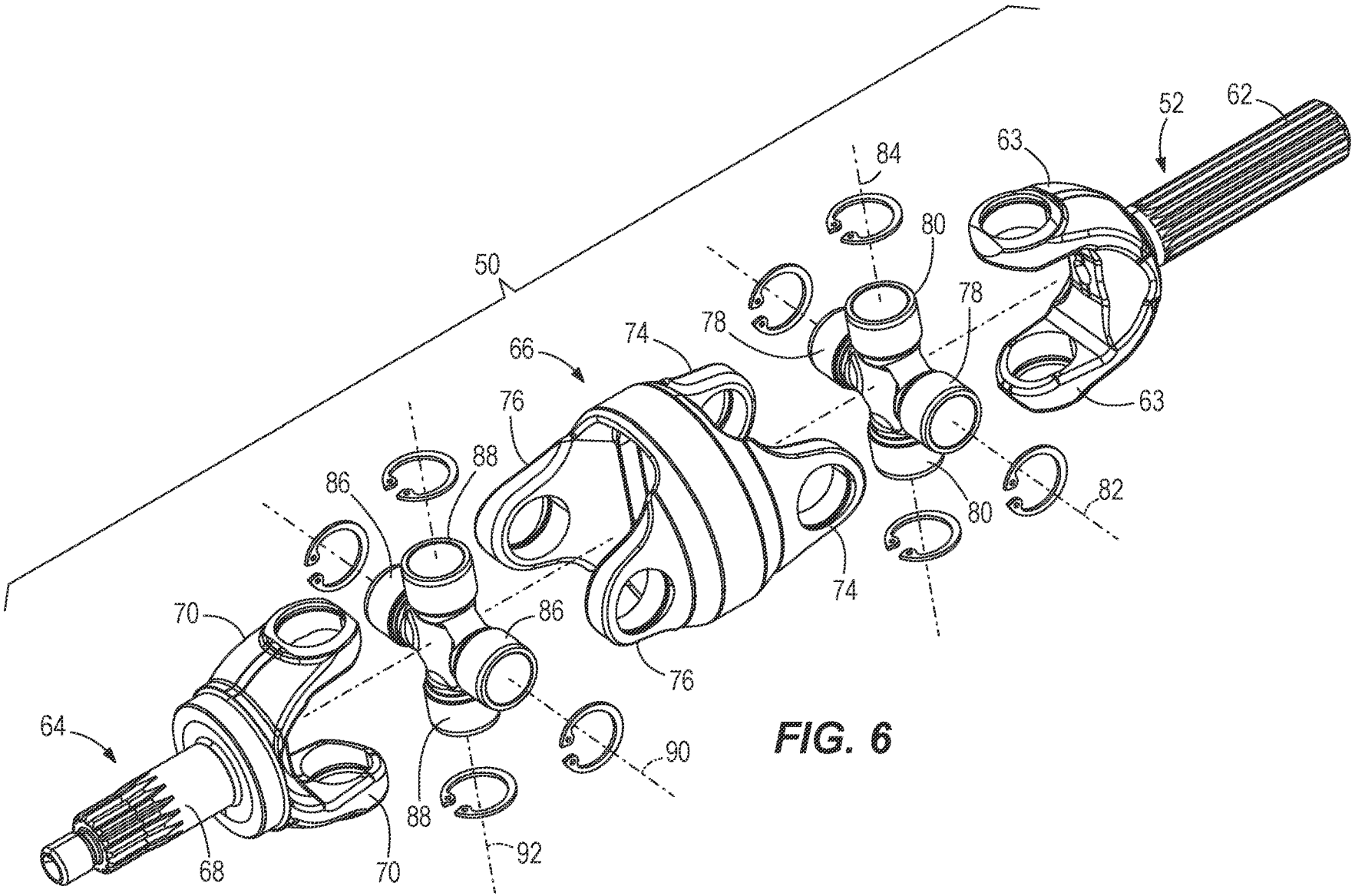
FIG. 6 is an exploded view of the universal joint.

Referring to FIGS. 5-7, a universal joint 50 couples the electric motor 14 to the driveshaft 24 so that operation of the electric motor 14 causes rotation of the driveshaft 24, which in turn causes rotation of the output shaft(s) 28. The universal joint 50 is also advantageously configured to facilitate trimming of the drive assembly 20 an amount sufficient to raise at least a majority of the drive assembly 20 out of the water, for example during periods of non-use. The universal joint 50 has an input member 52 which is rotatably engaged with an output shaft 54 of the electric motor 14, an output member 64 which is rotatably engaged with the driveshaft 24, and an elongated body 66 which rotatably couples the input member 52 to the output member 64. The input member 52 has an externally-splined input shaft 62 and input arms 63 which form a U-shape. The output member 64 has an output shaft 68 and output arms 70 which form a U-shape. The elongated body 66 has a first pair of arms 74 which form a U-shape and an opposing second pair of arms 76 which form a U-shape. Input pivot pins 78, 80 pivotably couple the input arms 63 of the input member 52 to the first pair of arms 74 of the elongate body 66 along a first input pivot axis 82 and along a second input pivot axis 84 which is perpendicular to the first input pivot axis 82. Output pivot pins 86, 88 pivotably couple the output arms 70 of the output member 64 to the second pair of arms 76 of the elongated body 66 along a first output pivot axis 90 and along a second output pivot axis 92 which is perpendicular to the first output pivot axis 90.

Referring to FIG. 7, an internally splined sleeve 56 is rotatably supported in the mounting assembly 16 by inner and outer bearings 58, 60. The output shaft 54 of the electric motor 14 is fixed to the splined sleeve 56 so that rotation of the output shaft 54 causes rotation of the splined sleeve 56. The externally-splined input shaft 62 of the universal joint 50 extends into meshed engagement with the splined sleeve 56 so that rotation of the splined sleeve 56 causes rotation of the input member 52. The output shaft 68 of the universal joint 50 is coupled to the driveshaft 24 by an angle gearset 72 located in the driveshaft housing 22 and configured so that rotation of the output member 64 causes rotation of the driveshaft 24. Thus, it will be understood that operation of the electric motor 14 causes rotation of the universal joint 50, which in turn causes rotation of the driveshaft 24 and output shaft(s) 28. The splined engagement between the input member 52 and splined sleeve 56 also advantageously permits telescoping movement of the input member 52 during trimming of the drive assembly 20, as will be further described below with reference to FIGS. 8-9. A flexible bellows 94 encloses the universal joint 50 relative to the mounting assembly 16 and the driveshaft housing 22.

Referring now to FIGS. 1-4 and 7, the mounting assembly 16 has a rigid mounting plate 100, a vibration dampening (e.g., rubber or other pliable and/or resilient material) mounting ring 102, and a rigid mounting ring 103 which is fastened to the transom 18 by fasteners 105 and a fastening ring 107 to couple the vibration dampening mounting ring 102 and rigid mounting plate 100 to the transom 18. A pair of rigid mounting arms 104 extends rearwardly from the rigid mounting plate 100 and is pivotably coupled to a rigid, U-shaped mounting bracket 108 extending forwardly from the top of the driveshaft housing 22. The pivot joint between the rigid mounting arms 104 and mounting bracket 108 defines a trim axis T (see FIG. 2) about which the drive assembly 20 is pivotably (trimmable), up and down relative to the mounting assembly 16. The type and configuration of mounting assembly 16 can vary from what is shown, and a non-limiting example of the mounting assembly 16 is described herein below with reference to FIGS. 14-21.

Figure 14:
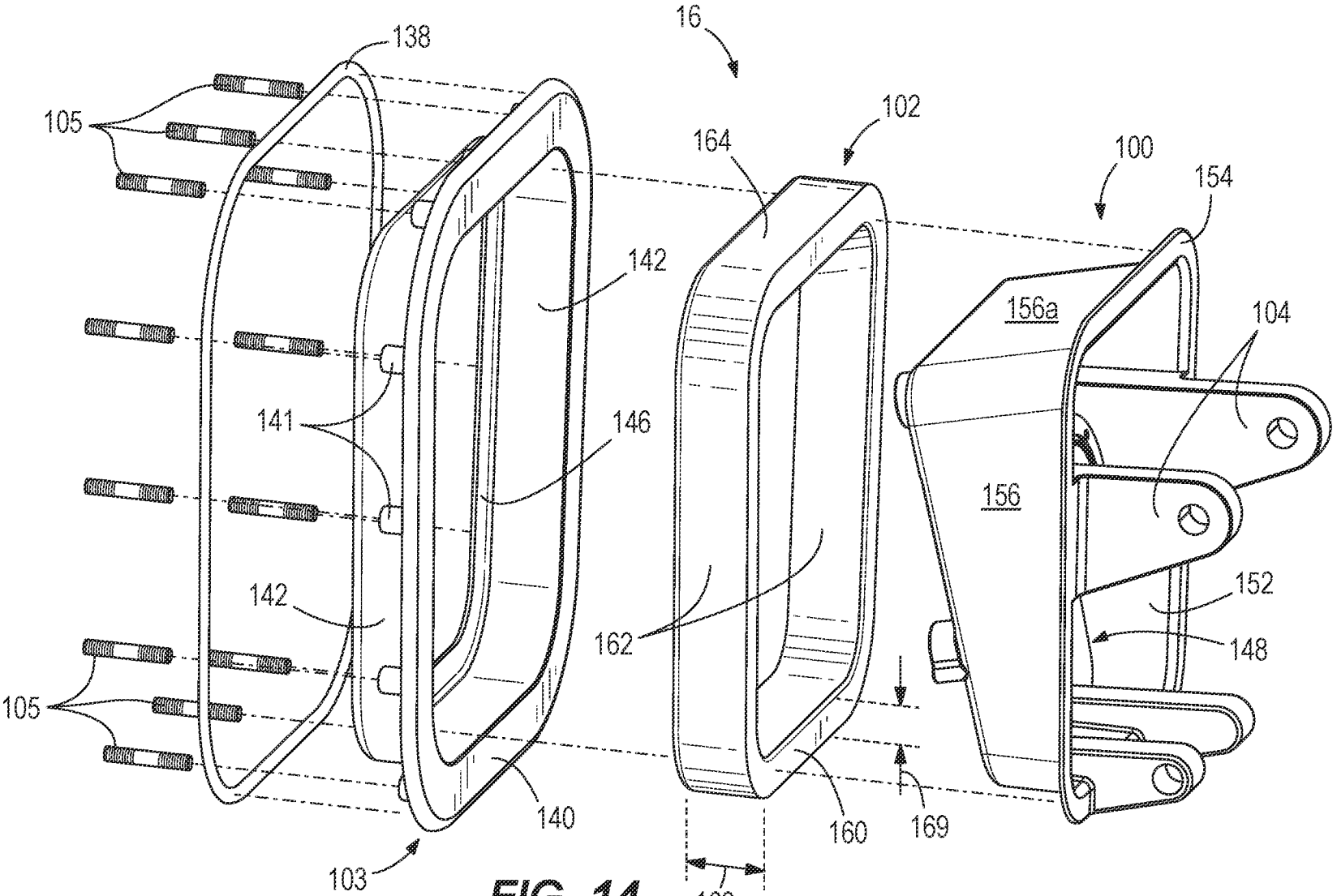
FIG. 14 is an exploded perspective view of an embodiment of a mounting assembly for a stern drive that includes a rigid mounting plate, and optionally a rigid mounting ring, and a vibration dampening member.
Figure 15:
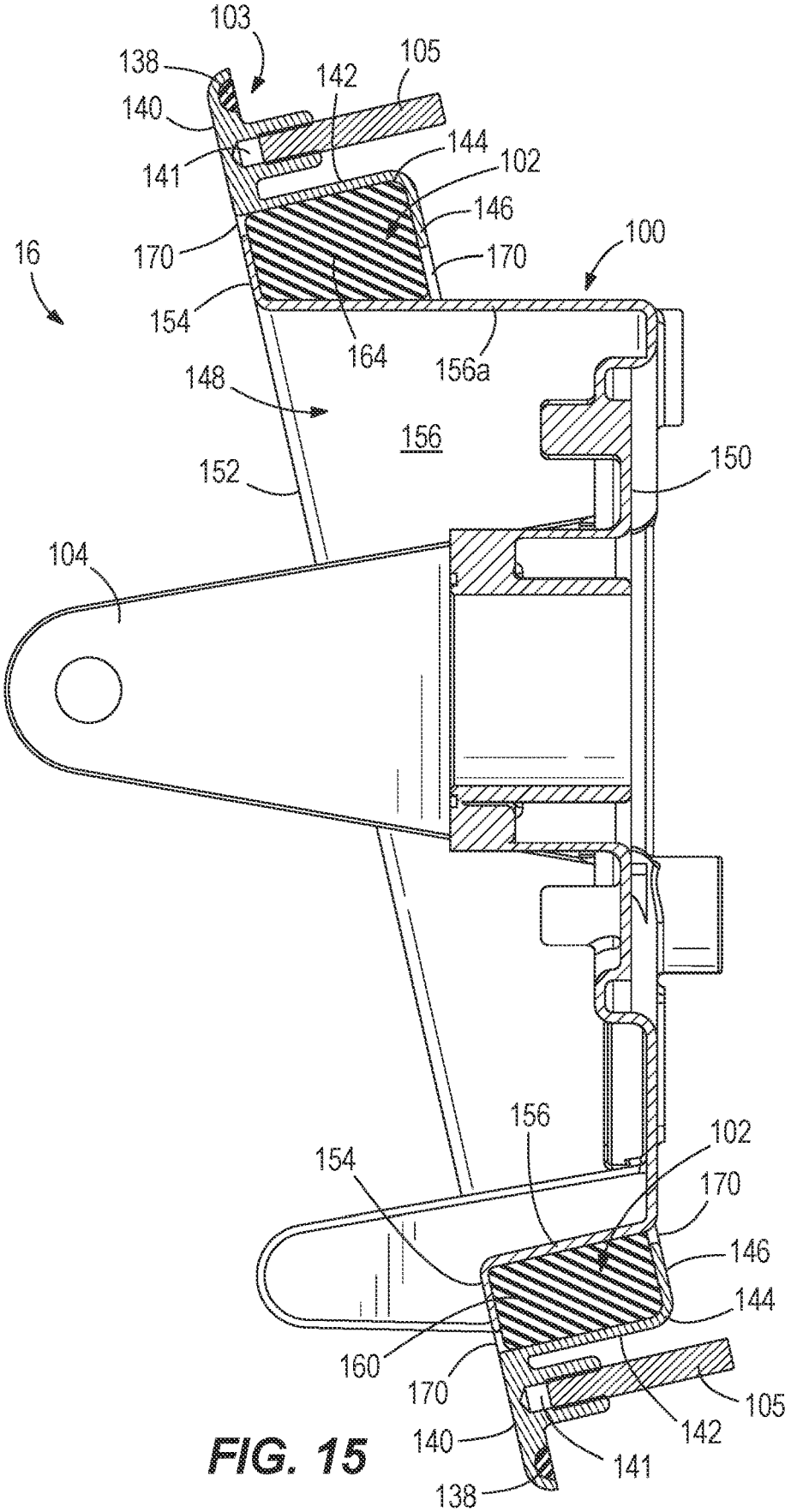
FIG. 15 is a cross-sectional side view of the mounting assembly of FIG. 14.
Figure 16:
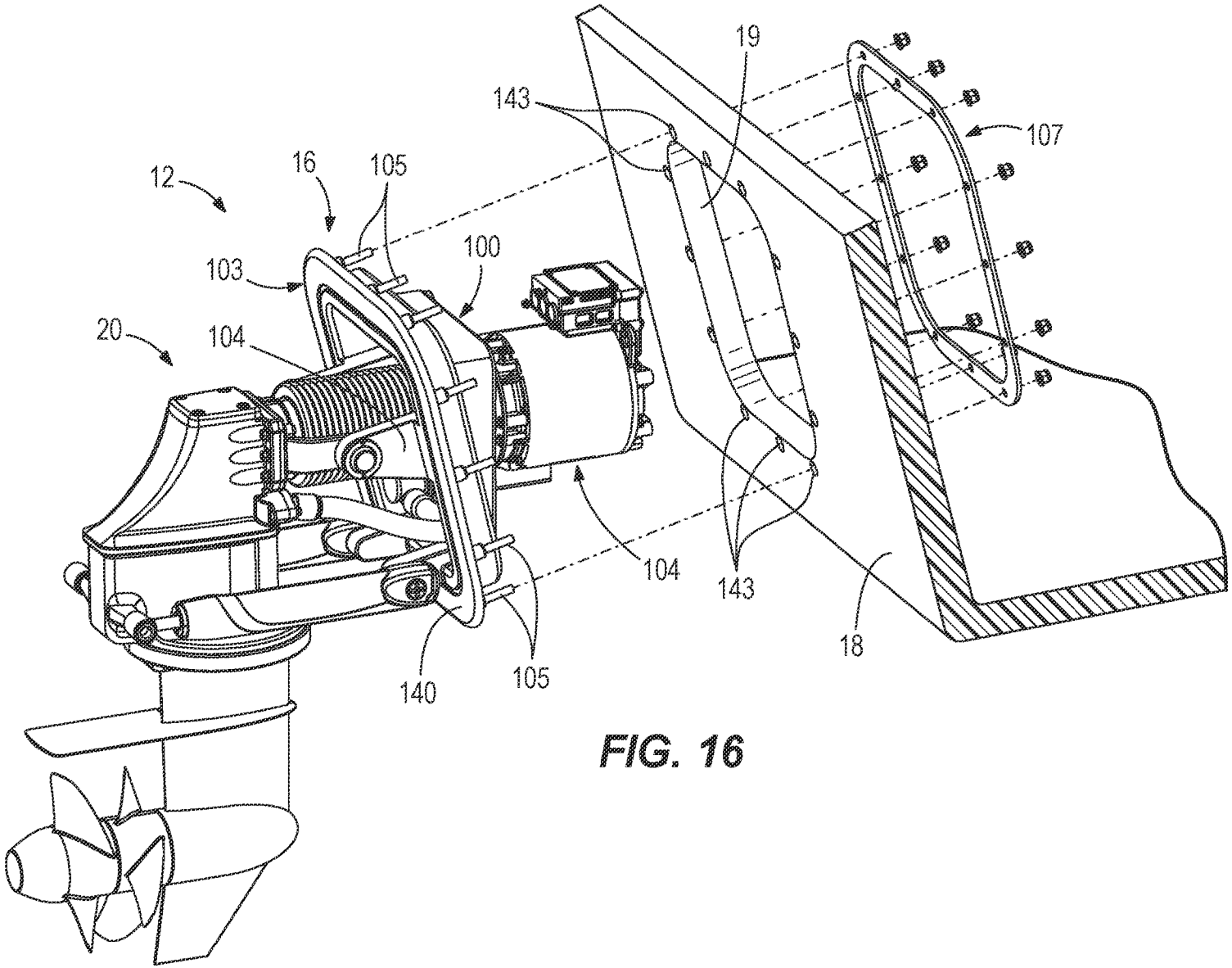
FIG. 16 is an exploded perspective view illustrating the installation of a stern drive with the mounting assembly of FIG. 15 onto the transom of a marine vessel.
Figure 17:
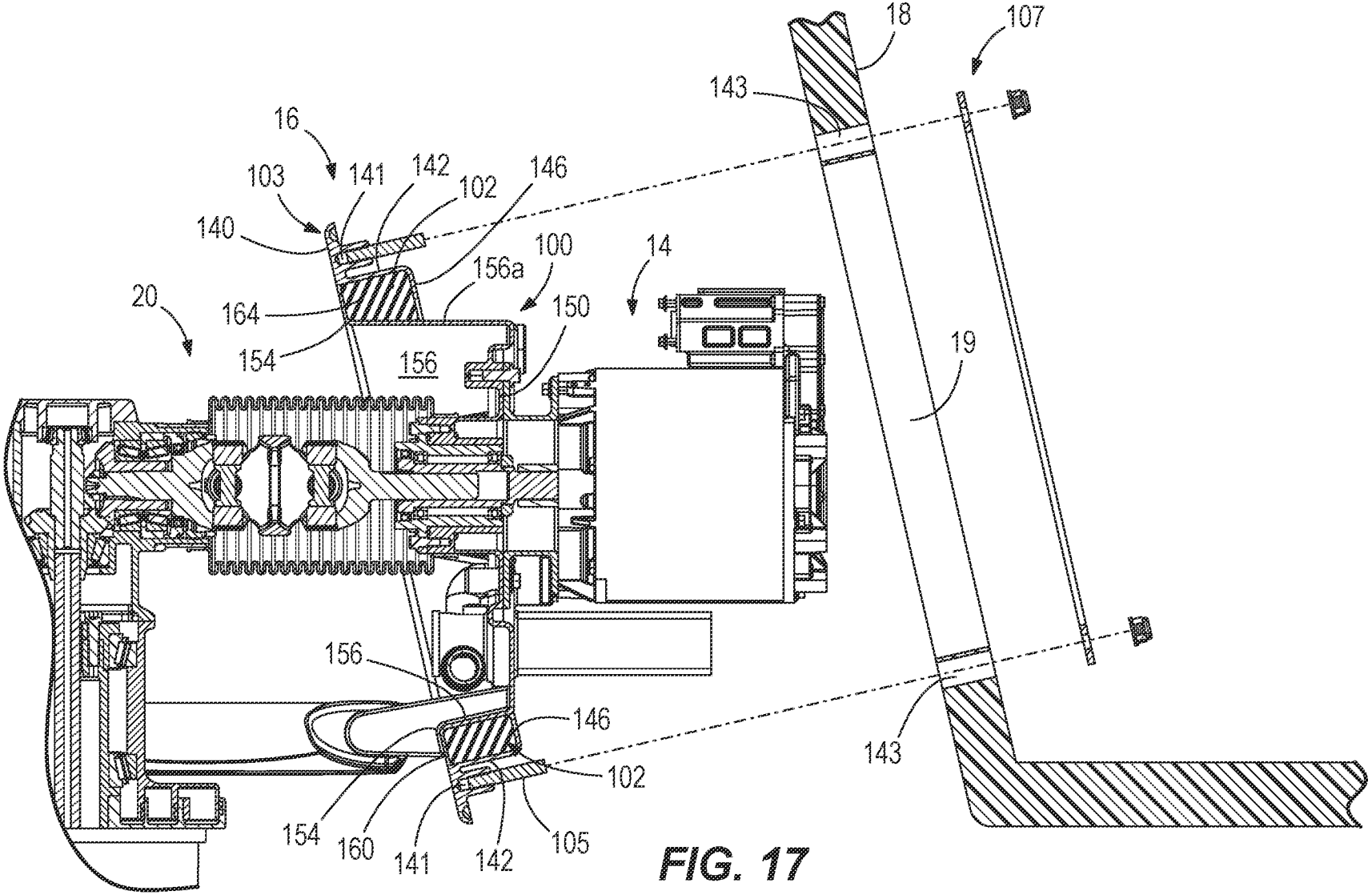
FIG. 17 is a cross-sectional side view of the stern drive of FIG. 16.

Referring first to FIGS. 14-17, the example mounting assembly 16 is configured to couple the drive assembly 20 to the transom 18 outside of the marine vessel and suspend the powerhead 14 from the transom 18 inside of the marine vessel. As illustrated in FIGS. 16 and 17, the mounting assembly 16 resides in (and extends through) an opening 19 in the transom 18 of the marine vessel (FIGS. 16-17) and generally includes a rigid mounting ring 103 and a rigid mounting plate 100. The rigid mounting ring 103 extends around the perimeter of the opening 19 on the exterior of the transom 18. The rigid mounting plate 100 is supported in the opening 19 by the rigid mounting ring 103. The rigid mounting ring 103 includes an annular rim 140 that extends around the opening 19 and abuts the outer surface of the transom 18. A support surface 142 of the rigid mounting ring 103 extends from the annular rim 140 into the opening 19 along the periphery of the opening 19. A flange 146 extends from a distal end 144 of the support surface 142 inward towards the center of the rigid mounting ring 103 and the opening 19. Mounting holes 141 formed in the back surface of the annular rim 140 are configured to receive fasteners 105 that extend through through-bores 143 formed in the transom 18. The fasteners 105 engage a fastening ring 107 that extends around the opening 19 on the inside of the transom 18, thereby coupling the mounting assembly 16 to the transom 18 of the marine vessel. Referring to FIG. 15, an O-ring 138 may be positioned between the rigid mounting ring 103 and the transom 18 to form a seal therebetween. Other embodiments, however, may omit an O-ring.

Figure 4:
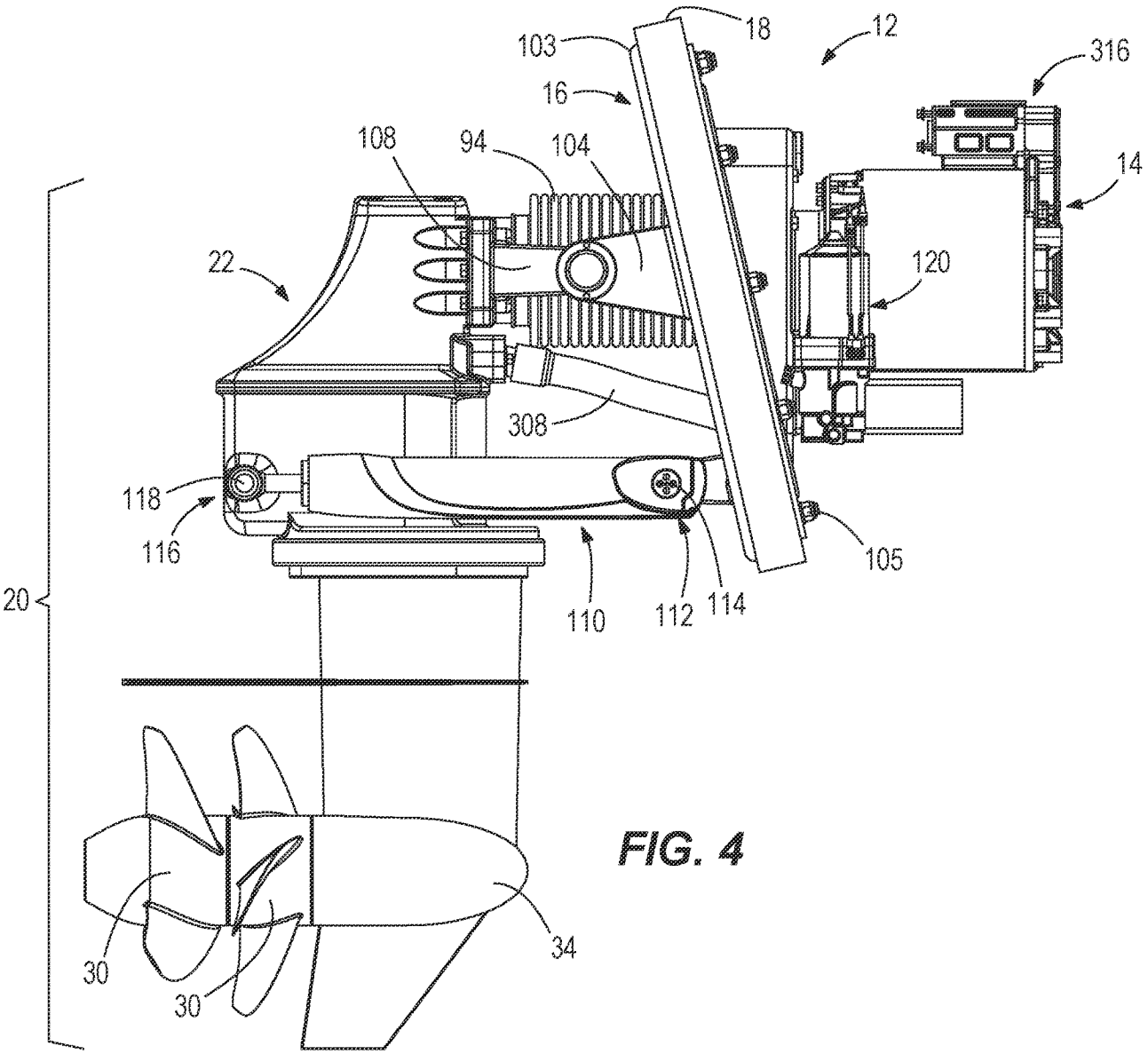
FIG. 4 is a starboard side view of the stern drive.

Referring to FIGS. 14 and 15, the rigid mounting plate 100 is configured to support at least some of the various components of the drive assembly 20. The rigid mounting plate 100 is recessed into the hull of the marine vessel through the rigid mounting ring 103 and includes an interior space 148 defined by a front wall 150, a rear opening 152 defined by an annular flange 154, and sidewalls 156 that extend longitudinally between the front wall 150 and the annular flange 154. In the illustrated embodiments, the front wall 150 is in a generally vertical orientation and the annular flange 154 is formed at an angle so that it is generally coplanar with the transom 18. The drive assembly 20 is supported on the rigid mounting plate 100 via a pair of rigid mounting arms 104 that extend rearwardly from front wall 150 of the rigid mounting plate 100. As illustrated in FIG. 4, the rigid mounting arms 104 are pivotably coupled to the rigid, U-shaped mounting bracket 108 that extends forwardly from the top of the driveshaft housing 22. As further described herein below, the rigid mounting plate 100 also supports the powerhead, which is configured as an electric motor 14 suspended from the front wall 150 on the interior of the transom 18.

Referring to FIGS. 14, 15, and 17, a novel vibration dampening member 102 is positioned between the rigid mounting ring 103 and the sidewalls 156 of the rigid mounting plate 100. As will be described in more detail below, the vibration dampening member 102 is uniquely configured to isolate vibrations of the drive assembly 20 and the powerhead 14 relative to the transom 18. In the illustrated embodiments, the vibration dampening member 102 is configured as a monolithic annular ring which extends around the stern drive 12 and the sidewalls 156 of the rigid mounting plate 100. The shape and size of the cross-sectional profile of the vibration dampening member 102 may be consistent, or may vary along different segments of the vibration dampening member 102. Varying the cross-sectional profile may be useful, for example, to achieve the desired spring rate for the vibration dampening member 102 and/or to limit the deflections of the drive assembly 20 relative to the transom 18 and the rigid mounting plate 100. The illustrated vibration dampening member 102 has a horizontal lower segment 160 and vertical side segments 162 that are generally rectangular and an upper segment 164 having a profile that is generally in the shape of a right trapezoid. Additionally or alternatively, at least one of a width dimension 168 and a thickness dimension 169 (FIG. 14) may vary between different segments of the vibration dampening member 102. In the illustrated embodiment, the vertical side segments 162 are thicker than the lower and upper segments 160, 164. Other embodiments, however, may include at least one segment 160, 162, 164 that is differently shaped and/or sized than the segments 160, 162, 164 of the illustrated vibration dampening member 102. For example, at least one segment 160, 162, 164 of the vibration dampening member 102 may have a cross-sectional shape that changes along the length of the segment. In some embodiments, the material composition of the vibration dampening member may vary between different segments 160, 162, 164 and/or between different portions of a segment 160, 162, 164.

Referring to FIG. 15, the vibration dampening member 102 is sandwiched between the support surface 142 of the rigid mounting ring 103 and the sidewalls 156 of the rigid mounting plate 100, and between the flange 146 of the rigid mounting ring 103 and the annular flange 154 formed around the rigid mounting plate 100. Thus, the rigid mounting ring 103 and the rigid mounting plate 100 together encase the vibration dampening member 102. The annular flanges 146, 154 are dimensioned so that there is a gap 170 between the distal end of each annular flange 146, 154 and the corresponding one of the rigid mounting plate 100 and the rigid mounting ring 103. This may be useful, for example, so that the rigid mounting plate 100 does not contact the rigid mounting ring 103 when the vibration dampening member 102 is compressed, thereby preventing direct transfer of vibrations from the rigid mounting plate 100 to the rigid mounting ring 103.

In some embodiments, the vibration dampening member 102 may be secured to the rigid mounting ring 103 and/or the rigid mounting plate 100 via an adhesive or bonding agent. For example, the vibration dampening member 102 may be bonded to the annular flange 154 and/or sidewalls 156 of the rigid mounting plate 100 and/or the support surface 142 of the rigid mounting ring 103 with an adhesive prior to installation of the stern drive 12 on the transom 18. By bonding the vibration dampening member 102 to the rigid mounting plate 100 and/or the rigid mounting ring 103 prior to installation, the vibration dampening member 102 is secured thereto in a relaxed configuration. This may be useful, for example, to provide enhanced control over (i.e., tuning of) the spring rate of the vibration dampening member 102, and to better prevent a leak path from forming around the vibration dampening member 102. In some embodiments, at least one of the material(s) of the vibration dampening member 102, the shape of the vibration dampening member 102, and/or the dimensions of the vibration dampening member 102 may be selected based on the desired spring rate of the vibration dampening member 102 and/or any other desired parameter thereof.

In the illustrated embodiments, the vibration dampening member 102 is adhesively bonded to the rigid mounting plate 100 and the rigid mounting ring 103, without mechanical fasteners, such that the rigid mounting plate 100 is coupled to the rigid mounting ring 103 only via the vibration dampening member 102. Thus, the vibration dampening member 102 couples and supports the drive assembly 20, and electric motor 14, and any other components secured to the rigid mounting plate 100 such that all vibrations emanating from the stern drive 12 are transferred to the vibration dampening member 102 before being transferred to the transom 18. Other embodiments, however, may be configured with at least one fastener configured to couple the rigid mounting plate 100, the rigid mounting ring 103, and/or the vibration dampening member 102.

Referring to FIGS. 16 and 17, the stern drive 12 is uniquely and advantageously configured so that the drive assembly 20, the powerhead 14, and the mounting assembly 16 are installed on the marine vessel as a single component from outside the transom 18. The installation method may begin by assembling the stern drive 12 as a single component that includes a drive assembly 20 configured to generate a thrust force in water, a powerhead 14 configured to power the drive assembly 20, and a mounting assembly 16 configured to couple the drive assembly 20 to the transom 18 outside of the marine vessel and to suspend the powerhead 14 on the transom 18 inside of the marine vessel.

The mounting assembly 16 is assembled by inserting a fastener 105 into each of the mounting holes 141 on the back side of the rigid mounting ring 103 and mounting the rigid mounting plate 100 on the rigid mounting ring 103. In some embodiments, the mounting assembly 16 may be configured with the vibration dampening member 102 which isolates vibrations of the drive assembly 20 and the powerhead 14 relative to the transom 18. The vibration dampening member 102 may be configured as the monolithic annular ring that extends around the stern drive 12. The vibration dampening member 102 may be positioned in the mounting assembly 16 between the rigid mounting ring 103 and the rigid mounting plate 100 such that the rigid mounting plate 100 is supported on the rigid mounting ring 103 by the vibration dampening member 102. As illustrated in FIG. 15, the vibration dampening member 102 extends around the sidewalls 156 of the rigid mounting plate 100 and is sandwiched between the support surface 142 and the flange 146 of the rigid mounting ring 103 and the sidewalls 156 and the annular flange 154 of the rigid mounting plate 100. In some embodiments, the vibration dampening member 102 is adhesively bonded to at least one of the rigid mounting plate 100 and the rigid mounting ring 103. In such an embodiment, the vibration dampening member 102 may be adhesively bonded to the rigid mounting plate 100 and/or the rigid mounting ring 103 while no external forces are applied to the rigid mounting plate 100, the rigid mounting ring 103, or the vibration dampening member 102 so that the vibration dampening member 102 is bonded thereto while it is in a relaxed state.

Figure 13:
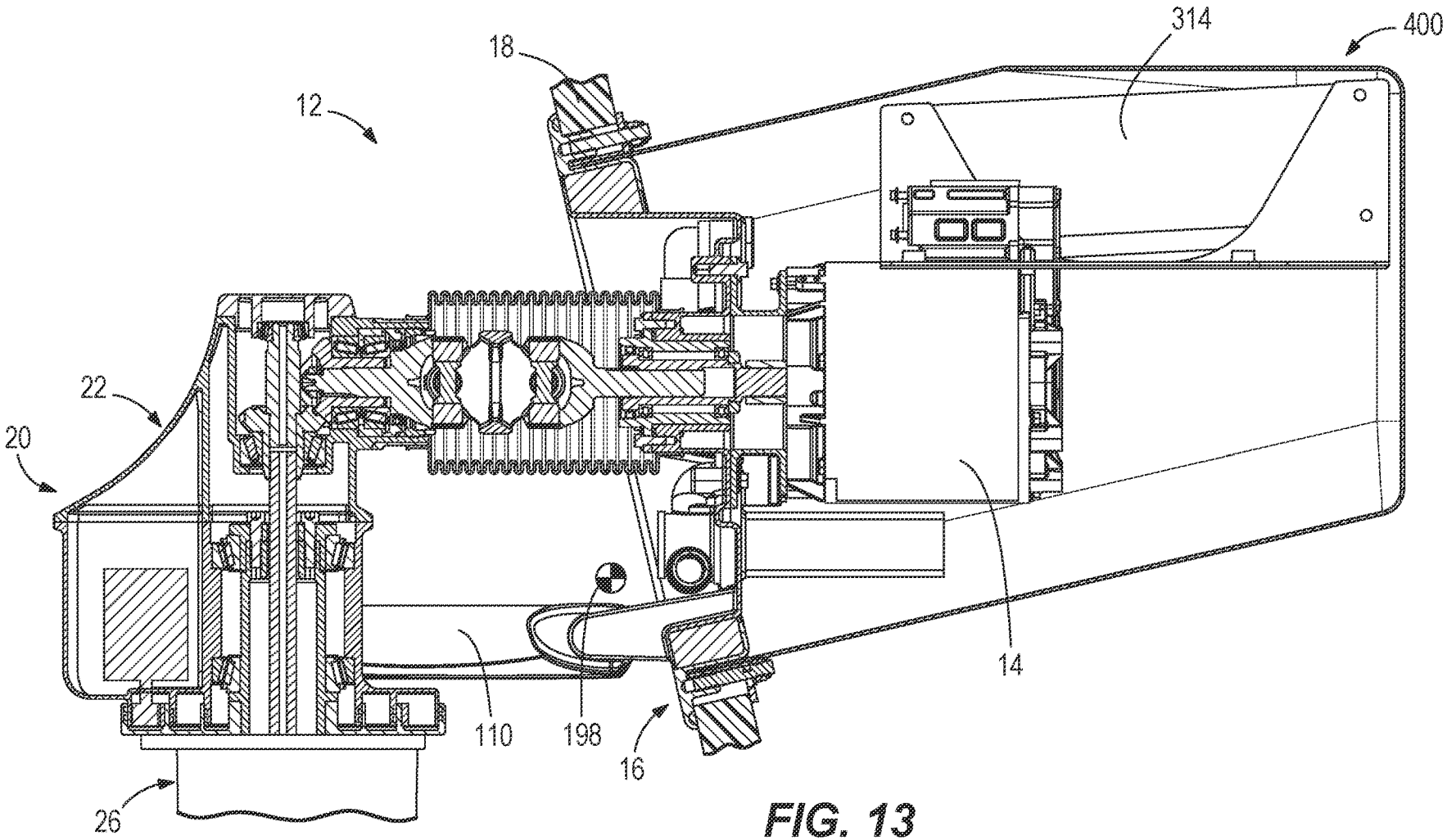
FIG. 13 is a starboard side sectional view of the example shown in FIG. 12.

Referring to FIGS. 16 and 17, once the mounting assembly 16 is assembled, the drive assembly 20 and the powerhead 14, which is configured as an electric motor in the illustrated embodiment, are mounted on the mounting assembly 16. The drive assembly 20 is suspended from the rigid mounting arms 104 on the exterior side of the mounting assembly 16. The powerhead 14 is coupled to the front side of the front wall 150 of the rigid mounting plate 100 such that the powerhead 14 is suspended from the interior-facing side of the mounting assembly 16. The drive assembly 20, the powerhead 14, and/or the mounting assembly 16 of the stern drive 12 may be configured so that the assembled stern drive 12 has a center of gravity 198 (see FIG. 13) which is aligned with a portion of the transom 18 when installed on the marine vessel. For example, as illustrated in FIG. 13, the center of gravity 198 of the stern drive 12 may be vertically aligned with the mounting assembly 16. This may be advantageous, for example, to balance the stern drive 12 so that the stern drive 12 produces fewer vibrations when the stern drive 12 is operating, thereby reducing the noise produced by the stern drive 12.

Referring to FIG. 17, after the stern drive 12 is assembled as a single component, it is mounted on the transom 18 of the marine vessel. From the exterior of the marine vessel, the powerhead 14 is inserted into the marine vessel via the mounting opening 19 in the transom 18 until the mounting assembly 16 engages the transom 18. As the powerhead 14 is inserted through the opening 19, the fasteners 105 extending from the annular rim 140 of the rigid mounting ring 103 are aligned with and inserted through corresponding through-bores 143 formed through the transom 18 around the opening 19. In some embodiments, an O-ring 138 may be positioned on the mounting assembly 16 such that the O-ring 138 is sandwiched between the annular rim 140 of the rigid mounting ring 103 and the exterior surface of the transom 18. The stern drive 12 may then be secured to the transom 18 by fastening the rigid mounting ring 103 to the transom 18. The fastening ring 107 is positioned on the interior side of the transom 18 such that the fastening ring extends around the stern drive 12 and the opening 19. The fastening ring 107 is moved into engagement with the fasteners 105 protruding through the transom 18, and a nut is received on each of the fasteners 105 in order to secure the stern drive 12 on the transom 18.

Some embodiments of a stern drive 12 may include a mounting assembly that is configured differently than the mounting assembly 16 of FIGS. 13-17. For example, FIGS. 18 and 19 illustrate other examples of a rigid mounting plate 500, 600 and a rigid mounting ring 503, 603 for a mounting assembly 16.

Figure 18:
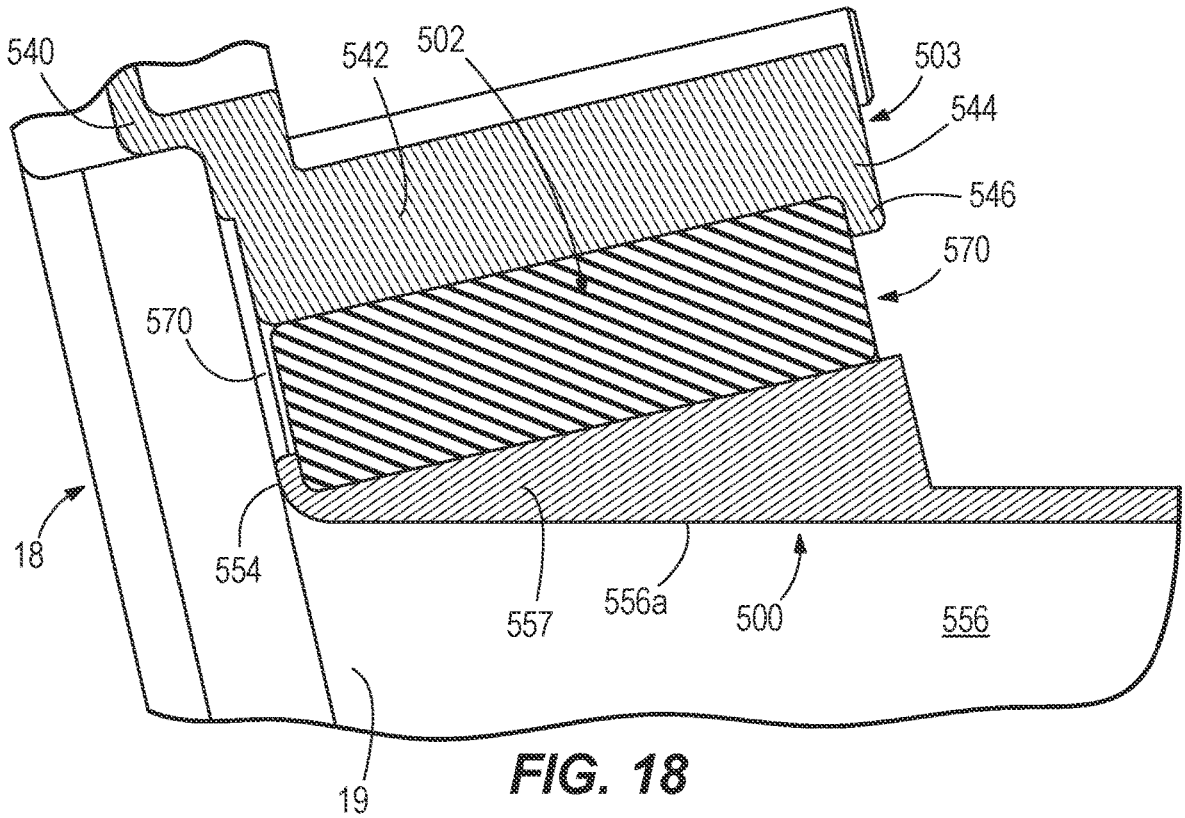
FIG. 18 is a cross-sectional side view of another embodiment of a mounting assembly including a rigid mounting plate, a rigid mounting ring, and a vibration dampening member.

Referring to FIG. 18, the rigid mounting ring 503 includes an annular rim 540 that extends around the opening 19 of the transom 18 and a support surface 542 that extends from the annular rim 540 into the opening 19. A flange 546 extends from a distal end 544 of the support surface 542 inward towards the center of the rigid mounting ring 103 and the opening 19. In the illustrated embodiment, the support surface 542 of the rigid mounting ring 503 is thicker than the support surface 142 of FIGS. 13-17. This may be useful, for example, to reduce the amount of material needed for the vibration dampening member 502. Similarly to the rigid mounting plate 100 of FIGS. 13-17, the rigid mounting plate 500 includes sidewalls 556 that extend longitudinally between a front wall (see, e.g., front wall 150 and side walls 556 in FIG. 16) and an annular flange 554 that is configured to abut the exterior surface of the transom 18. However, the top sidewall **556*a* of the rigid mounting plate 500 of FIG. 18 includes a ramp surface 557 that is formed at an angle relative to the generally horizontal top sidewall 556*a* and extends forward from the annular flange 554. The ramp surface 557 is configured to be generally parallel to the support surface 542 and generally perpendicular to the annular rim 540 of the rigid mounting ring 503, the annular flange 554 of the rigid mounting plate 500, and the plane of the exterior surface of the transom 18. This may be useful, for example, so that the vibration dampening member 502 may be configured with a uniform rectangular cross-section. The annular rim 540 of the rigid mounting ring 503 and/or the annular flange 554 of the rigid mounting plate 500 may be dimensioned to leave a gap 570 between the rigid mounting plate 500 and the rigid mounting ring 503**.

Figure 19:
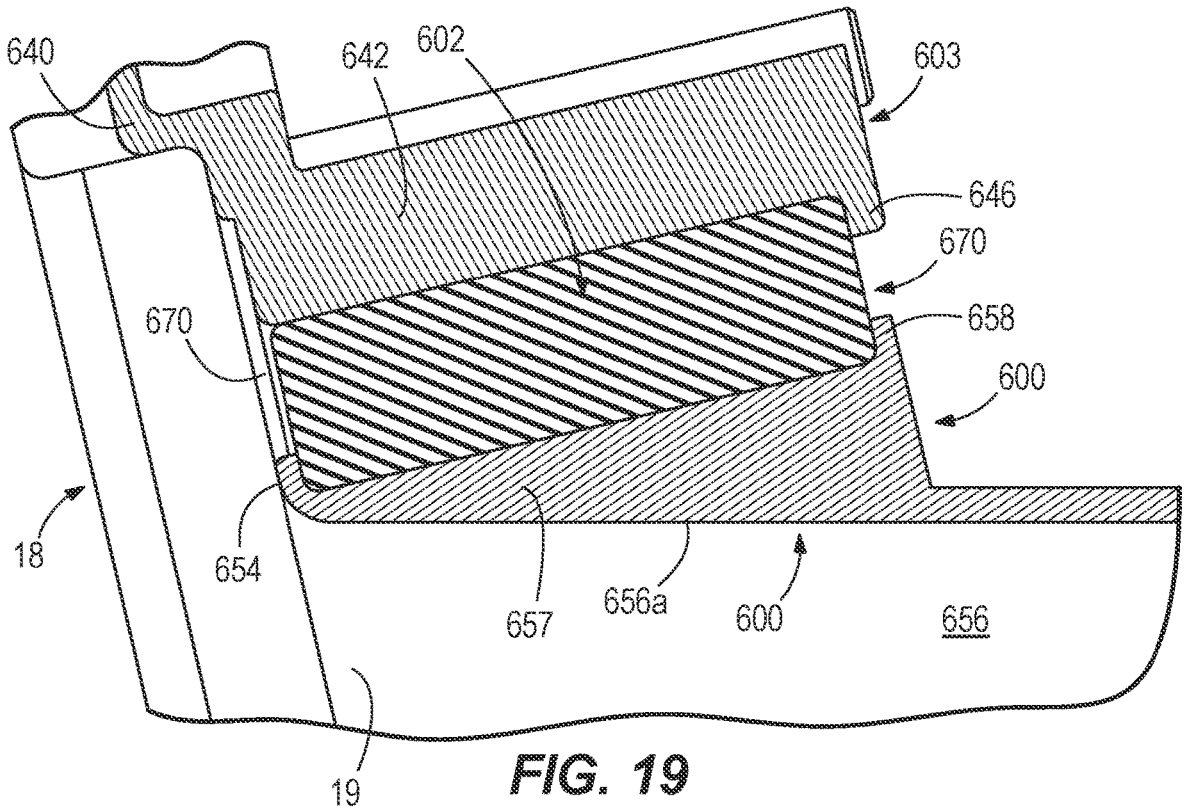
FIG. 19 is a cross-sectional side view of another embodiment of a mounting assembly including a rigid mounting plate, a rigid mounting ring, and a vibration dampening member.

FIG. 19 illustrates other examples of a rigid mounting plate 600 and the rigid mounting ring 603 of a mounting assembly 16 for a stern drive 12. The rigid mounting plate 600, the rigid mounting ring 603, and the vibration dampening member 602 of FIG. 19 are similar to those of the embodiment of FIG. 18 in that the support surface 642 of the rigid mounting ring 603 is thicker than the support surface 142 of FIGS. 13-17 and the top sidewall **656*a* of the rigid mounting plate 600 includes a ramp surface 657. Unlike the mounting assembly of FIG. 18, the mounting assembly 16 of FIG. 19 is configured with a rigid mounting plate 600 that includes an interior flange 658 formed around at least a portion of the sidewalls 656. In the illustrated embodiment, the interior flange 658 is formed proximate the distal end of the ramp surface 657 and can be configured to retain the vibration dampening member 602 in the desired position by resisting movement and/or forces that could break the bond between the vibration dampening member 602 and the rigid mounting plate 600 and/or the rigid mounting ring 603. In some embodiments, the interior flange 658 may additionally or alternatively be formed around the lateral sidewalls and the bottom sidewall of the rigid mounting plate 600. The annular rim 640 of the rigid mounting ring 603 and/or the annular flange 654 and/or interior flange 658 of the rigid mounting plate 600 may be dimensioned to leave a gap 670 between the rigid mounting plate 600 and the rigid mounting ring 603**.

Figure 20:
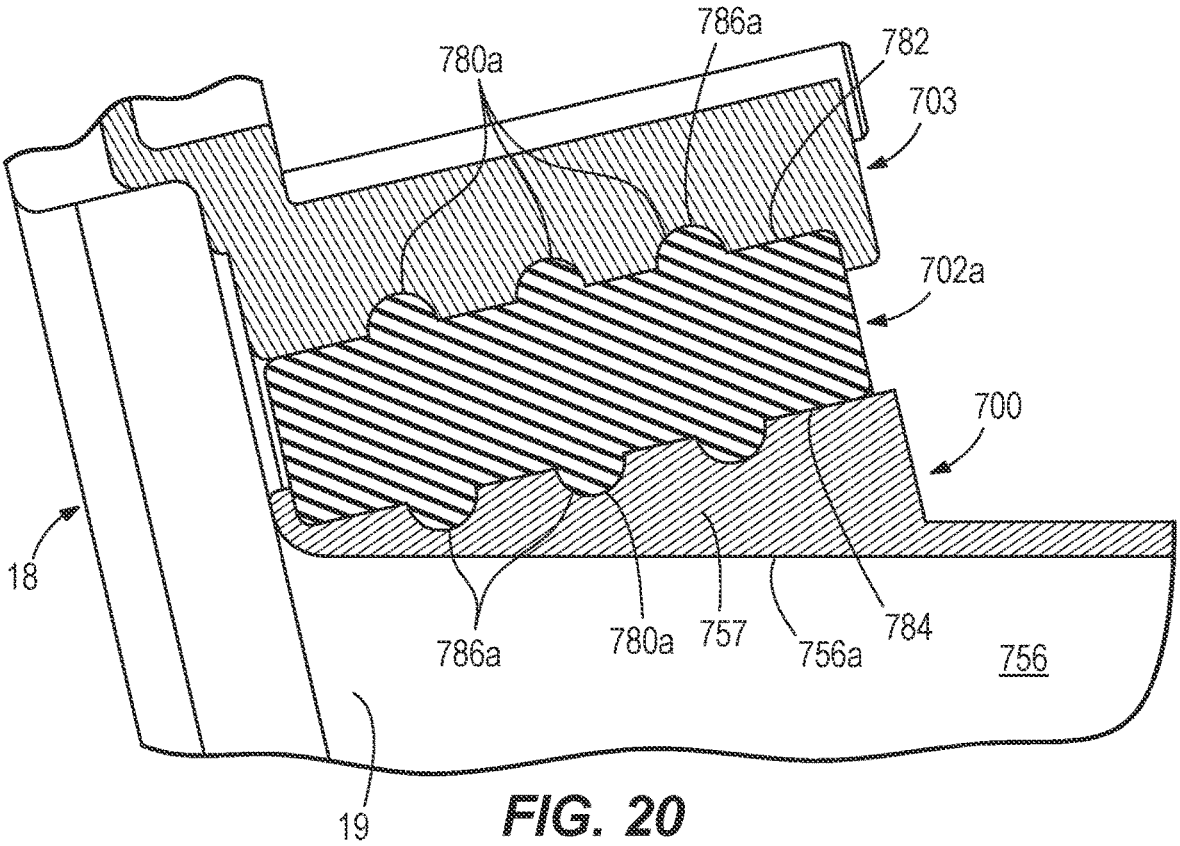
FIG. 20 is a cross-sectional side view of an embodiment of a mounting assembly that includes a vibration dampening member with locating protrusions.
Figure 21:
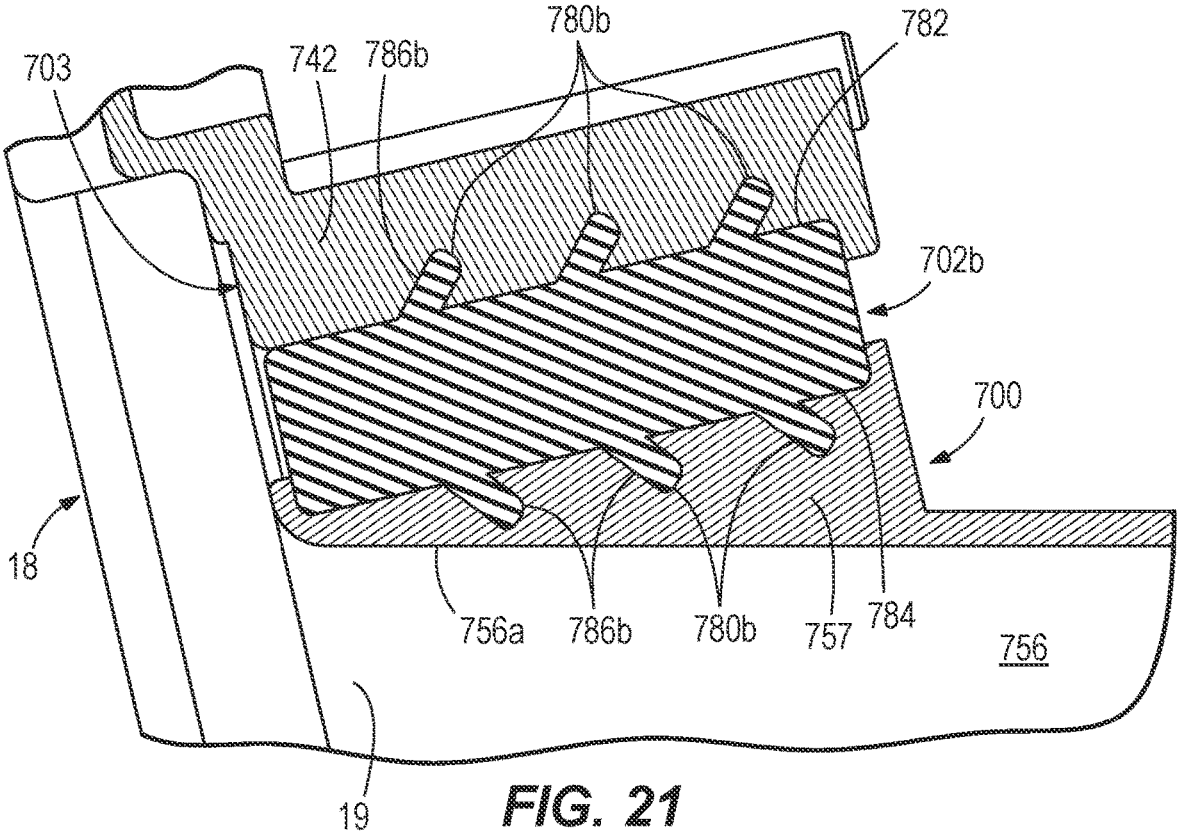
FIG. 21 is a cross-sectional side view of another embodiment of a mounting assembly that includes a vibration dampening member with locating protrusions.

Some embodiments of a stern drive 12 may be configured with a vibration dampening member, rigid mounting ring, and/or rigid mounting plate that include positioning features configured to retain the vibration dampening member in a desired position. For example, FIGS. 20 and 21 illustrate examples of mounting assemblies 16 that include a vibration dampening member 702*a*, 702*b* with elongated locating protrusions 780*a*, 780*b* formed around the vibration dampening member. Referring to FIGS. 20 and 21, the vibration dampening member 702 includes locating protrusions 780 formed on an exterior cross-sectional surface 782 and an interior cross-sectional surface 784 of the vibration dampening member 702. Each of the locating protrusions 780 is configured to be received in a corresponding recess 786 formed in the support surface 742 of the rigid mounting ring 703 and the ramp surface 757 and/or the top sidewall 756*a* of the rigid mounting plate 700. Engagement between the locating protrusions 780 and the corresponding recesses 786 may be useful, for example, to retain the vibration dampening member 702 in a desired position relative to the rigid mounting plate 700 and the rigid mounting ring 703, and to prevent a leak path from the exterior of the marine vessel to the interior of the marine vessel from forming between the vibration dampening member 702 and the rigid mounting plate 700 and/or the rigid mounting ring 703.

Embodiments of a vibration dampening member may be configured with various locating protrusions. Referring to FIG. 20, a vibration dampening member 702*a* may be configured with three semicircular locating protrusions 780*a* formed around the exterior cross-sectional surface 782 and the interior cross-sectional surface 784 thereof. Each semicircular locating protrusion 780*a* is configured to be received in a corresponding semicircular recess 786*a* formed in the rigid mounting plate 700 and the rigid mounting ring 703. Referring to FIG. 21, a vibration dampening member 702*b* may be configured with three elongated locating protrusions 780*b* formed around the exterior cross-sectional surface 782 and the interior cross-sectional surface 784 thereof. Each of the elongated locating protrusions 780*b* may extend from vibration dampening member 702*b* at an angle relative to the interior or exterior cross-sectional surface 782, 784. Each elongated locating protrusion 780*b* is received in a corresponding elongated recess 786*b* formed in the rigid mounting plate 700 and the rigid mounting ring 703. These embodiments may require different production and/or assembly methods, such as by separately molding the dampening members or molding the dampening members in place.

Some embodiments of a vibration dampening member may be configured with a different arrangement of locating protrusions formed thereon. For example, at least one of the exterior cross-sectional surface and the interior cross-sectional surface may be configured with a different number of locating protrusions, and at least one locating protrusion on the interior and/or exterior cross-sectional surface may have a different shape, size, and/or orientation than those of the illustrated embodiments. In some embodiments, a vibration dampening member may be asymmetrical such that the shape, size, number, and/or orientation of locating protrusions on the inward facing and outward facing surfaces are different. Further still, some embodiments of a mounting assembly may be configured with at least one locating protrusion formed on and extending from a sidewall of the rigid mounting plate and/or a support surface of the rigid mounting ring. In such an embodiment, the locating protrusion(s) on the rigid mounting plate and/or the rigid mounting ring would be received in a corresponding recess formed in the body of the vibration dampening member.

Referring back to FIGS. 1-4 and 7, trim cylinders 110 are located on opposite sides of the mounting assembly 16. The trim cylinders 110 have a first end 112 pivotably coupled to the rigid mounting plate 100 at a first pivot joint 114 and an opposite, second end 116 pivotably coupled to the drive assembly 20 at a second pivot joint 118. A hydraulic actuator 120 (which in this example includes a pump and associated valves and line components) is mounted to the interior of the rigid mounting plate 100. The hydraulic actuator 120 is hydraulically coupled to the trim cylinders 110 via a least one internal passage through the mounting assembly 16 and the first pivot joint 114, advantageously so that there are no other hydraulic lines located on the exterior of the stern drive 12, or otherwise outside the marine vessel so as to be subjected to wear and/or damage from external elements. The hydraulic actuator 120 is operable to supply hydraulic fluid to the trim cylinders 110 via the noted internal passage to cause extension of the trim cylinders 110 and alternately to cause retraction of the trim cylinders 110. Extension of the trim cylinders 110 pivots (trims) the drive assembly 20 upwardly relative to the mounting assembly 16 and retraction of the trim cylinders 110 pivots (trims) the drive assembly 20 downwardly relative to the mounting assembly 16. Examples of a suitable hydraulic actuator are disclosed in the above-incorporated U.S. Pat. No. 9,334,034.

Figure 8:
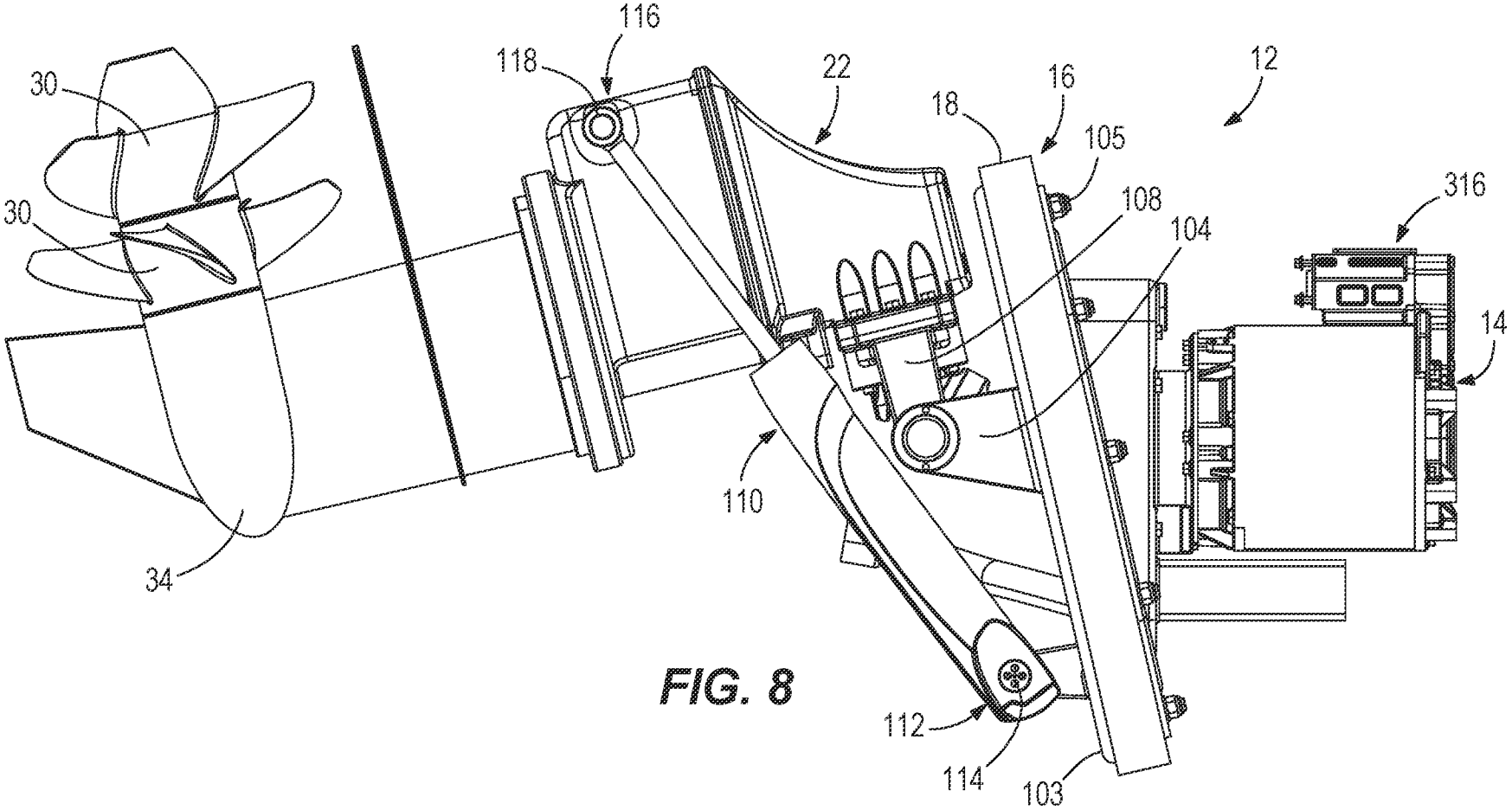
FIG. 8 is a starboard side view of the stern drive in a trimmed-up position.
Figure 9:
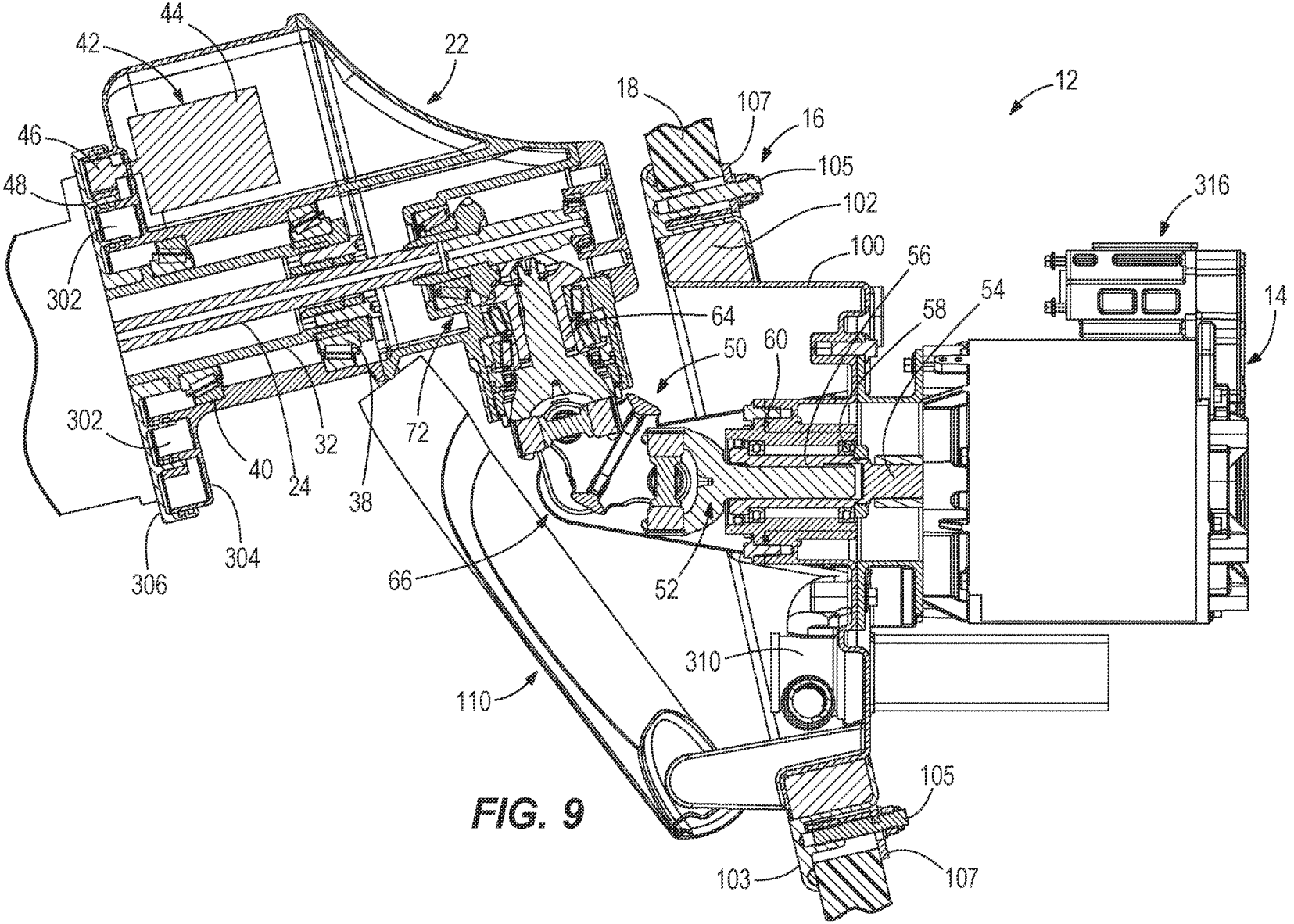
FIG. 9 is a starboard side sectional view of the stern drive in the trimmed-up position.

By comparison of FIGS. 7-9, it will be seen that the universal joint 50 advantageously facilitates trimming of the drive assembly 20 about the trim axis T (see FIG. 2) while maintaining operable connection between the electric motor 14 and the output shaft(s) 28. In particular, as the drive assembly 20 is trimmed, the elongated body 66 is configured to also pivot about the first and/or second input pivot axes 82, 84 (via input pivot pins 78, 80), and the output member 64 is configured to also pivot about the first and/or second output pivot axes 90, 92 (via output pivot pins 86, 88). As explained above, the input shaft 62 is coupled to the internally splined sleeve 56 by a splined coupling so that the input shaft 62 is free to telescopically move outwardly relative to the internally splined sleeve 56 and mounting assembly 16 when the drive assembly 20 is trimmed up and so that the input shaft 62 is free to telescopically move inwardly relative to the mounting assembly 16 when the drive assembly 20 is trimmed down.

A controller 200 (see FIG. 1) is communicatively coupled to the electric motor 14, the steering actuator 42, and the hydraulic actuator 120. The controller 200 is configured to control operation of the electric motor 14, the steering actuator 42, and the hydraulic actuator 120. More specifically, the controller 200 is configured to control the electric motor 14 to rotate the universal joint 50, the driveshaft 24 and the output shaft(s) 28, thereby controlling the thrust force generated by the propulsor(s) 30 in the water. The controller 200 is configured to control the steering actuator 42 to rotate the gearcase housing 26 about the steering axis S. The controller 200 is configured to control the hydraulic actuator 120 to extend and alternately to retract the trim cylinders 110 to trim the drive assembly 20 about the trim axis T.

The type and configuration of the controller 200 can vary. In non-limiting examples, the controller 200 has a processor which is communicatively connected to a storage system comprising a computer readable medium which includes volatile or nonvolatile memory upon which computer readable code and data is stored. The processor can access the computer readable code and, upon executing the code, carry out functions, such as the controlling functions for the electric motor 14, steering actuator 42, and the hydraulic actuator 120. In other examples the controller 200 is part of a larger control network such as a controller area network (CAN) or CAN Kingdom network, such as disclosed in U.S. Pat. No. 6,273,771. A person having ordinary skill in the art will understand that various other known and conventional computer control configurations could be implemented and are contemplated by the present disclosure, and that the control functions described herein may be combined into a single controller or divided into any number of distributed controllers which are communicatively connected.

The controller 200 is in electrical communication with the electric motor 14, the steering actuator 42, and the hydraulic actuator 120 via one or more wired and/or wireless links. In non-limiting examples, the wired and/or wireless links are part of a network, as described above. The controller 200 is configured to control the electric motor 14, the steering actuator 42, and the hydraulic actuator 120 by sending and optionally by receiving said signals via the wired and/or wireless links. The controller 200 is configured to send electrical signals to the electric motor 14 which cause the electric motor 14 to operate in a first direction to rotate the universal joint 50, the driveshaft 24 and the output shaft(s) 28 in a first direction, thereby generating a first (e.g., forward) thrust force in the water via the propulsor(s) 30, and alternately to send electric signals to the electric motor 14 which cause the electric motor 14 to operate in an opposite, second direction, to rotate the universal joint 50, the driveshaft 24 and the output shaft(s) 28 in an opposite direction which generates a second (e.g., reverse) thrust force in the water via the propulsor(s) 30. The controller 200 is configured to send electric signals to the steering actuator 42 which cause the steering actuator 42 to rotate the gearcase housing 26 in a first direction about the steering axis S and alternately to send electric signals to the steering actuator 42 which cause the steering actuator 42 to rotate the gearcase housing 26 in an opposite direction about the steering axis S. The controller 200 is configured to send electrical signals to the hydraulic actuator 120 which cause the hydraulic actuator 120 to provide hydraulic fluid to one side of the trim cylinders 110 to extend the trim cylinders 110 and trim the drive assembly 20 upwardly relative to the mounting assembly 16 and alternately to send electric signals to the hydraulic actuator 120 which cause the hydraulic actuator 120 to provide hydraulic fluid to an opposite side of the trim cylinders 110 to retract the trim cylinders 110 and trim the drive assembly 20 downwardly relative to the mounting assembly 16.

A user input device 202 (see FIG. 1) is provided for inputting a user-desired operation of the electric motor 14, and/or a user desired operation of the steering actuator 42, and/or a user-desired operation of the hydraulic actuator 120. Upon input of the user-desired operation, the controller 200 is programmed to control the electric motor 14, and/or the steering actuator 42, and/or the hydraulic actuator 120 accordingly. The user input device 202 can include any conventional device which can be communicatively connected to the controller 200 for inputting a user-desired operation, including but not limited to one or more switches, levers, joysticks, buttons, touch screens, and/or the like.

Referring to FIG. 7, one or more sensor(s) 204 are provided for directly or indirectly sensing a rotational orientational position of the universal joint 50 and communicating this information to the controller 200. In non-limiting examples, the sensor 204 comprises one or more conventional magnetic pick-up coil(s), Hall-effect sensor(s), magneto-resistive element (MRE) sensor(s), and/or optical sensor(s), such as are available for purchase from Parker Hannifin Corp., among other places. The sensor(s) 204 may be configured to sense the orientational position of the universal joint 50 by sensing the rotational position of the output shaft of the electric motor 14 and/or the rotational position of the internally splined sleeve 56 and/or by sensing the rotational position of the input gear of the angle gearset 72, for example. In other examples, the sensor(s) 204 may also or alternately be configured to directly sense the orientational position of one or more rotatable component of the universal joint 50. The location of the one or more sensor(s) can vary, but preferably is located to be able to accurately sense a rotating part of the assembly for which an orientation between the splines and gears is known.

The controller 200 is configured to automatically cause the electric motor 14 to rotate the universal joint 50 into the neutral position shown in the figures (e.g., see FIGS. 5 and 7), wherein the first input pivot axis 82 and the first output pivot axis 90 are aligned with each other and generally parallel to the trim axis T. This advantageously facilitates trimming of the drive assembly 20 fully out of the water. More specifically, rotating the universal joint 50 into the neutral position with the first input pivot axis 82 and the first output pivot axis 90 oriented generally parallel to the trim axis T (i.e., with the first input pivot axis 82 and the first output pivot axis 90 oriented generally horizontally) thus permits the first pair of arms 74 of the elongated body 66 to pivot through a maximum allowable range about the first input pivot axis 82 within the U-shape formed by the input arms 63, as shown in FIG. 9. Similarly, rotating the universal joint 50 into the neutral position locates the output arms 70 of the output member 64 at a ninety-degree offset from the second pair of arms 76 of the elongated body 66 and thus permits the output arms 70 to pivot through a maximum allowable range about the first output pivot axis 90 within the U-shape formed by the second pair of arms 76, as shown in FIG. 9.

The controller 200 is advantageously programmed to automatically operate the electric motor 14 to rotate the universal joint 50 into the neutral position as indicated by the sensor 204 based upon an operational state of the stern drive 12. The operational state can for example include change in an on/off state of the electric motor 14 (for example a key on or key off event) and/or any other designated programmed request or request input to the controller 200 via the user input device 202.

Figure 11:
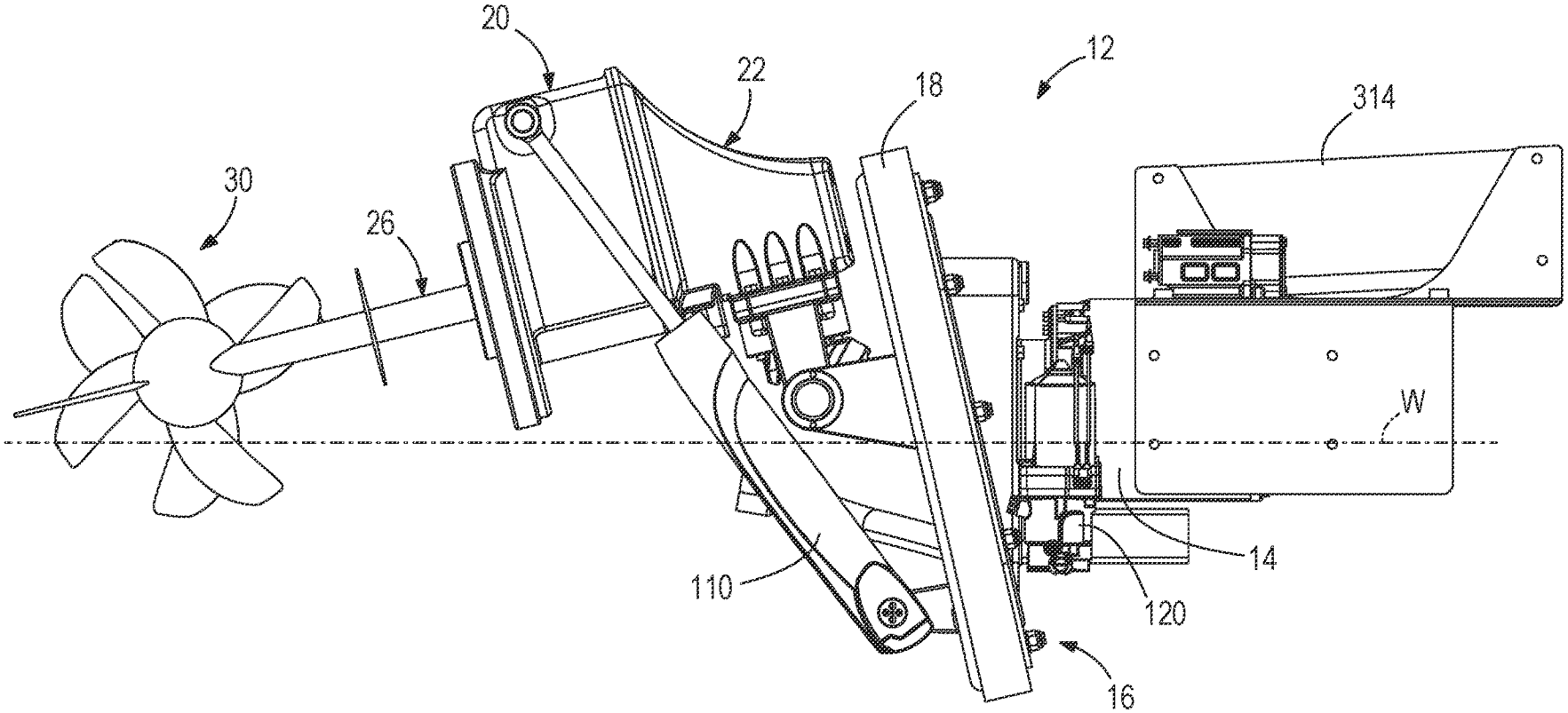
FIG. 11 is a starboard side perspective view of the stern drive in the trimmed-up position and steered ninety degrees off center (straight-ahead) so that the drive assembly of the stern drive is trimmed fully out of the water.

In a non-limiting example, a user can actuate the user input device 202 to command the controller 200 to control the hydraulic actuator 120 to trim the drive assembly 20 into a fully raised, storage position. Upon receiving said command, the controller 200 is programmed to automatically control the electric motor 14 to rotate the universal joint 50 into the noted neutral position. As explained above, this advantageously facilitates trimming all or at least a majority of the drive assembly 20 out of the water. For example the majority may include all of the driveshaft housing 22 and a majority of the gearcase housing 26. Referring to FIG. 11, the controller 200 can be also configured to automatically operate the steering actuator 42 to steer (i.e., rotate) the drive assembly 20 about the steering axis S, for example into the position shown, which is ninety degrees offset to either one of the port or starboard sides. This can occur prior to, during, or after the drive assembly 20 is trimmed upwardly via the universal joint 50. Steering the drive assembly 20 into the position shown (or into the 180 degree opposite position of what is shown) advantageously further elevates the lowermost point of the drive assembly 20 (which typically is on the torpedo housing 34 or skeg of the gearcase housing 26) further above the waterline W, thus ensuring that the entirety of the drive assembly 20, including all of the driveshaft housing 22 and all of the gearcase housing 26, is positioned out of the body of water. Thus the present disclosure contemplates methods for operating the stern drive 12, including the steps of operating the electric motor 14 to rotate the universal joint 50 into the aforementioned neutral position, which facilitates trimming of the drive assembly 20 upwardly relative to the rest of the stern drive 12, and optionally also steering the gearcase housing 26 relative to the driveshaft housing 22, before, during or after the trimming of the drive assembly 20, thereby moving an entirety of the drive assembly 20 further upwardly relative to the stern drive 12 and ensuring that the entirety of the drive assembly 20 is positioned out of the body of water. This advantageously locates the majority or entirety of the drive assembly 20 out of the body of water during periods of non-use, thus preventing deleterious effects of the water on the drive assembly 20.

Figure 10:
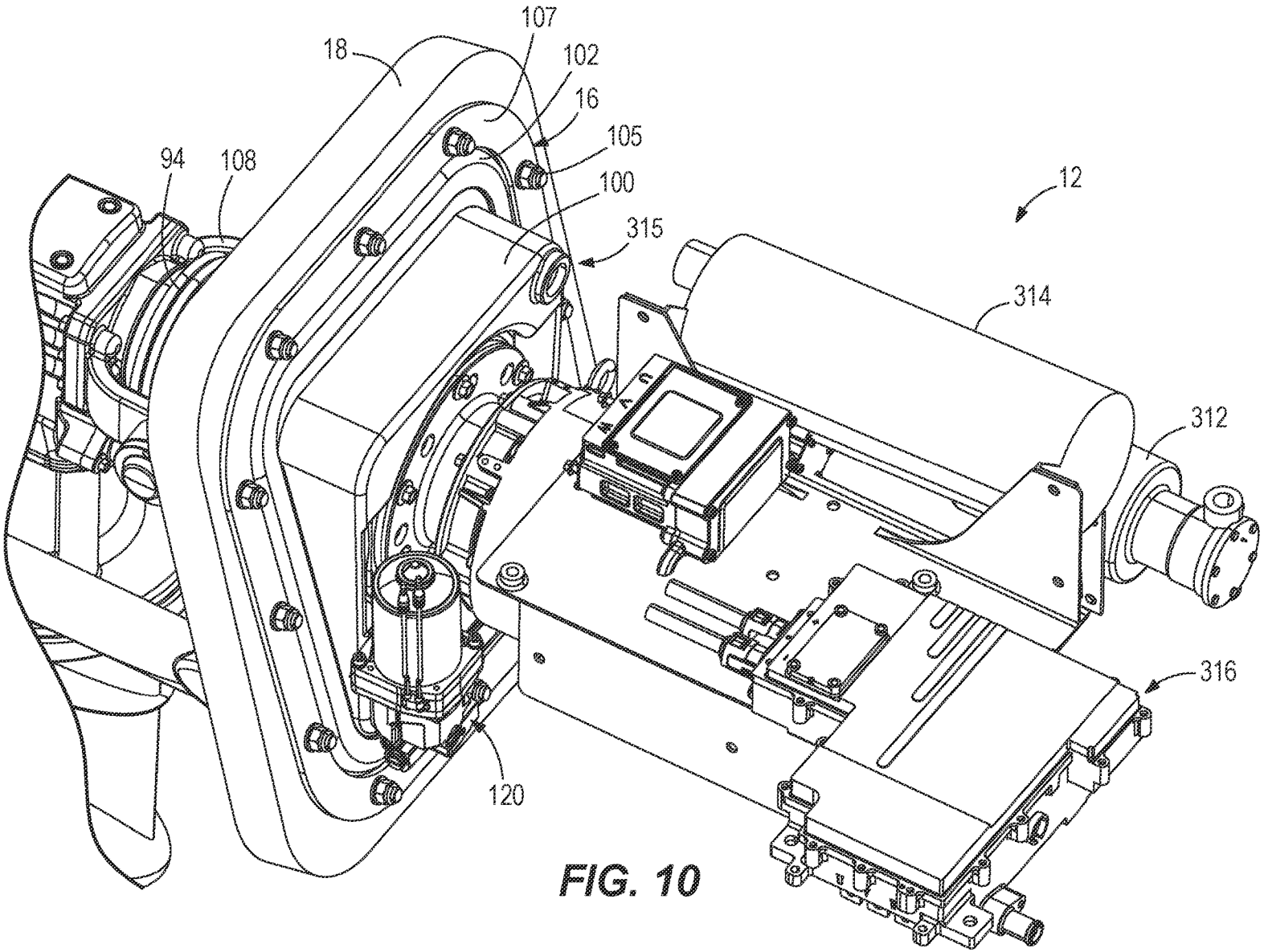
FIG. 10 is a starboard side perspective view of a mounting assembly which mounts the electric motor to the transom of a marine vessel.

Referring to FIG. 7, the stern drive 12 has a cooling system for cooling various components thereof, including for example the electric motor 14. In the non-limiting example shown in the drawings, the cooling system includes an open loop cooling circuit for circulating cooling water from the body of water in which the stern drive 12 is situated and then discharging the cooling water back to the body of water. The open loop cooling circuit includes an intake inlet 300 (see FIG. 1) on the gearcase housing 26 which is connected to an annular cooling channel 302 defined between a lower annular flange 304 on the lower end of the driveshaft housing 22 and an annular flange 306 on the top of the gearcase housing 26. Reference is made to the above-incorporated U.S. Pat. No. 10,800,502. A flexible conduit 308 is coupled to the driveshaft housing 22 and configured to convey the cooling water from the annular cooling channel 302 to a cooling water pump 310 mounted on the outside of the rigid mounting plate 100. The cooling water pump 310 is configured to draw the cooling water in through the intake inlet 300, see FIG. 1, through the annular cooling channel 302, and through the flexible conduit 308. The cooling water pump 310 pumps the cooling water through the mounting assembly 16 to a heat exchanger 314 and then to an outlet 315 shown in FIG. 10. In the illustrated example, the stern drive 12 further includes a closed loop cooling circuit having a pump 312 for pumping cooling fluid such as a mixture of water and ethylene glycol through the heat exchanger 314, exchanging heat with the cooling water in the open loop cooling circuit. The mixture of water and ethylene glycol is circulated past the electric motor 14, an associated inverter 316, and one or more batteries for powering the electric motor 14, thus cooling these components.

Figure 12:
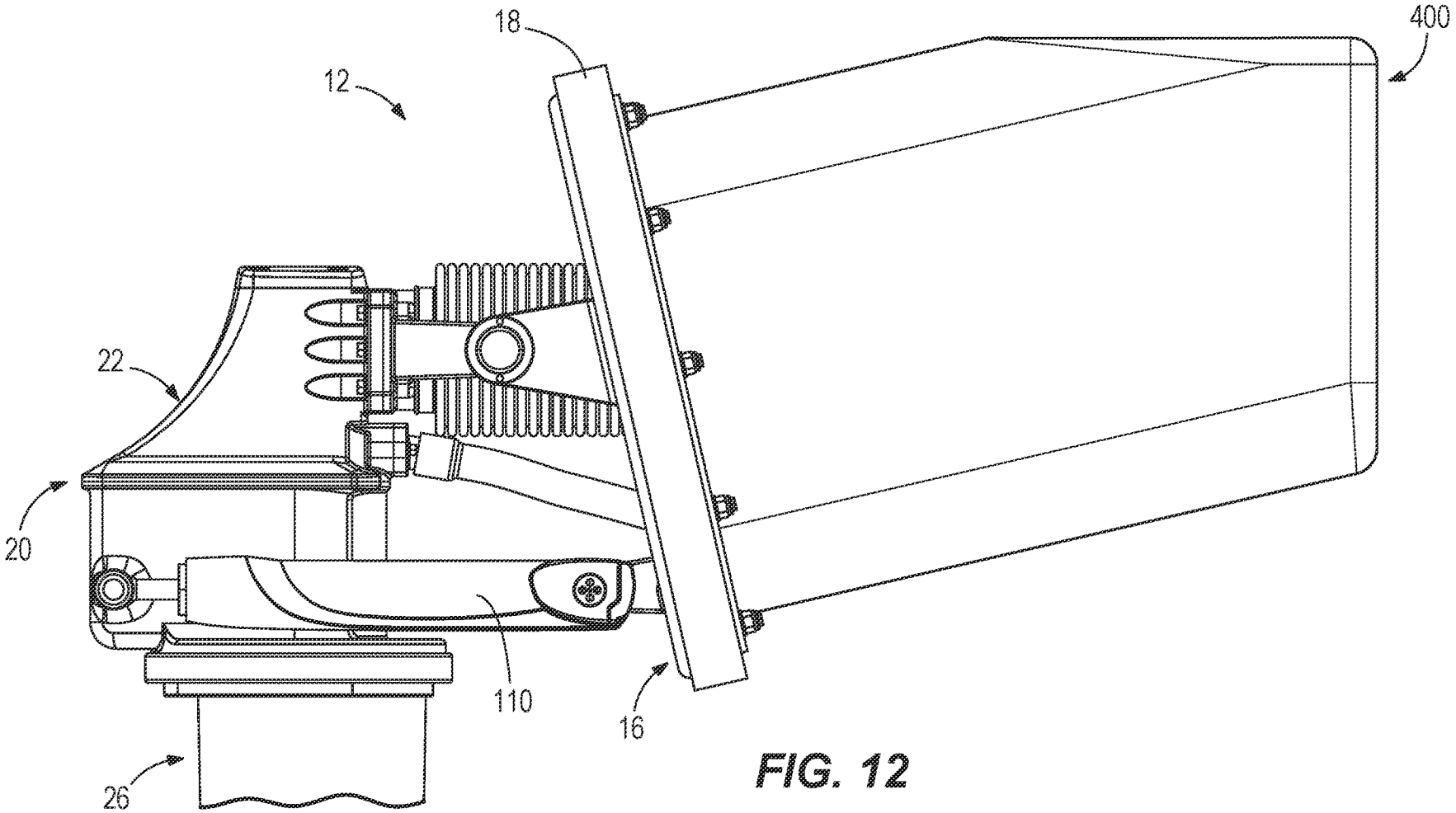
FIG. 12 is a starboard side view of an example of a noise-vibration-harshness (NVH) dampening cover for the stern drive.

Referring to FIGS. 12 and 13, in non-limiting examples, the stern drive 12 also has a sound absorbing enclosure which in other words is a noise-vibration-harshness (NVH) dampening cover 400, which encloses the inboard portions of the stern drive 12 and advantageously limits noise emanating from the stern drive 12. The sound absorbing enclosure 400 can be made of foam and/or any other conventional sound absorbing material, such as a sheet molding compound (SMC). In the illustrated example, the sound absorbing enclosure 400 completely encloses the inboard components of the stern drive 12 and is fixed to the mounting assembly 16. In other examples, the sound absorbing enclosure 400 is configured to only enclose some of the inboard components of the stern drive 12.

FIGS. 22-36 illustrate embodiments of a stern drive 12 with a noise-vibration-harshness (NVH) dampening cover 900 configured to absorb and dampen sound and/or vibrations emanating from the powerhead 14. The stern drive 12 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO.

Similar to the embodiments of FIGS. 14-21, the stern drive 12 of FIGS. 22-36 includes a powerhead 14 and a drive assembly 20, which includes a propulsor 30 for propelling a marine vessel in water. A mounting assembly 16 includes an inner portion 902 (see e.g. FIG. 25) configured to suspend the powerhead 14 inside of the transom 18 and an outer portion 904 configured to suspend the drive assembly 20 outside of the transom 18. The illustrated NVH dampening cover 900 (see e.g., FIG. 31) is configured as an assembly including multiple panels 914, 916 that are suspended from the mounting assembly 16 and extend over the powerhead 14 inside of the marine vessel. As further described herein below, the NVH dampening cover 900 may be efficiently and advantageously installed on an inner portion 902 of the mounting assembly 16 through the opening 19 in the transom 18, from the exterior of the marine vessel.

Figure 22:
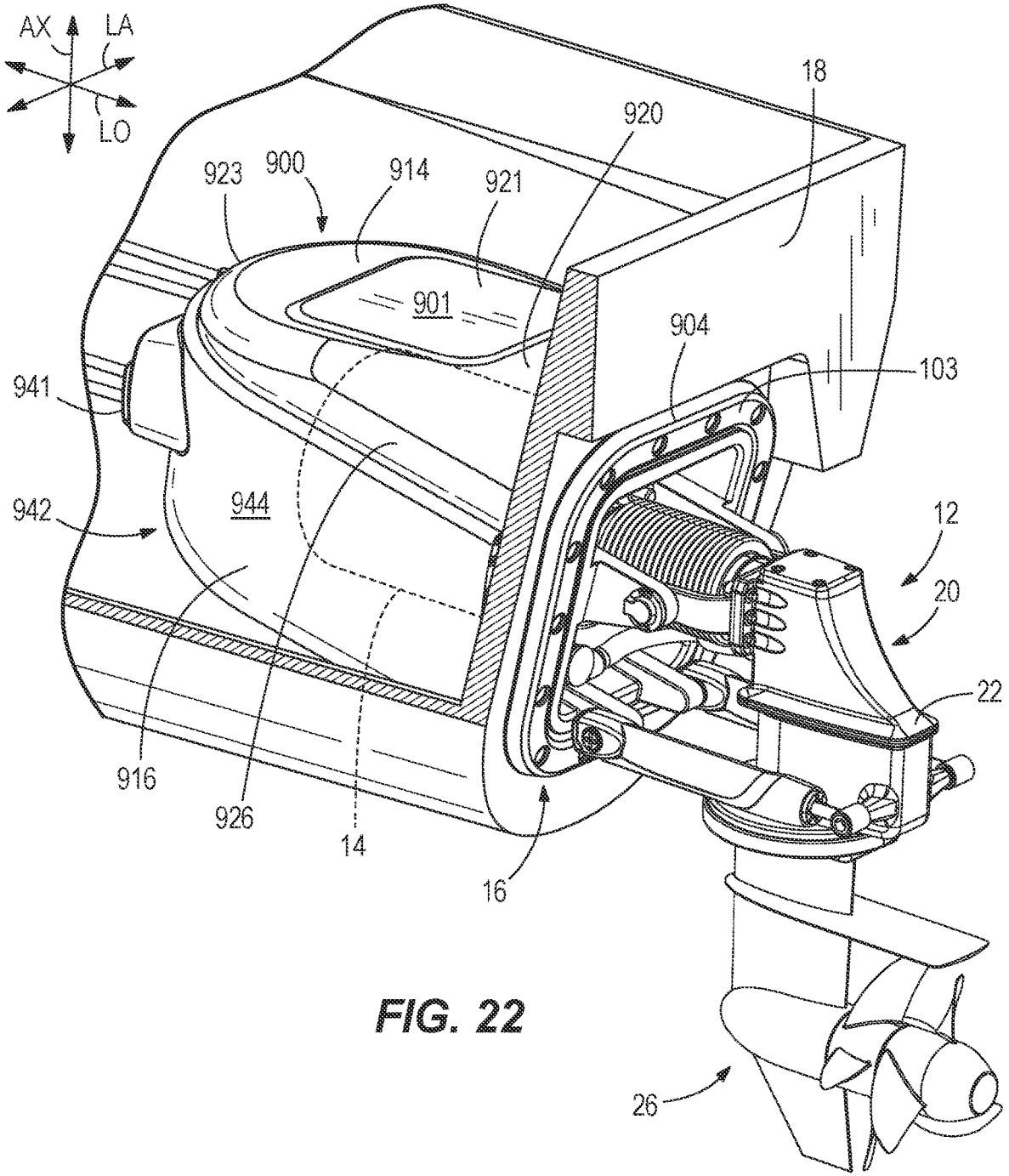
FIG. 22 is a port side perspective view of a stern drive including a noise-vibration-harshness (NVH) dampening cover according to the present disclosure.
Figure 24:
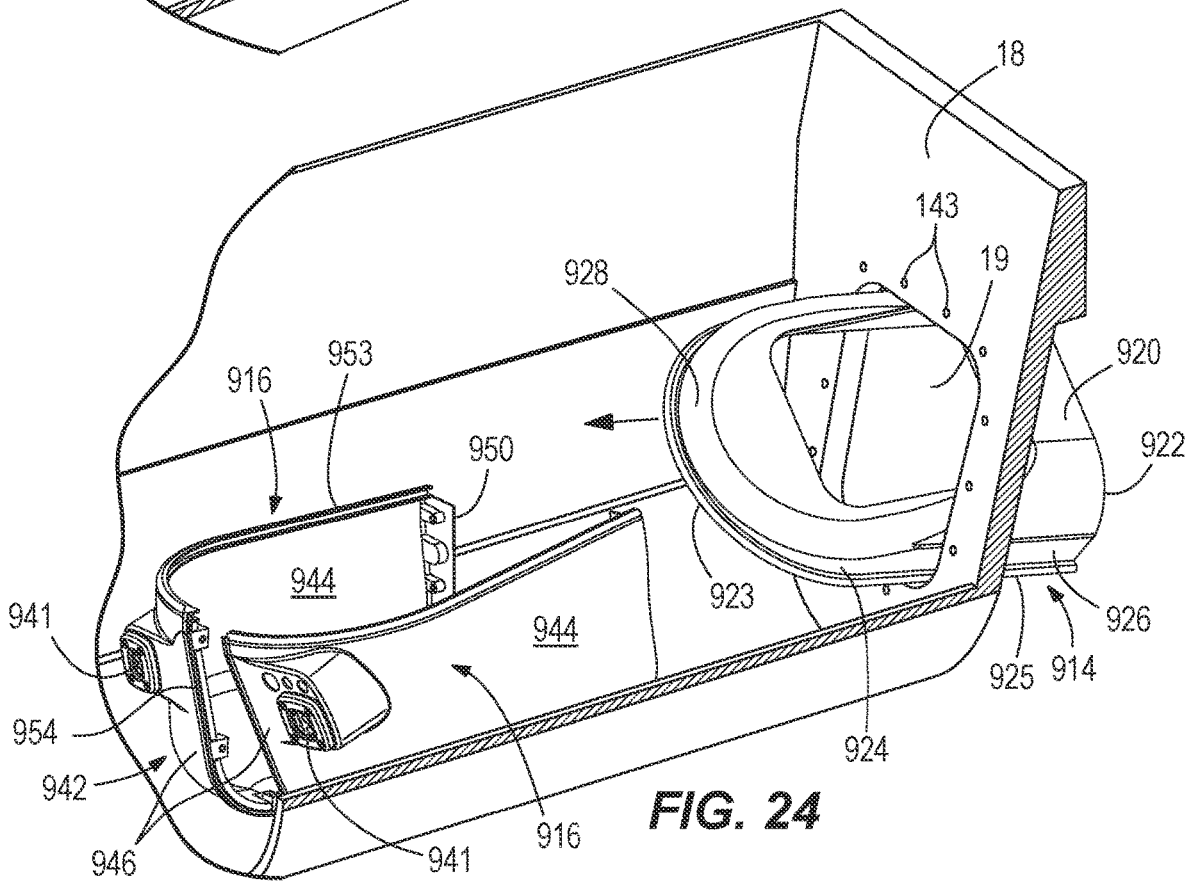
FIG. 24 is the port side perspective view of FIG. 23 with a top panel of the NVH dampening cover being inserted through an opening in the transom.
Figure 25:
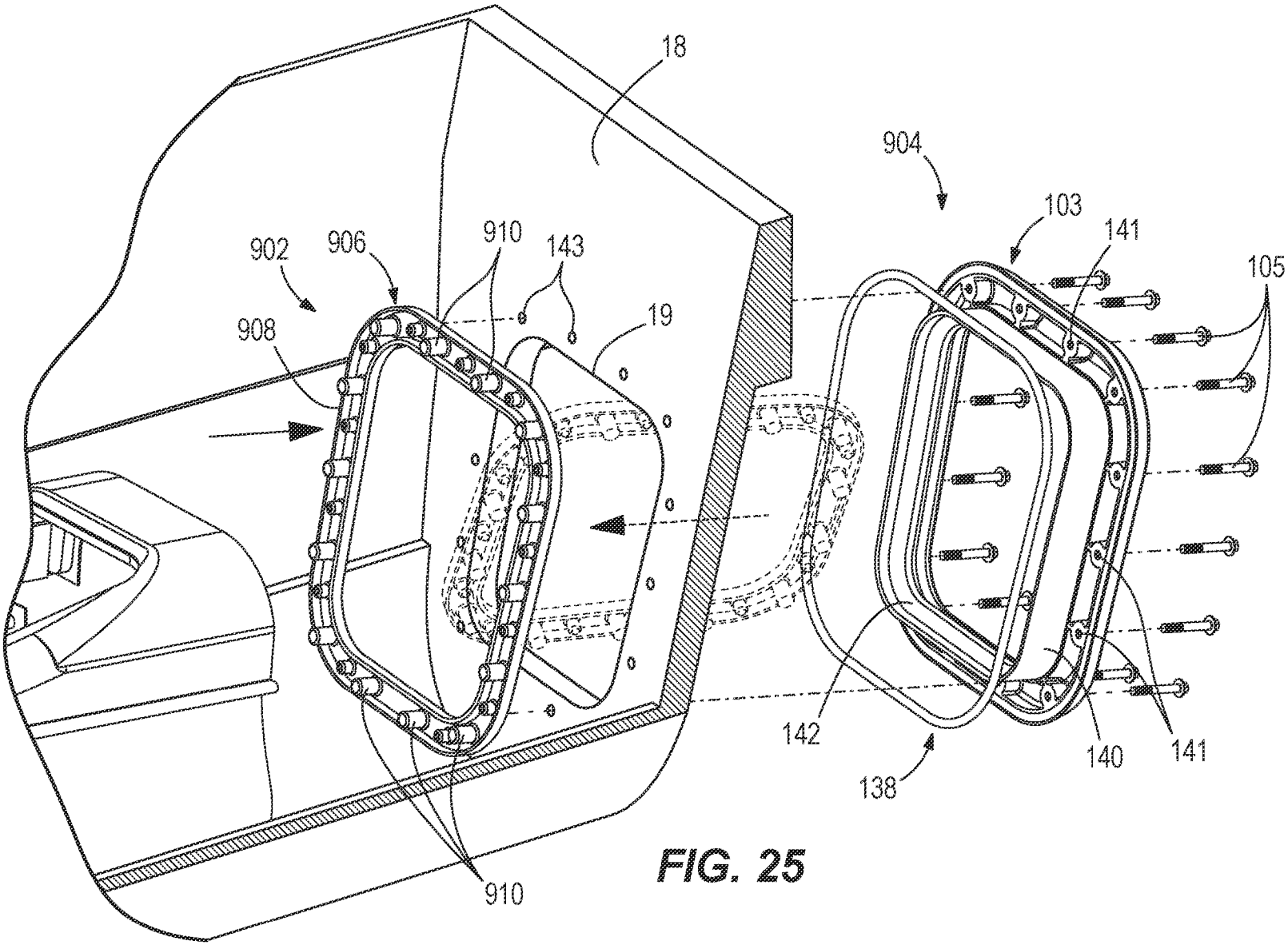
FIG. 25 is the port side perspective view of FIG. 24 with a mounting assembly being coupled to the transom.

Referring to FIG. 25, the illustrated mounting assembly 16 resides in (and extends through) an opening 19 in the transom 18 of the marine vessel and includes an inner portion 902 facing inside the marine vessel and an outer portion 904 facing outside the marine vessel. The inner portion 902 is fixed to the transom 18 by either (not shown) studs or dedicated fasteners to hold in place so the NVH cover can be installed. In the illustrated embodiment, the outer portion 904 of the mounting assembly 16 includes a rigid mounting ring 103 that extends around, and is supported in, the opening 19 in the exterior of the transom 18. Similar to the rigid mounting ring 103 of the stern drive 12 of FIGS. 14-21, the rigid mounting ring 103 of the stern drive 12 of the embodiment in FIGS. 22-36 is configured to support a rigid mounting plate 100 (FIGS. 14-15) in the opening 19 via a vibration dampening mounting ring 102 (FIGS. 14-15). As illustrated in FIG. 22, the drive assembly 20 is coupled to and suspended on an exterior side of the rigid mounting plate 100. Referring to FIG. 25, the rigid mounting ring 103 is positioned on the exterior of the transom 18 and includes an annular rim 140 that extends around the opening 19 and abuts the outer surface of the transom 18. A support surface 142 of the rigid mounting ring 103 extends from the annular rim 140 into the opening 19 along the periphery of the opening 19. Mounting holes 141 formed through the annular rim 140 are configured to receive fasteners 105 that extend through through-bores 143 formed in the transom 18.

With continued reference to FIG. 25, the inner portion 902 of the mounting assembly 16 includes a fastening ring 906 with a generally planar annular rim 908 that extends around the opening 19 and sits flush against the interior surface of the transom 18. A plurality of mounting openings 910 are formed through the annular rim 908 of the fastening ring 906 and are positioned in alignment with certain corresponding through-bores 143 formed in the transom 18. As further explained herein below, during assembly, dedicated fasteners or studs (not shown) are inserted through the corresponding through-bores 143 from inside or outside the transom 18 and into the mounting openings 910 to fasten the fastening ring 906 to the interior surface of the transom 18. This step is performed prior to a later step of fastening the outer portion 904 of the mounting assembly 16 to the outside surface of the transom 18, as further described herein above, for example after assembly of the NVH dampening cover 900, as further described herein below. Generally, mounting holes 141 are formed through the annular rim 140 of the rigid mounting ring 103. As explained herein above, fasteners 105 are inserted through the mounting holes 141 and into certain through-bores 143 of the transom 18 to fasten the rigid mounting ring 103 to the outside of the transom 18, along with the powerhead 14 and drive assembly 20. Some embodiments may be configured with an O-ring 138 positioned between the rigid mounting ring 103 and the transom 18 to form a seal therebetween. Other embodiments, however, may omit an O-ring 138.

Referring to FIGS. 22-24, 35, and 36, the NVH dampening cover 900 comprises a plurality of panels 914, 916 which together at least partially surround the powerhead 14. A top panel 914 forms a top of the NVH dampening cover 900 and opposing side panels 916 form the bottom and sides of the NVH dampening cover 900. Each of the panels 914, 916 is fastened to the fastening ring 906 on the inner portion 902 of the mounting assembly 16 such that they are suspended from the fastening ring 906 of the mounting assembly 16, for example prior to further assembly of the outer portion 904 of the mounting assembly 16 and remainder of the stern drive 12. The plurality of panels 914, 916 are configured to mate with each other when suspended from the mounting assembly 16, thereby enclosing a powerhead 14 suspended from the transom 18 of the marine vessel. The interior surface of each panel 914, 916 is lined with a sound and/or vibration absorbing dampening material 980 that absorbs or dampens any noise or vibrations produced by the components housed in the NVH dampening cover 900. For example, the dampening material may be formed from at least one of open cell foam, closed cell foam, an elastomeric material 980 such as rubber, and any other material configured to absorb or dampen noise or vibrations.

Figure 28:
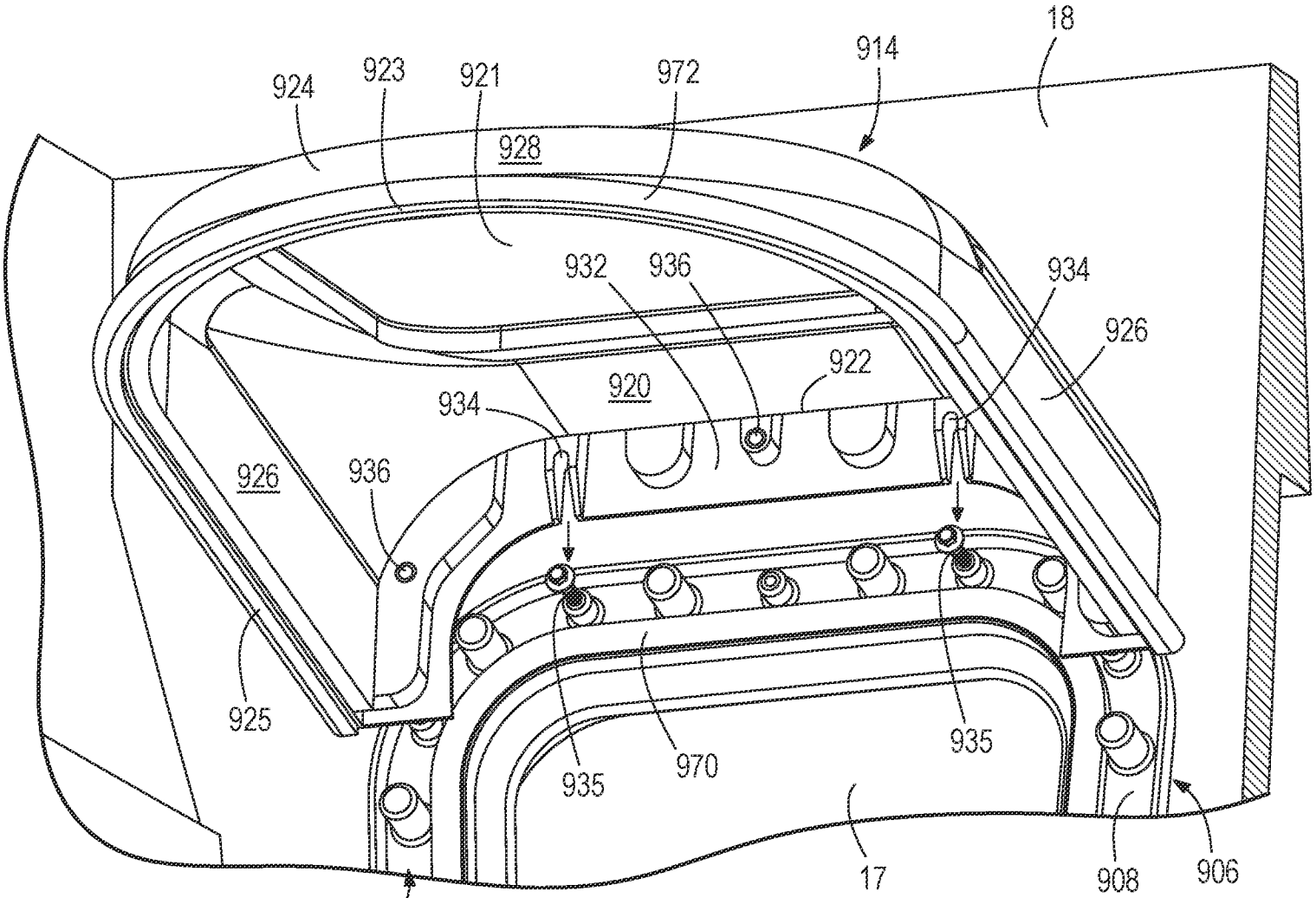
FIG. 28 is a perspective view of the top panel in position above the inner portion of the mounting assembly.
Figure 29:
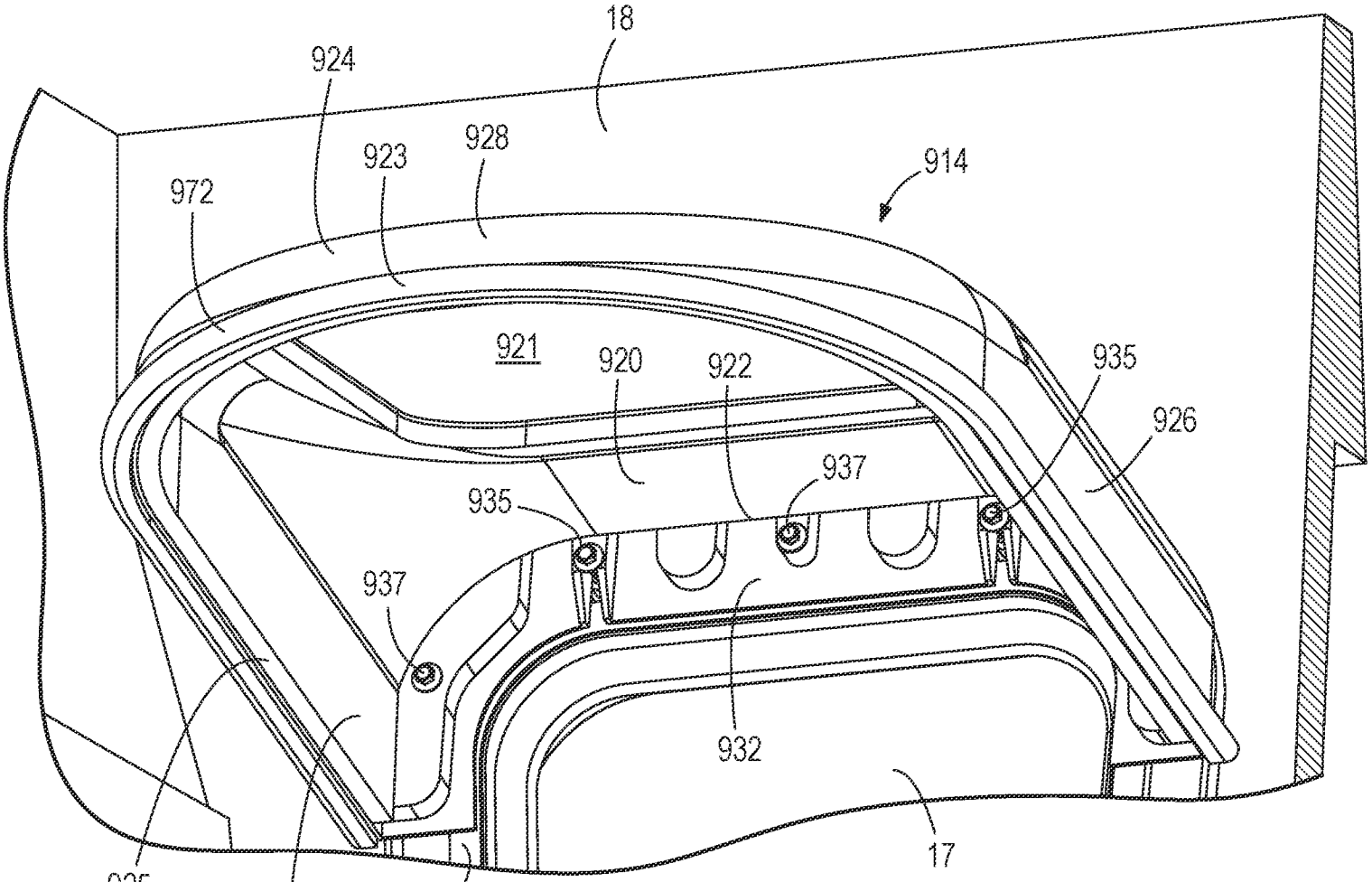
FIG. 29 is the perspective view of FIG. 28 with the top panel secured to the inner portion of the mounting assembly.

Referring to FIGS. 22, 28, and 29, the top panel 914 includes a top wall 920 extending longitudinally from a back end 922 to a front end 923 and a generally U-shaped perimeter wall 924 that extends downward from the top wall 920 to a lower edge 925 of the perimeter wall 924. A hatch 921 is formed through the top wall 920 and provides access to an interior 901 of the NVH dampening cover 900 from the interior of the marine vessel. This may be useful, for example, so that the interior 901 of the NVH dampening cover 900 may be accessed from above the NVH dampening cover 900. Some embodiments may include a hatch cover (not shown) movable between an open and closed position to seal the hatch 921.

Referring to FIGS. 28 and 29, the perimeter wall 924 includes opposing lateral side walls 926 and a curved front wall 928 that extends around the front end 923 of the top panel 914 between the lateral side walls 926 to form a generally continuous surface. In other embodiments the curved surface could be flat. A top panel mounting flange 932 is formed around the front end 923 of the top panel 914 and extends downward from the top wall 920 and laterally inward from the side walls 926. A plurality of slots 934 and mounting openings 936 are formed through the mounting flange 932 and are configured for securing the top panel 914 to the fastening ring 906 with fasteners 935, 937. This is not limiting in that in other examples there may be just one slot 934. In the illustrated example, the slots 934 face downward and are slidably engageable with fasteners 935 on the mounting assembly 16, which facilitates hanging of the top panel 914 on the mounting assembly 16 during assembly, and which thereby facilitates further installation by fastening the top panel 914 to the mounting assembly 16 with additional fasteners 937. A lip 930 (FIG. 31) is formed around and extends outward from the perimeter wall 924 proximate the lower edge 925 thereof. As discussed in further detail below, the side panels 916 and a seal member 972 are configured to engage the lip 930 such that the side panels 916 are at least partially suspended from the top panel 914 during installation of the NVH dampening cover 900.

Referring to FIGS. 23, 24 and 30-32, the side panels 916 are configured to be suspended from the top panel 914 and/or the inner portion 902 of the mounting assembly 16 and are joined at a seam 940 to form a bottom portion 942 of the NVH dampening cover 900. Each side panel 916 includes a lateral side wall 944, a front wall section 946 that joins with the front wall section 946 of the opposing side panel 916 to form a front wall 947 (FIG. 31) of the bottom portion 942, and a bottom wall section 948 that joins with the bottom wall section 948 to form a bottom wall 949 (FIG. 32) of the bottom portion 942. Each side panel 916 may include at least one rigging port 941 through which a rigging connector (not shown) may extend into the NVH dampening cover 900 to connect to the powerhead 14 and/or any other components housed in the NVH dampening cover 900. In the illustrated embodiments, the rigging ports 941 are formed through the front wall sections 946 of each side panel 916. Some embodiments, however, may include at least one rigging port 941 formed through a different portion of a side panel 916 and/or the top panel 914.

A side panel mounting flange 950 is formed around a rear end 951 of each side panel 916. The side panel mounting flange 950 extends upward from the bottom wall section 948 and laterally inward from the side walls 944 of the side panel 916. A plurality of mounting holes 960 are formed through the side panel mounting flanges 950 and are configured to receive fasteners 961 to secure the side panels 916 to the fastening ring 906. A groove 952 (FIG. 36) is formed around an upper edge 953 of each side panel 916 and extends along the upper edges of the side wall 944 and the front wall section 946. As discussed in further detail below, the grooves 952 formed on the side panels 916 are configured to receive a seal member 972 and the lip 930 of the top panel 914 to suspend the side panel 916 from the top panel 914 during installation of the NVH dampening cover 900.

Figure 30:
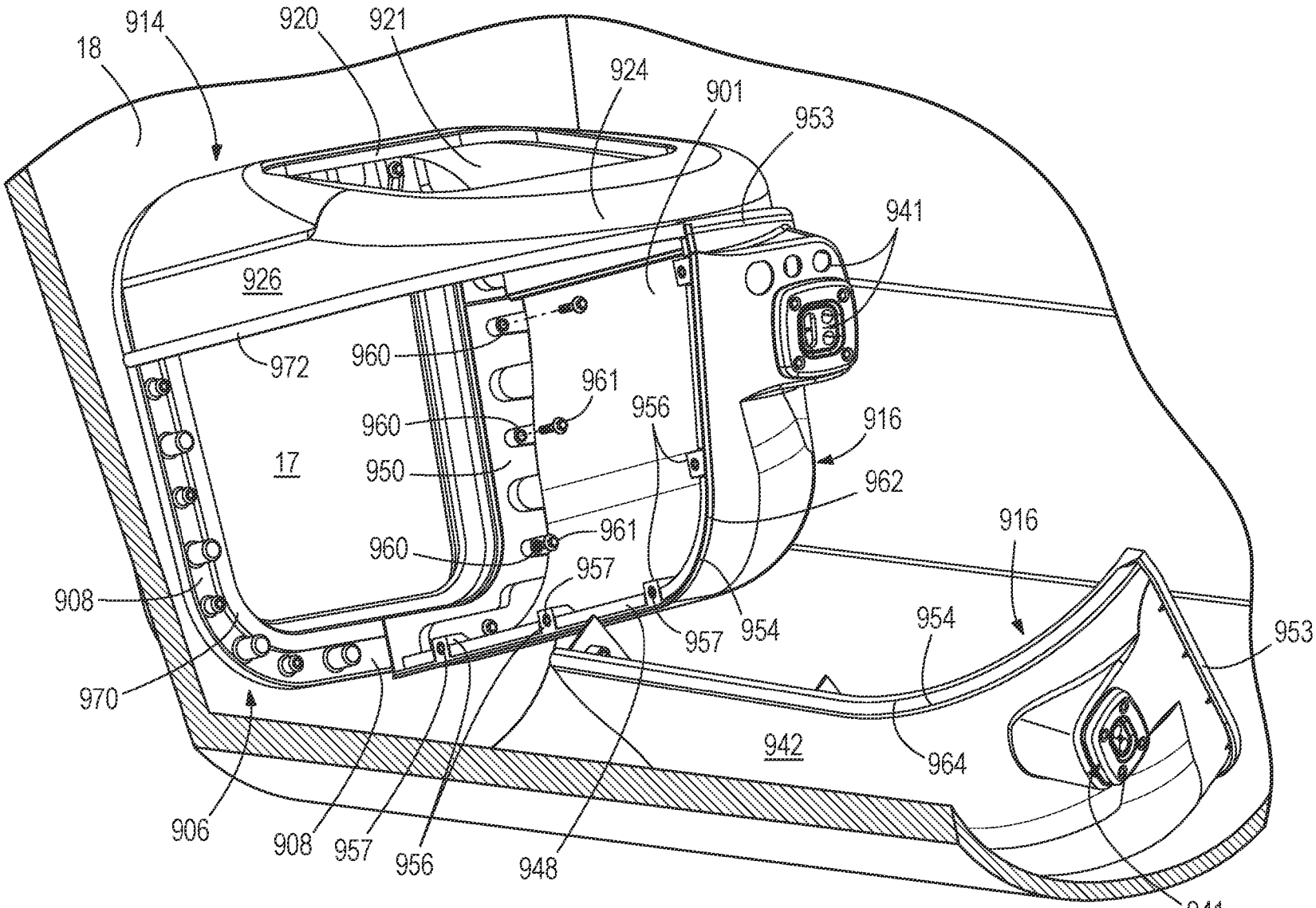
FIG. 30 is a starboard side perspective view with a side panel supported on the top panel and the mounting assembly.
Figure 32:
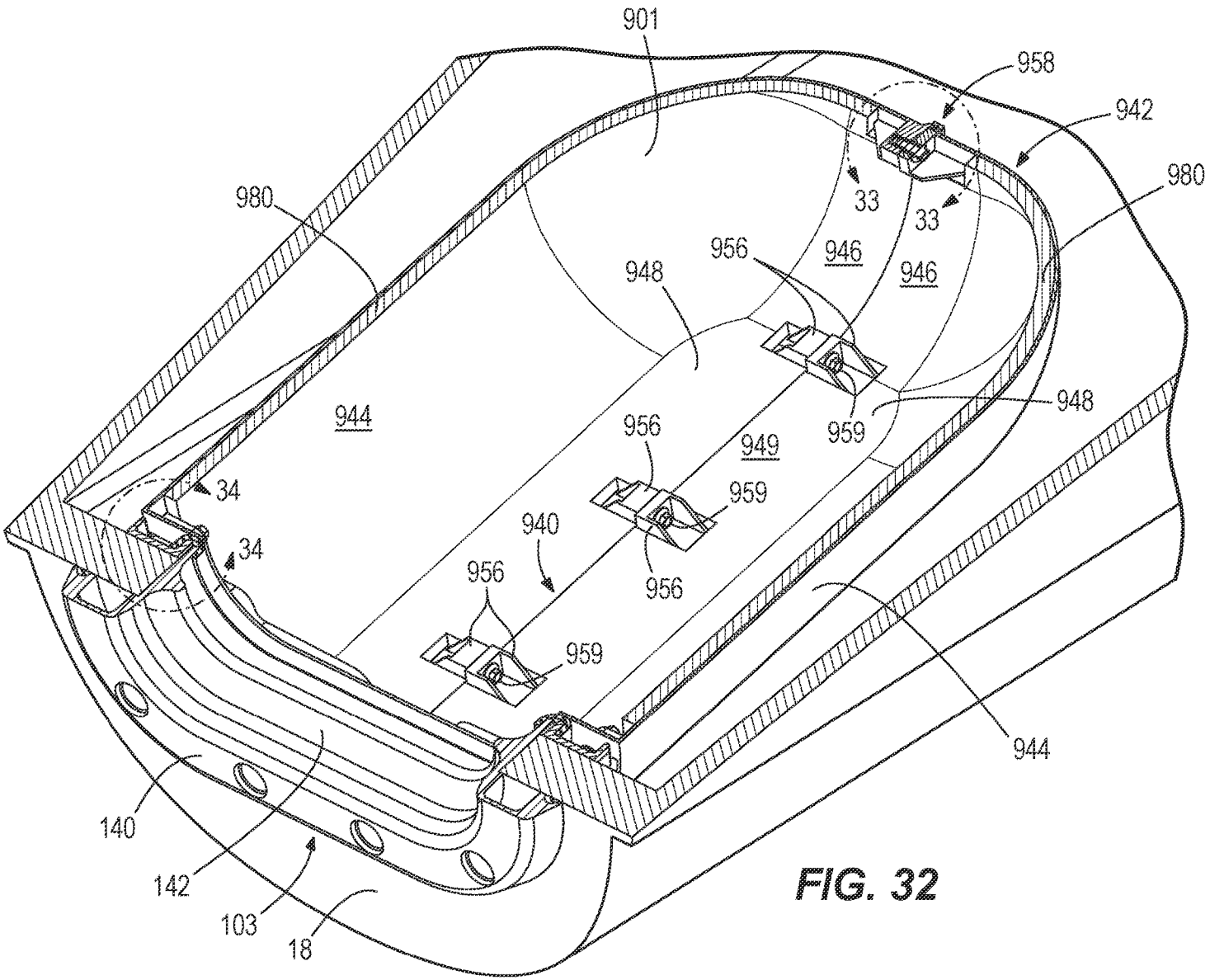
FIG. 32 is a view of section 32-32, taken in FIG. 31.
Figure 33:
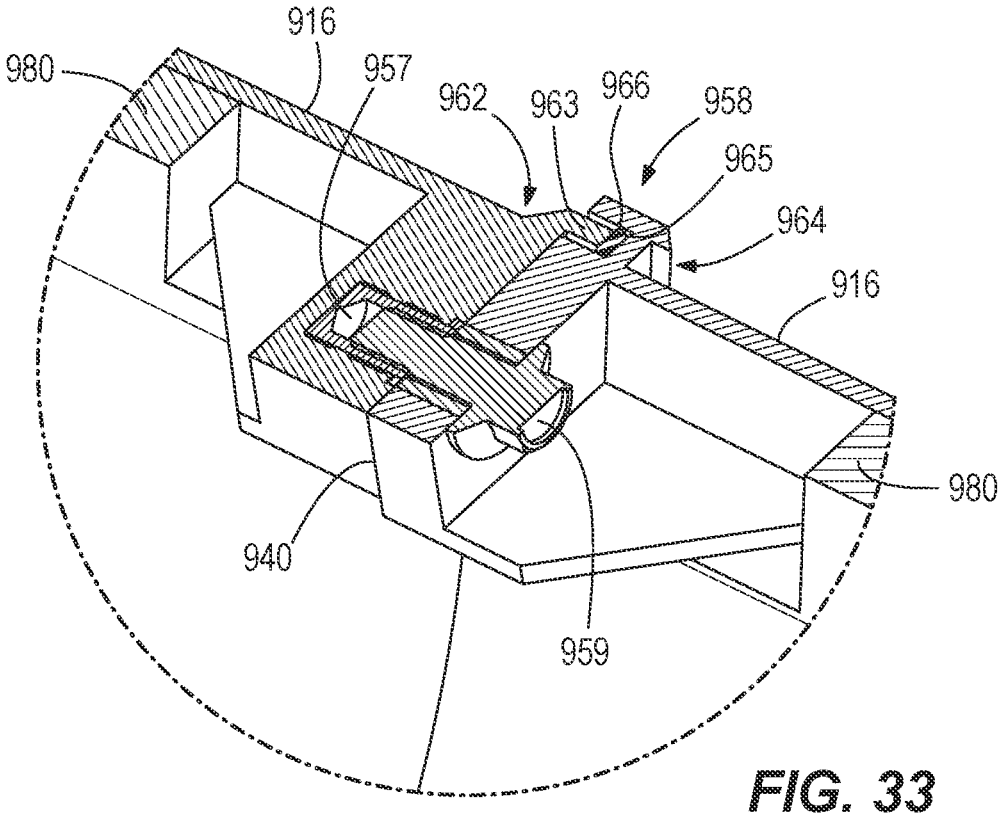
FIG. 33 is a view of detail 33-33, taken in FIG. 32.

Referring to FIGS. 30, 32, and 33, as previously mentioned, the opposing side panels 916 are configured to be fastened to each other at a seam 940 extending along a lateral midpoint of the NVH dampening cover 900. Each side panel 916 includes mounting brackets 956 formed along an interior edge 954 of the side panel 916 at the seam 940 between the opposing side panels 916. Each mounting bracket 956 is positioned in alignment with a corresponding mounting bracket 956 on the opposing side panel 916. A laterally extending through-bore 957 is formed through each mounting bracket 956, and a fastener 959 extends through the through-bores 957 in each set of corresponding mounting brackets 956 to couple the side panels together at the seam 940.

To prevent the ingress of water into the NVH dampening cover 900 through the seam 940, the interior edges 954 of the side panels 916 are configured as a tongue-and-groove interface 958. Referring to FIG. 33, the tongue-and-groove interface 958 is formed along the interior edges 954 of the front wall sections 946 and bottom wall sections 948. A first one of the opposing side panels 916 is configured with the tongue portion 962 of tongue-and-groove interface 958 and the other one of the opposing side covers 916 is configured with the groove portion 964 of tongue-and-groove interface 958. The groove portion 964 includes a groove 965 that extends along the interior edge 954 of the first one of the side panels 916 and has an opening that faces laterally inward towards the opposing side panel 916. The tongue portion 962 includes a protrusion 963 that projects laterally inward from the interior edge 954 of the second one of the side panels 916. The protrusion 963 is configured to be received in the groove 965 to link the opposing side panels 916. A seal member 966 may be positioned within the groove 965 and is configured to be sandwiched between the protrusion 963 and the interior of the groove 965 to form a seal between the side panels 916.

Figure 26:
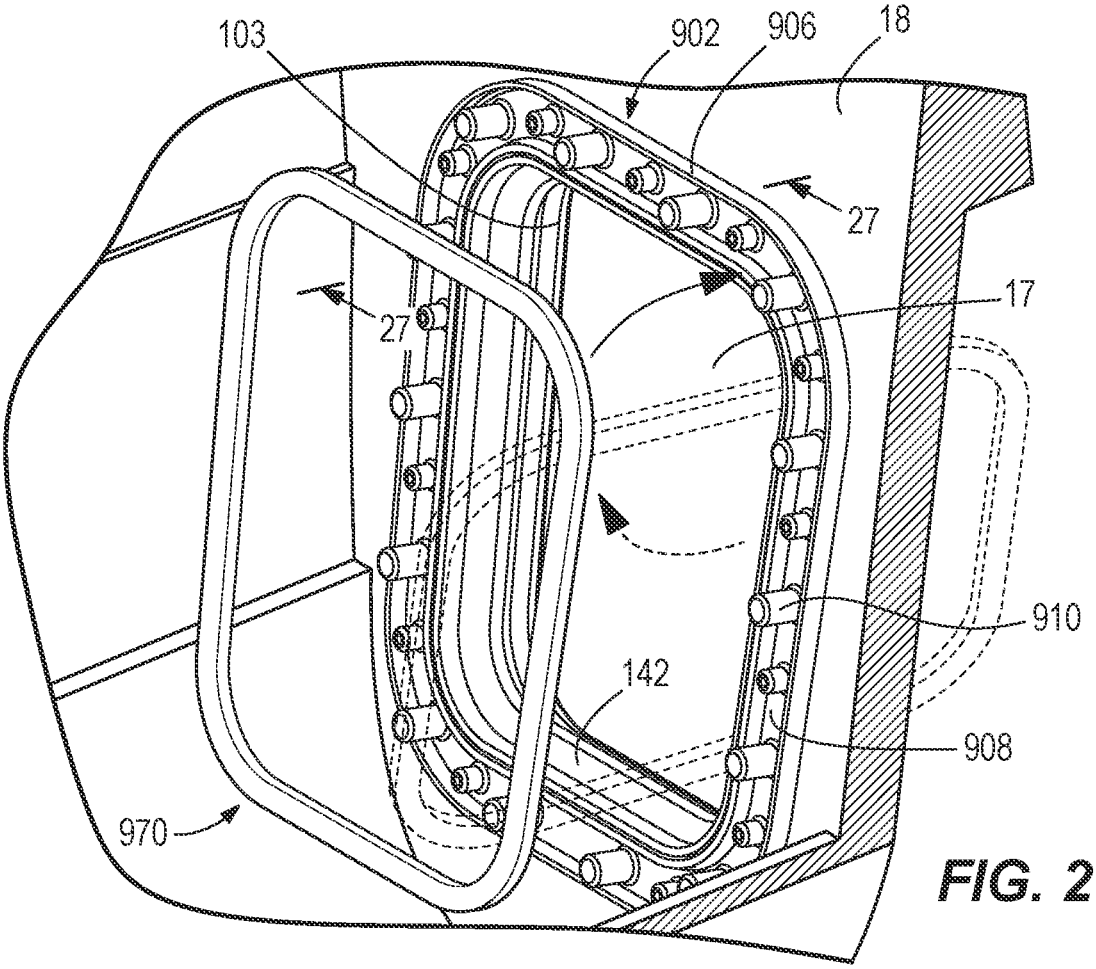
FIG. 26 is the port side perspective view of FIG. 25 with a seal member being positioned on the mounting assembly.
Figure 27:
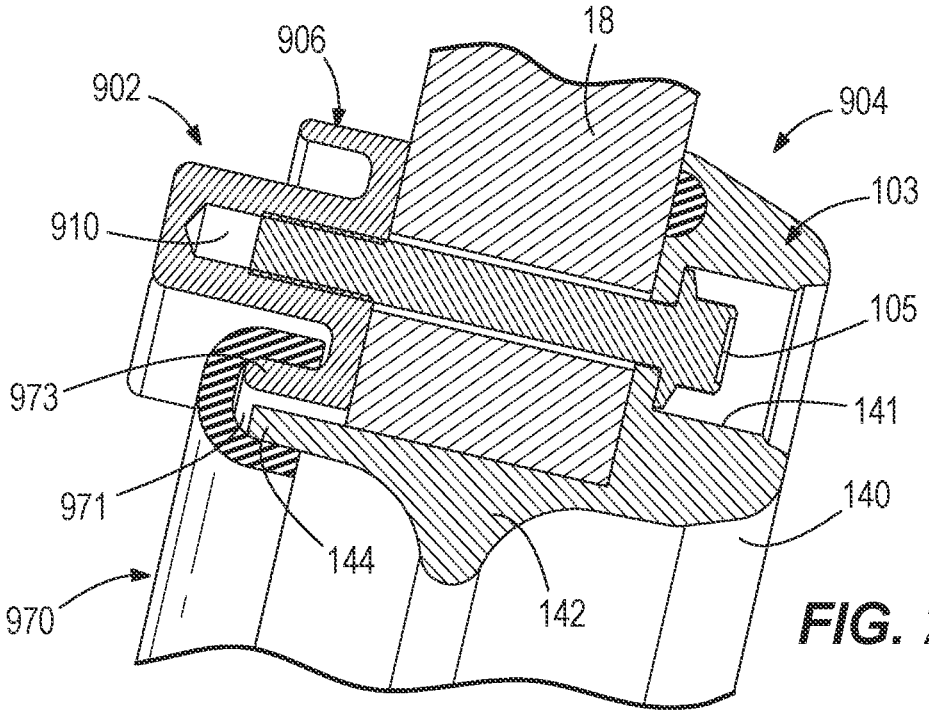
FIG. 27 is a view of section 27-27, taken in FIG. 26.
Figure 34:
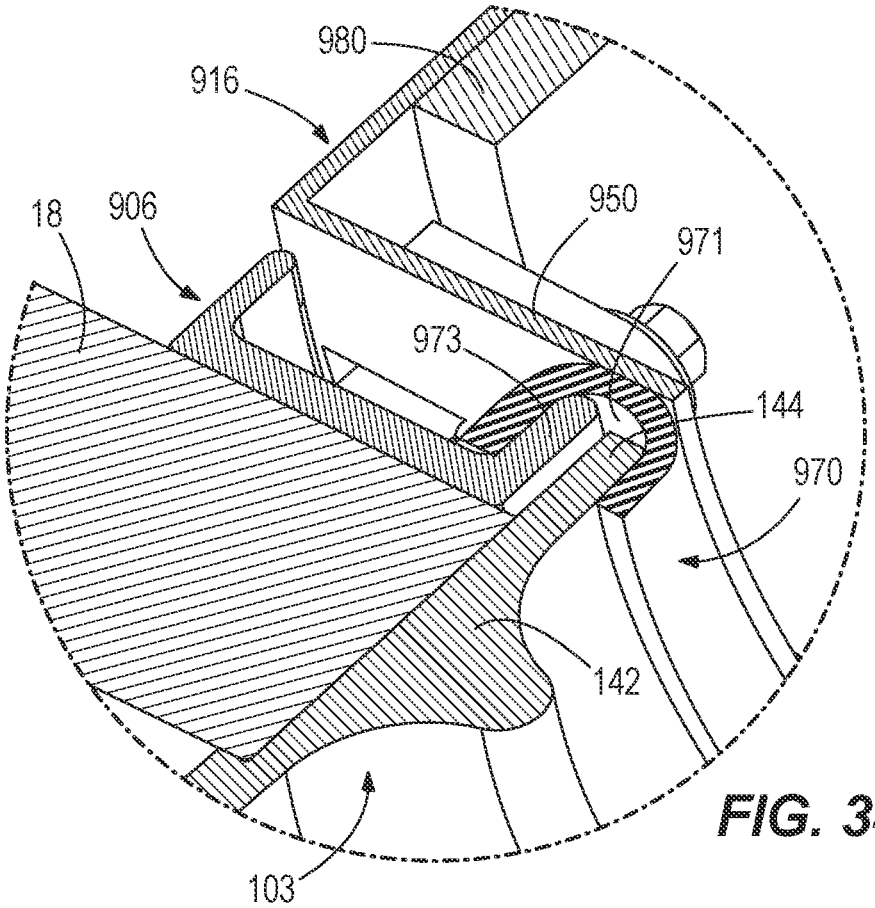
FIG. 34 is a view of detail 34-34, taken in FIG. 32.

Some embodiments of a NVH dampening cover 900 may include at least one seal configured to prevent ingress of fluid to the NVH dampening cover 900. Referring to FIGS. 26, 27, and 34, the NVH dampening cover 900 includes an annular seal member 970 that is located between the NVH dampening cover 900 and the mounting assembly 16 and forms a seal therebetween. Referring to FIG. 27, the annular seal member 970 has a shape that corresponds to the shape of the aperture 17 through the mounting assembly 16. In the illustrated embodiments, the annular seal member 970 is generally rectangular with rounded corners. Other embodiments, however, may be differently shaped. The annular seal member 970 has a U-shaped cross-sectional profile configured to extend around a portion of the rigid mounting ring 103 and the fastening ring 906. The U-shaped cross section of the annular seal member 970 defines a groove 971 that receives a forward-extending lip 973 formed around the interior periphery of the fastening ring 906 and the distal end 144 of the support surface 142 of the rigid clamp ring 103. As illustrated in FIG. 34, when the panels 914, 916 of the NVH dampening cover 900 are secured to the mounting assembly 16, the annular seal member 970 is compressed between the mounting flanges 932, 950 of the panels 914, 916 and the edges of the rigid clamp ring 103 and the fastening ring 906, thereby forming a seal between the NVH dampening cover 900 and the mounting assembly 16.

Figure 35:
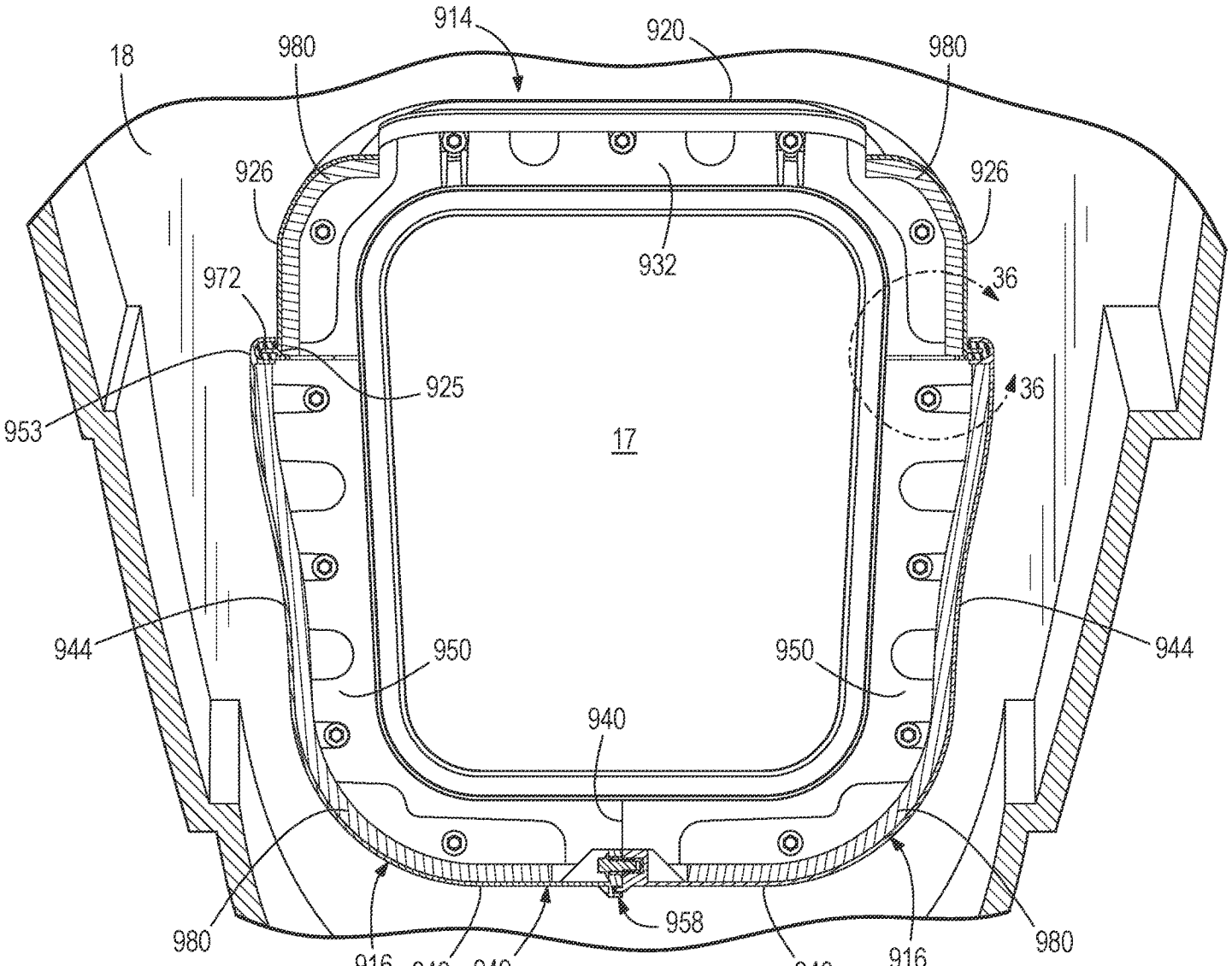
FIG. 35 is a view of section 35-35, taken in FIG. 31
Figure 36:
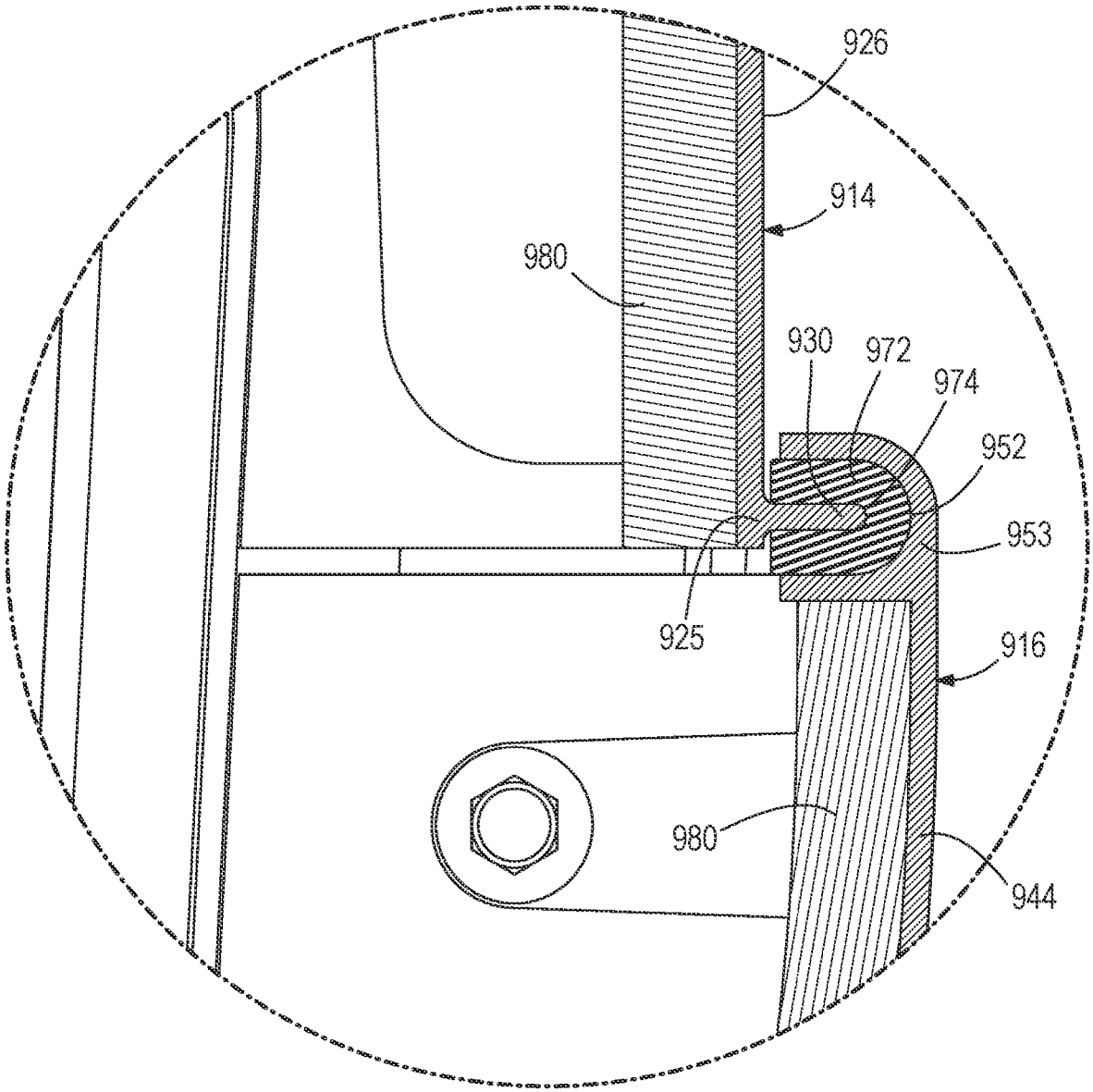
FIG. 36 is a view of detail 36-36, taken in FIG. 35.
Figure 37:
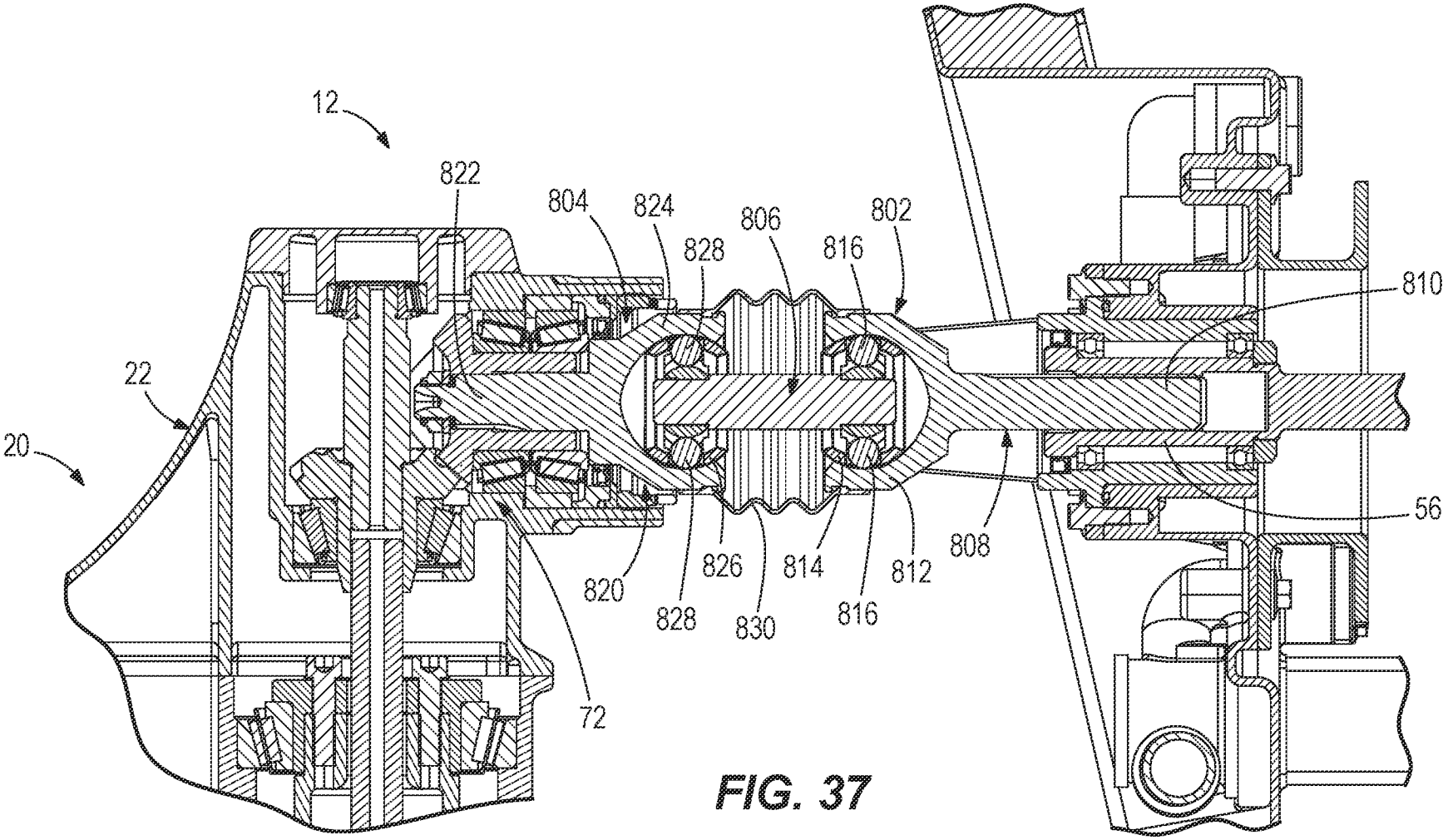
FIG. 37 is a starboard sectional view of another example of the stern drive having dual constant velocity (CV) joints and center shaft instead of the universal joint shown in FIG. 5
Figure 38:
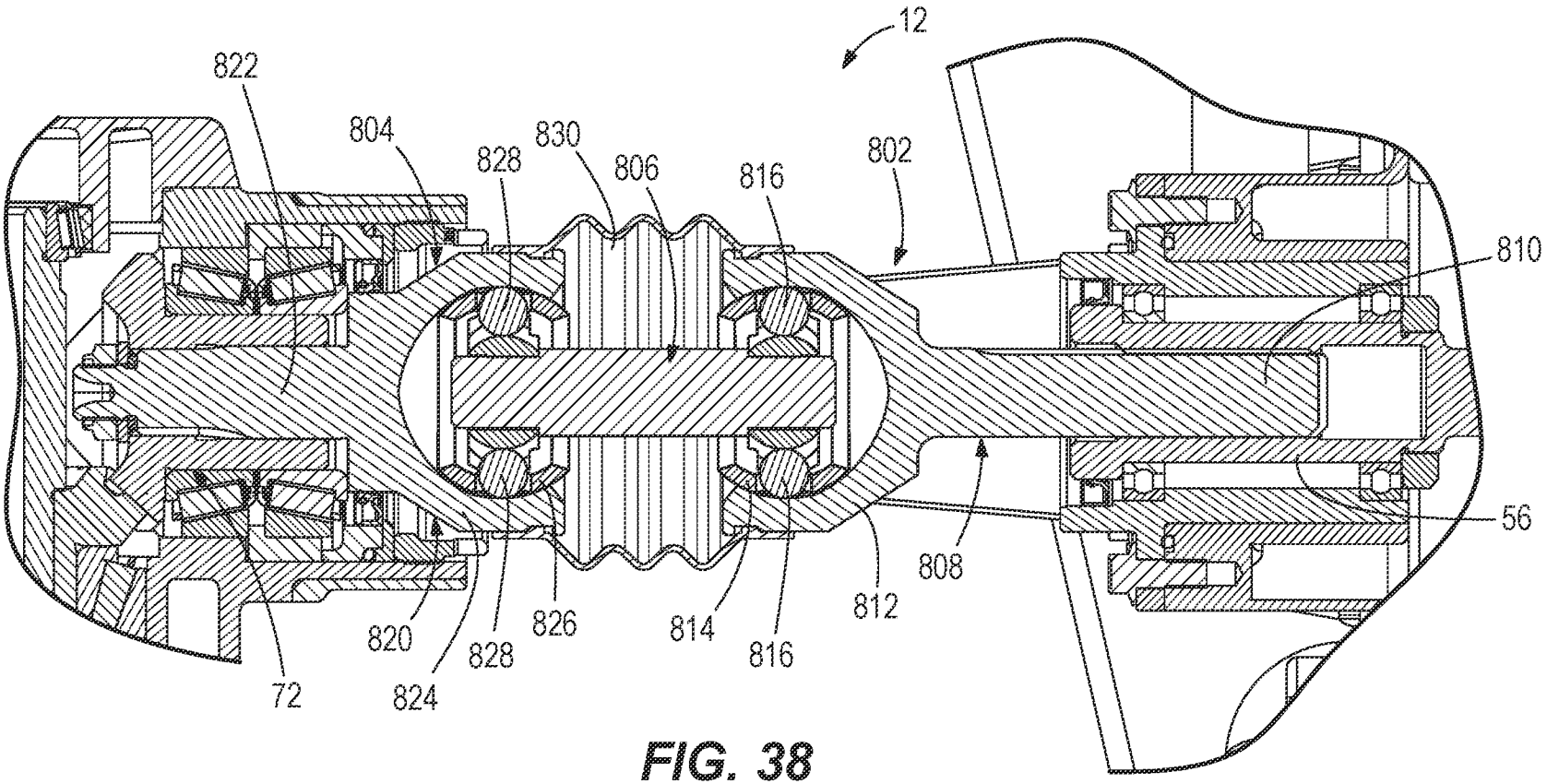
FIG. 38 is a closer starboard sectional view of the dual CV joints and center shaft shown in FIG. 37.

Referring to FIGS. 28 and 29, additionally or alternatively, some embodiments may include a seal member 972 configured to form a seal between the top panel 914 and at least one of the side panels 916. More particularly, the NVH dampening cover 900 includes a generally U-shaped seal member 972 that extends around the lower edge 925 of the top panel 914. Referring to FIGS. 35 and 36, the U-shaped seal member 972 has a U-shaped cross-section that defines an inward facing groove 974 extending the length of the U-shaped seal member 972. The inward facing groove 974 is configured to receive the lip 930 formed around the lower edge 925 of the top panel 914 to support the U-shaped seal member 972 on the top panel 914. When connecting the side panels 916 to the top panel 914, the grooves 952 formed around the upper edges 553 of the side panels 916 are configured to receive the U-shaped seal member 972 in order to suspend the side panels 916 from the top panel 914.

In the illustrated embodiments, the U-shaped seal member 972 is preassembled on the top panel 914 prior to insertion into the marine vessel. Some embodiments, however, may be configured with a U-shaped seal member 972 that is passed through the opening 19 and moved into position on the top panel 914 after the top panel 914 has been secured to the mounting assembly 16.

Figure 23:
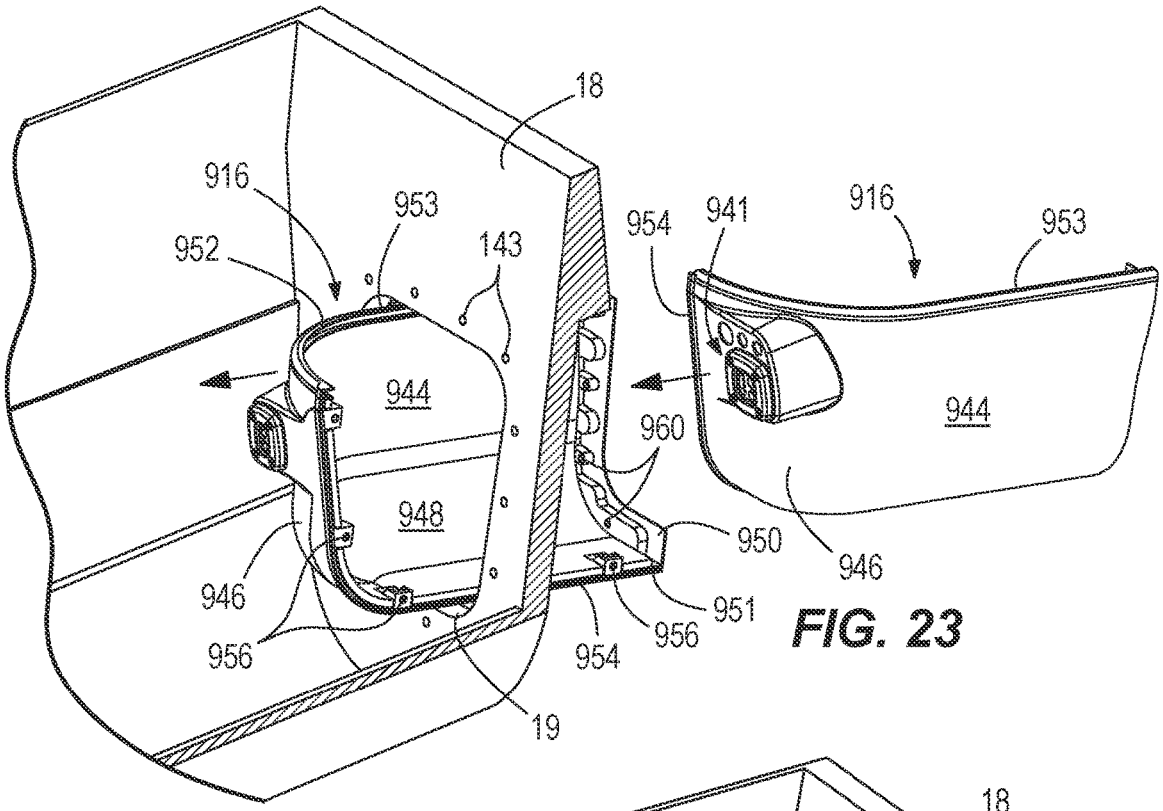
FIG. 23 is a port side perspective view of side panels of the NVH dampening cover of FIG. 22 being inserted through an opening in the transom.

Embodiments of a stern drive 12 including the NVH dampening cover 900 of FIGS. 22-36 are advantageously configured so that the inner portion of the mounting assembly 16, the powerhead 14, and the NVH dampening cover 900 can fit through the opening 19 in the transom 18 for mounting the stern drive 12 so that they may be assembled and fastened to the mounting assembly 16 from outside the marine vessel. Referring to FIGS. 23 and 24, the top panel 914 and the two opposing side panels 916 are inserted through the opening 19 in the transom 18 and are placed temporarily within the transom 18 until the panels 914, 916 can be secured to the outer portion 902 of the mounting assembly 16 which is already fastened to the interior surface of the transom 18. As illustrated in FIG. 23, the side panels 916 are dimensioned such that they may fit through the opening 19 while in an upright position. As illustrated in FIG. 24, the top panel 914 may be rotated to fit through the opening 19 on a diagonal.

During assembly, referring to FIG. 25, the fastening ring 906 is passed through the opening 19 and moved into position against the interior face of the transom 18. As explained herein above, fasteners or studs (not shown) are inserted through the corresponding through-bores 143 from outside the transom 18 and into the mounting openings 910 to fasten the fastening ring 906 to the interior surface of the transom 18.

In the illustrated embodiments, the panels 914, 916 of the NVH dampening cover 900 are then inserted into the marine vessel before the mounting assembly 16 is secured around the opening 19 through the transom 18. However, it should be appreciated that this order may be reversed, and the inner portion 902 of the mounting assembly 16 may be coupled to the transom 18 prior to inserting the top and side panels 914, 916 into the marine vessel. In such an embodiment, the top panel 914 and the side panels 916 may be passed through the transom 18 via the aperture 17 in the mounting assembly 16.

Referring to FIGS. 26 and 27, the annular seal member 970 may be inserted into the marine vessel via the aperture 17 in the mounting assembly 16 and moved into position between the plurality of panels 914, 916 and the mounting assembly 16. The annular seal member 970 is then moved into position on the mounting assembly 16 by sliding the annular seal member 970 onto the mounting assembly 16 such that the forward-extending lip 973 of the fastening ring 906 and the distal end 144 of the support surface 142 of the rigid clamp ring 103 are received in the groove 971 defined by the U-shaped cross-section of the annular seal member 970.

Referring to FIGS. 28 and 29, the panels 914, 916 of the NVH dampening cover 900 may then be accessed through the opening 19 in the transom to fasten the panels 914, 916 to the inner portion 902 of the mounting assembly 16. First, as illustrated in FIG. 28, the top panel 914 is hung from fastening ring 906 of the mounting assembly 16 by positioning the top panel 914 above the opening 19 and moving the top panel 914 downward such that the fasteners 935 extending from the mounting assembly 16 are received in the slots 934. The fasteners 935 may then be tightened and additional fasteners 937 are inserted through the mounting openings 936 in the mounting flange 932 of the top panel 914 to secure the top panel 914 to fastening ring 906 of the mounting assembly 16, as illustrated in FIG. 29. As the fasteners 935, 937 are tightened, the annular seal member 970 is compressed between the top cover 914 and the mounting assembly 16. If the U-shaped seal member 972 was not prepositioned on the top panel 914, the U-shaped seal member 972 may be passed into the interior of the marine vessel via the aperture 17 through the mounting assembly 16. The U-shaped seal member 972 is then moved into position on the top cover 914 such that the groove 974 formed in the U-shaped seal member 972 receives the lip 930 formed around the lower edge 925 of the top panel 914 (FIG. 41).

Figure 31:
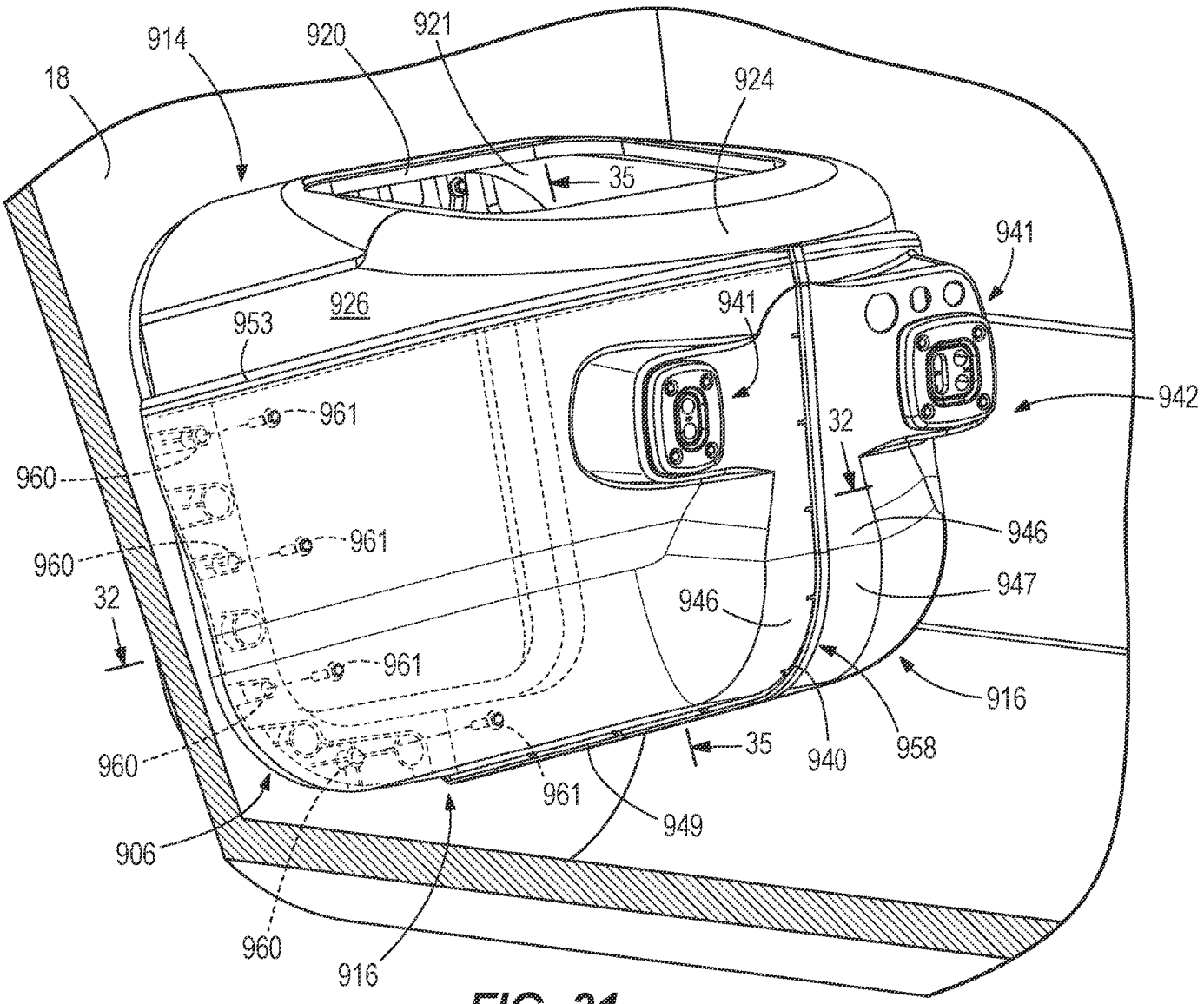
FIG. 31 is the starboard side perspective view of FIG. 30, with both side panels secured to the top cover and mounting assembly.

Referring to FIGS. 30 and 31, the opposing side panels 916 are coupled to the top panel 914 and the mounting assembly 16 one at a time. A first one of the side panels 916 is moved into position and suspended from the top cover 914. In particular, the side panel 916 is positioned proximate the transom 18 before sliding laterally onto the top panel 914 such that the U-shaped seal member 972 extending around the lower edge 925 of the top panel 914 is received in the groove 952 formed around the upper edge 953 of the side panel 916, thereby hanging the side panel 916 from the top panel 914, as illustrated in FIG. 31. Once the side panel 916 is supported by the top panel 914, fasteners 961 may be inserted through the mounting holes 960 formed through the side panel mounting flange 950 to couple the side panel 916 to the mounting assembly 16. As the fasteners are tightened, the annular seal member 970 is compressed between the side panel 916 and the mounting assembly 16 forming a seal therebetween, as illustrated in FIG. 34.

Referring to FIGS. 31 and 32, the second one of the side panels 916 is connected to the top cover 914, the mounting assembly 16, and the opposing side panel 916. As with the first side panel 916, the second side panel 916 slides laterally onto the top cover 914 such that the annular seal member 970 is received in the groove 952 formed around the upper edge 953 of the side panel 916 and the interior edges 954 of the side panels 916 abut each other at the seam 940. As the side panels come together, the protrusion 963 of the tongue-and-groove interface 598 enters the groove 965 on the opposing side panel 916, thereby forming the bottom portion 942 of the NVH dampening cover 900. As illustrated in FIGS. 31-33, fasteners 961 are inserted through the mounting holes 960 formed through the side panel mounting flange 950 to couple the side panel 916 to the mounting assembly 16, and the two side panels 916 are fastened to each other with fasteners 959 that extend through and engage the through bores 957 in corresponding mounting brackets 956, thereby coupling the opposing side panels 916 together. As the fasteners 959 are tightened, the seal member 966 (FIG. 33) in the tongue-and-groove interface 958 is compressed between the two side panels 916 to form a seal therebetween.

As illustrated in FIGS. 34 and 35, the annular seal member 970 forms a seal between the inner portion 902 of the mounting assembly 16 and the top panel 914 and opposing side panels 916, the U-shaped seal member 972 forms a seal between the top cover 914 and each of the opposing side panels 916, and the seal member 966 in the tongue-and-groove interface 958 forms a seal between the two side panels 916. Thus, the NVH dampening cover 900 provides an enclosed interior space 901 configured to house the powerhead 14 and/or any other portion of the stern drive 12.

After the mounting assembly 16 and the NVH dampening cover 900 on the transom 18, the outer portion 904 of the mounting assembly 16, the powerhead 14, and drive assembly 20 may be efficiently mounted on the transom 18 with the NVH dampening cover 900 in place. Similar to the mounting assembly 16 of FIGS. 14-22, the powerhead 14 and/or the drive assembly 20 may be suspended from the rigid mounting plate 100 (FIGS. 14 and 15) which is configured to be received in the rigid mounting ring 103 and suspended therefrom by a vibration dampening mounting ring (FIGS. 14 and 15). In such an embodiment, the preassembled outer portion 904 of the mounting assembly 16, the drive assembly 20, the rigid mounting plate 100, and the powerhead 14 may be inserted into the aperture 17 in the rigid mounting ring 103 such that the powerhead 14 is positioned inside the transom 18 and within the NVH dampening cover 900. In some embodiments, however, the powerhead 14 may be separately moved into the interior 901 of the NVH dampening cover 900 prior to attachment to the rigid mounting plate 100 (or another portion of the mounting assembly 16 or stern drive 12. The outer portion 904 of the mounting assembly 16 is then secured to the transom 18 by positioning the rigid mounting ring 103 on the exterior of the transom 18 such that the support surface 142 extends into the opening 19 and the annular rim 140 is pressed against the exterior surface of the transom 18, thereby sandwiching the O-ring 138 between the transom 18 and the rigid mounting ring 103. The fasteners 105 are then inserted through the mounting holes 141 in the annular rim 140 and the throughbore 143 in the transom 18 to engage the mounting openings 910 in the fastening ring 906, thereby clamping the rigid mounting ring 103 and the fastening ring 906 on the transom 18 and securing the mounting assembly 16 thereto. With the stern drive 12 suspended on the transom 18 by the mounting assembly 16, the powerhead 14 is enclosed within the NVH dampening cover 900. In some embodiments, some components within the NVH dampening cover 900 may be blocked or otherwise inaccessible through the opening 19 in the transom 18 and a user may access the interior 901 of the NVH dampening cover 900 via the hatch 921 in the top panel 914. For example, a user may access the interior 901 of the NVH dampening cover 900 to connect rigging connectors to the powerhead 14. In such an embodiment, the hatch 921 on the NVH dampening cover 900 may be accessible from inside the marine vessel via a hatch, trapdoor, or other opening (not shown) formed in the deck (not shown) of the marine vessel above the NVH dampening cover 900. However, since all (or nearly all) of the stern drive 12, mounting assembly 16, and NVH dampening cover 900 can be assembled on the transom 18 from the exterior of the marine vessel, only a small access opening in the deck is needed. This may be useful, for example, to maximize the available space on the deck of the marine vessel for use by the user.

In other examples, the NVH dampening cover 900 may not need any ports or hatch, for example if all routings and connections are at but inside the transom. In these examples, all connections could be made prior to insertion with extended routings and then simply tucked back inside when the stern drive 12 is installed. This potentially would allow no need for the hatch in the top of the NVH dampening cover 900, nor a hatch in the floor of the marine vessel.

When the stern drive 12 is operated, all sound and/or vibration produced by the powerhead 14 must travel through the dampening material 980 that lines the interior surfaces of the top and side panels 914, 916 before reaching the exterior of the enclosure 900. Advantageously, the dampening material 980 absorbs any sounds produced by the powerhead 14, thereby reducing the volume of the noise and/or the intensity of any vibrations from the powerhead. This may be particularly useful in reducing problematic noise and increasing overall noise quality of the stern drive 12. FIGS. 37-40 depict another example of a stern drive 12, which is like the embodiments described above, except instead of having the noted universal joint 50, the stern drive 12 shown in FIGS. 37-40 has dual (inner and outer) opposed constant velocity (CV) joints 802, 804 connected by a center shaft 806. The dual opposed CV joints 802, 804 and center shaft 806 advantageously provide dual spaced apart universal pivot axes which facilitate trimming of the stern drive 12 into the position shown in FIG. 39, above the waterline W.

More specifically, the inner CV joint 802 has an input member 808 including an input shaft 810 and a retainer cup 812 which contains an input hub member 814 and a set of ball bearings 816 disposed between the retainer cup 812 and the input hub member 814. Each ball bearing 816 is seated in a slot recess formed in the inside of the retainer cup 812 and a corresponding recess formed in the outside of the input hub member 814. The outer CV joint 804 has an output member 820 including an output shaft 822 and a retainer cup 824 which contains an output hub member 826 and a set of ball bearings 828 disposed between the retainer cup 824 and the output hub member 826. Each ball bearing 828 is seated in a slot recess formed in the inside of the retainer cup 824 and a corresponding recess formed in the outside of the output hub member 826. Like the embodiments described above, the input shaft 810 is engaged with the internally splined sleeve 56 via a splined coupling configured so that the input shaft 810 is free to telescopically move outwardly relative to the internally splined sleeve 56 and mounting assembly 16 when the drive assembly 20 is trimmed up and further so that the input shaft 810 is free to telescopically move inwardly relative to the internally splined sleeve 56 and mounting assembly 16 when the drive assembly 20 is trimmed down. Like the embodiments described above, the output shaft 822 is engaged with the driveshaft 24 via a splined coupling with the angle gearset 72 located in the driveshaft housing 22 and thus configured so that rotation of the output member 820 causes rotation of the driveshaft 24. The center shaft 806 has an inner end rotatably engaged with the input hub member 814 and an opposite, outer end rotatably engaged with the output hub member 826.

Figure 40:
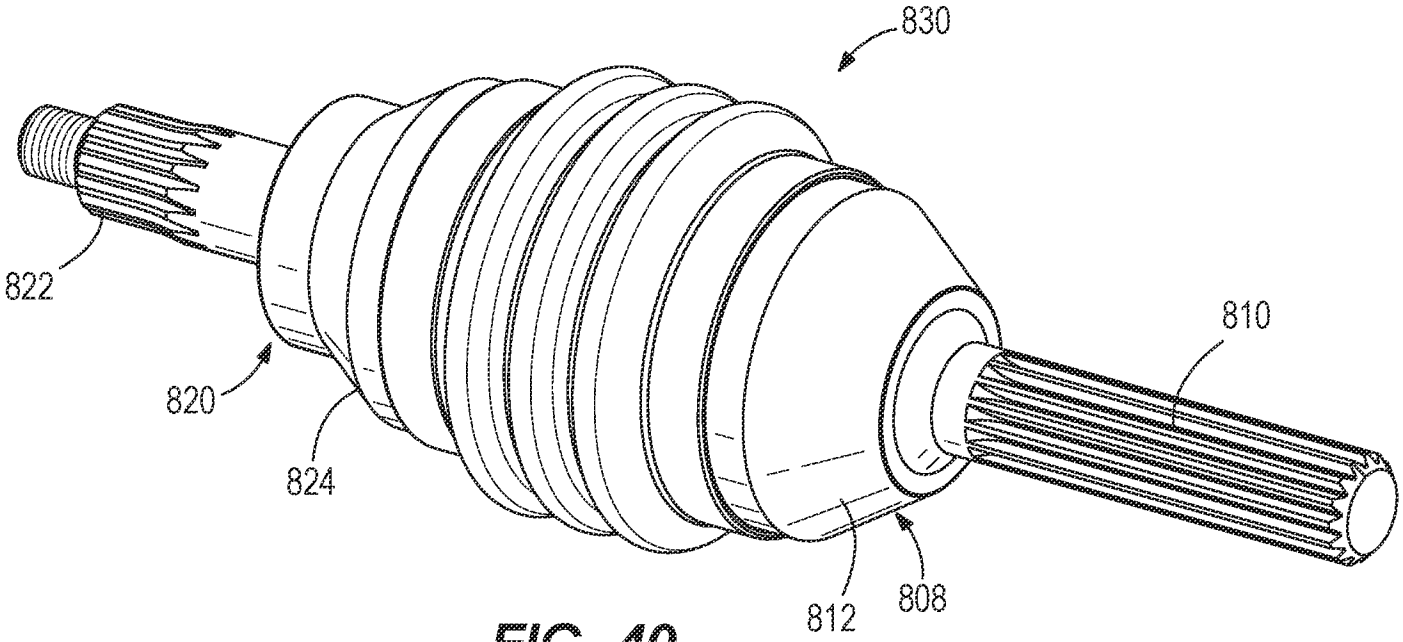
FIG. 40 is a perspective view of the dual CV joints.

Operation of the electric motor 14 causes rotation of the dual opposed CV joints 802, 804 and center shaft 806, which in turn causes rotation of the driveshaft 24 and output shaft(s) 28. The splined engagement between the input member 808 and internally splined sleeve 56 also advantageously permits telescoping movement of the input member 808 during trimming of the drive assembly 20, as described above. As shown in FIG. 40, the dual CV joints 802, 804 and center shaft 806 are enclosed in a protective, flexible bellows 830.

Figure 39:
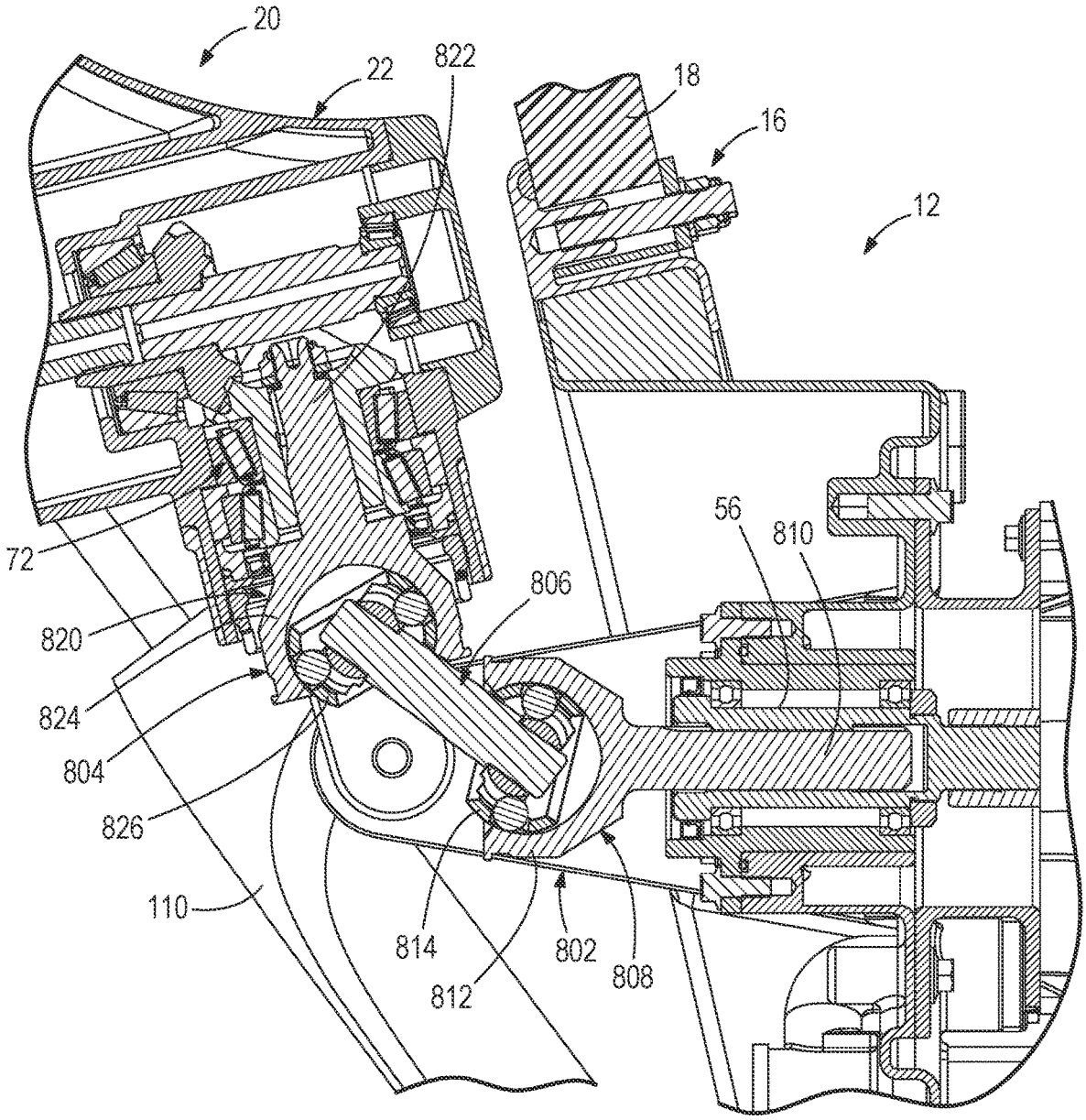
FIG. 39 is a starboard side sectional view showing the stern drive of FIG. 37 in a trimmed up position.

During trimming of the stern drive 12, each set of ball bearings 816, 828 facilitates universal (360 degree) pivoting of the center shaft 806 and respective input/output hub members 814, 826 relative to the retainer cups 812, 824. The center shaft 806 is sized long enough so the inner and outer CV joints 802, 804 are apart from each other by an axial distance which is sufficient to permit the noted dual universal pivoting, as shown in FIG. 39, facilitating raising of the drive assembly 20 out of the water. As with the example described herein above with reference to FIG. 11, the drive assembly 20 can also be steered ninety degrees off-center in the fully trimmed up position.

It will thus be understood that the present disclosure provides novel stern drive arrangements for propelling a marine vessel in water, which in non-limiting examples can be efficiently installed as a compact and yet comprehensive package via a through-bore in the transom of the marine vessel and supported (cantilevered) from the transom of the marine vessel in an easily serviced location. The above-described examples advantageously locate the high voltage components of the stern drive inside the marine vessel, including for example the electric motor 14 and associated inverter 316. The above-described examples advantageously permit efficient service, for example permitting removal of the entire unit from the rear of the marine vessel. Examples disclosed herein have an electric motor which is fixed to the marine vessel via a mounting assembly configured so that excess exposure and/or bending of electric and hydraulic cables is achieved. In non-limiting examples, the entire drive assembly is advantageously trimmable up out of the water, which avoids corrosion of the drive assembly when the marine vessel is left dormant for a long period of time. In non-limiting examples, the stern drive is compact so for example it can fit under a swim platform while the marine vessel is underway or parked for short periods of time and still able to trim completely out of the water when not in use for longer periods of time.

In the above-described examples, which are non-limiting, rubber isolation of the mounting assembly 16 is believed to work best if the center of gravity of the sprung structure is located at the transom. Locating the drive assembly 20 on the outside and locating the electric motor 14, inverter 316, heat exchanger 314, hydraulic actuator 120, glycol pump 312, and glycol reservoir, etc., cantilevered on the inside advantageously balances the weight on either side of the transom 18.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples which occur to those skilled in the art. Such other examples are intended to be within the scope of the claims if they have features or structural elements which do not differ from the literal language of the claims, or if they include equivalent features or structural elements with insubstantial differences from the literal languages of the claims.

The invention claimed is:

1. A stern drive comprising:

a drive assembly configured to propel a marine vessel in water;

a powerhead configured to power the drive assembly;

a mounting assembly configured to support the stern drive relative to a through-hole in the marine vessel, the mounting assembly including an outer portion suspending the drive assembly outside of the marine vessel and an inner portion suspending the powerhead inside of the marine vessel; and a noise-vibration-harshness (NVH) dampening cover at least partially surrounding the powerhead, the NVH dampening cover including a plurality of panels that are each configured to fit through the through-hole during assembly, wherein the plurality of panels is fastened to the inner portion of the mounting assembly from outside the marine vessel.

2. The stern drive according to claim 1, further comprising a seal configured to prevent ingress of fluid to the NVH dampening cover.

3. The stern drive according to claim 2, wherein the seal is located between the NVH dampening cover and the inner portion of the mounting assembly.

4. The stern drive according to claim 2, wherein the seal is located between two panels in the plurality of panels.

5. The stern drive according to claim 1, wherein the plurality of panels includes a top panel and opposing side panel.

6. A stern drive comprising:

a drive assembly configured to propel a marine vessel in water;

a powerhead configured to power the drive assembly;

a mounting assembly configured to support the stern drive relative to a through-hole in the marine vessel, the mounting assembly including an outer portion suspending the drive assembly outside of the marine vessel and an inner portion suspending the powerhead inside of the marine vessel; and a noise-vibration-harshness (NVH) dampening cover at least partially surrounding the powerhead, the NVH dampening cover including a plurality of panels that at least partially surrounds the powerhead, wherein the plurality of panels includes a top panel and opposing side panels; and a seal configured to prevent ingress of fluid to the NVH dampening cover, wherein the seal is located between the top panel and at least one of the side panels.

7. A stern drive comprising:

a drive assembly configured to propel a marine vessel in water:

a powerhead configured to power the drive assembly:

a mounting assembly configured to support the stern drive relative to a through-hole in the marine vessel, the mounting assembly including an outer portion suspending the drive assembly outside of the marine vessel and an inner portion suspending the powerhead inside of the marine vessel; and a noise-vibration-harshness (NVH) dampening cover at least partially surrounding the powerhead, the NVH dampening cover including a plurality of panels that at least partially surrounds the powerhead, wherein at least one of the plurality of panels comprises a slot that is engageable with a fasteners on the mounting assembly, which facilitates hanging of the plurality of panels on the mounting assembly during assembly, and thereby facilitates further installation by fastening to the mounting assembly.

8. The stern drive according to claim 1, wherein the NVH dampening cover includes at least one through-port for connecting rigging members to the powerhead.

9. A method of installing a stern drive via a through-hole in a transom of a marine vessel, the method comprising:

providing a noise-vibration-harshness dampening cover including a plurality of panels sized to fit through the through-hole;

providing a mounting assembly configured to support the stern drive relative to a through-hole in the marine vessel, the mounting assembly including an outer portion suspending a drive assembly outside of the marine vessel and an inner portion suspending a powerhead inside of the marine vessel;

coupling an inner portion of the mounting assembly to the transom;

before or after coupling the inner portion of the mounting assembly to the transom, inserting each of the plurality of panels into the marine vessel via the through-hole; and accessing the plurality of panels via the through-hole and fastening the plurality of panels to the inner portion of the mounting assembly.

10. The method according to claim 9, wherein at least one panel in the plurality of panels is fastened to the inner portion of the mounting assembly by first hanging the respective panel on a fastener extending from the inner portion of the mounting assembly and then tightening the fastener.

11. The method according to claim 9, further comprising inserting the powerhead into the marine vessel via the through-hole.

12. The method according to claim 9, further comprising coupling at least two of the plurality of panels together.

13. The method according to claim 9, further comprising positioning a seal between at least two of the plurality of panels.

14. The method according to claim 9, further comprising positioning a seal between the plurality of panels and the inner portion of the mounting assembly.

* * * * *